US006760400B2

(12) United States Patent
Watanabe et al.

(10) Patent No.: US 6,760,400 B2
(45) Date of Patent: Jul. 6, 2004

(54) EXPOSING METHOD AND SEMICONDUCTOR DEVICE FABRICATED BY THE EXPOSING METHOD

(75) Inventors: Hiroshi Watanabe, Hyogo (JP); Toyoki Kitayama, Hyogo (JP); Kouji Kise, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 32 days.

(21) Appl. No.: 10/211,309

(22) Filed: Aug. 5, 2002

(65) Prior Publication Data

US 2003/0152190 A1 Aug. 14, 2003

(30) Foreign Application Priority Data

Feb. 12, 2002 (JP) ..... 2002-034155

(51) Int. Cl.[7] ..... G21K 5/00
(52) U.S. Cl. ..... 378/34; 250/492.2
(58) Field of Search ..... 378/34, 35; 250/492.2

(56) References Cited

U.S. PATENT DOCUMENTS 4,425,423 A * 1/1984 Wang ..... 430/264
5,123,036 A * 6/1992 Uno et al. ..... 378/34
2001/0021239 A1 9/2001 Itoga et al.

FOREIGN PATENT DOCUMENTS

JP 2000-338299 12/2000

OTHER PUBLICATIONS

Takigawa, Tadahiro, "The Innovation of ULSI Lithography", *Science Forum Co. Ltd., 1st Edition*, p. 222 (Nov. 10, 1994).

Itoga, K. et al.: "Effect of secondary electron from the substrate in X–ray lithography using harder radiation spectra", *J. of Vacuum Sci. & Technol. B*, vol. 19, No. 6, pp. 2439–2443 (Nov./Dec. 2001).

Kise, K. et al., "Suppression of secondary electron blur by using Br–containing resists in X–ray lithography", *J. of Vacuum Sci. Technol. B*, vol. 20, No. 6, pp. 2953–2957 (Nov/Dec. 2002).

Khan, M. et al.: "Extension of x–ray lithography to 50 nm with a harder spectrum", *J. Vac. Sci. Technol.*, B 17(6), pp. 3426–3432, (Nov./Dec. 1999).

Feldman, M. et al.: "Resolution limits in x–ray lithography", *J. Vac. Sci. Technol.*, B. 10(6), pp. 3173–3176, (Nov./Dec. 1992).

Smith, H. et al.; "X–ray lithography—A review and assessment of future applications", *J. Vac. Sci. Technol.*, 17(1), pp. 533–535, (Jan./Feb. 1980).

* cited by examiner

*Primary Examiner*—Craig E. Church
(74) *Attorney, Agent, or Firm*—Leydig, Voit & Mayer, Ltd.

(57) ABSTRACT

In an exposing method reflecting synchrotron radiation, having a critical wavelength of 8.46 Å, emitted from a radiation generator (SR device) having a deflecting magnetic field of 4.5 T and electron acceleration energy of 0.7 GeV twice through rhodium mirrors having an oblique-incidence angle of 1°, transmitting the light through a beryllium window of 20 μm and through an X-ray mask prepared by forming an X-ray absorber pattern on a diamond mask substrate of 2 μm in thickness and thereafter irradiating a resist surface provided on a substrate with the light, the resist has a main absorption waveband in the wave range of at least 3 Å and not more than 13 Å and contains an element generating Auger electrons having energy in the range of at least about 0.51 KeV and not more than 2.6 KeV upon exposure.

11 Claims, 39 Drawing Sheets

EXPOSING METHOD AND SEMICONDUCTOR DEVICE FABRICATED BY THE EXPOSING METHOD

BACKGROUND OF THE INVENTION

1. Field of the Invention

The present invention relates to a resist for a fine pattern forming technique, a resist process technique and an exposing method. More particularly, the present invention relates to a technique mainly employed for a system for transferring a fine pattern formed on a mask by an X-ray proximity exposure technique in a technique of transferring a fine pattern for fabricating a semiconductor integrated circuit, for enabling transfer of a finer pattern at a higher speed than the prior art.

2. Description of the Background Art

FIG. 1 shows representative results of the relation between resolution and exposure wavelengths in X-ray proximity exposure. Referring to FIG. 1, the horizontal axis shows the exposure wavelengths (Å), and the vertical axis shows the resolution (nm). It has been regarded that the resolution in X-ray proximity exposure is decided by two different factors, i.e., the resolution limit of an optical image decided by Fresnel diffraction and the resolution limit decided by blurring resulting from the so-called secondary electrons, i.e., pattern blurring (reduction of resolution: hereinafter simply referred to as blurring) resulting from sensitization of a resist with photoelectrons and Auger electrons generated in the resist irradiated with exposure light.

The resolution limit R resulting from Fresnel diffraction is expressed as follows:

$$R=k\cdot(\lambda\cdot D)^{1/2}$$

where k represents a constant, λ represents the exposure wavelength, and D represents the distance between a mask and a wafer. It is understood from the above equation that the resolution is increased as the exposure wavelength as well as the distance between the mask and the wafer are reduced.

On the other hand, blurring caused by secondary electrons generated in the resist irradiated with X-rays is proportionate substantially to the $1.75^{th}$ power of X-ray energy of the exposure wavelength. It has been regarded that the so-called ground range ($=46/\sigma\times E^{1.75}$, where σ represents the density ($g\cdot cm^3$) of the resist and E represents the energy (KeV) of electrons) of the secondary electrons in the resist decides the resolution.

However, it has recently been clarified by more detailed experimental study and theoretical study that blurring of electrons is smaller than the ground range and the resolution limit resulting from the blurring of electrons moves toward a short-wave side. According to this clarification, it follows that the optimum wavelength for obtaining a pattern of high resolution can be newly reduced from the conventional level of 7 Å to 6 Å in the case of 10 μm gap. However, it has been understood that the actual resolution limit is decided not only by Fresnel diffraction but also by blurring resulting from secondary electrons. In other words, the curves shown in FIG. 1 are plotted on the assumption that the actual resolution is decided by the average sum of squares of the two resolution limits deciding the resolution. According to FIG. 1, it follows that the resolution cannot be much increased by reducing the exposure wavelength, and hence short-wave exposure has not been studied.

SUMMARY OF THE INVENTION

The present invention has been proposed on the basis of recognition obtained by making detailed study in relation to blurring resulting from secondary electrons such as photoelectrons and considering conditions for increasing resolution by reducing the exposure wavelength. The present invention relates to a technique of spreading the limit of application of the X-ray proximity exposure technique to a fine region for transferring a pattern of high resolution at a high speed. Thus, the present invention aims at solving a problem caused in a technique for improving resolution by reducing the resolution limit resulting from Fresnel diffraction by employing X-rays having a shorter wavelength than that studied in the conventional X-ray proximity exposure technique for exposure.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 2:
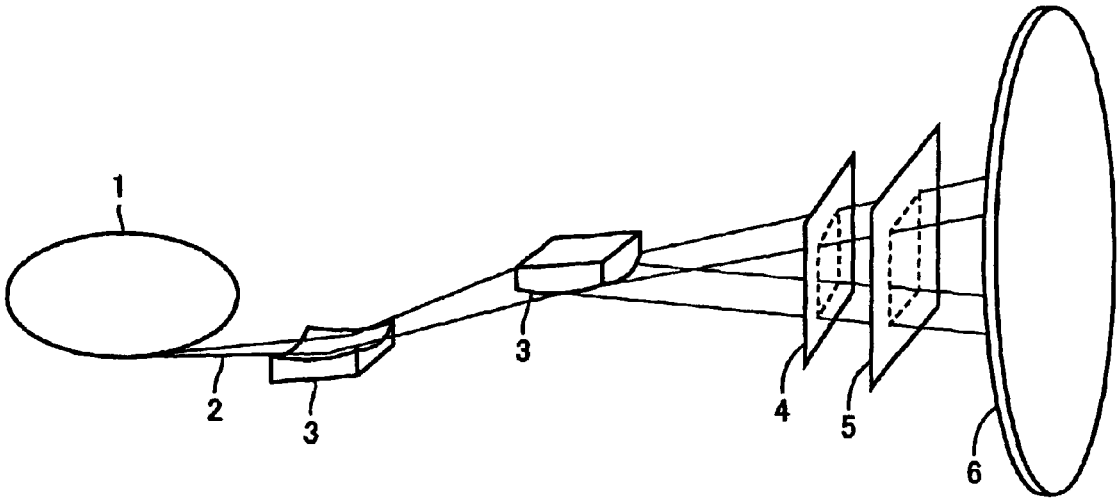
FIG. 2 illustrates the structure of a short-wave exposure system according to the present invention.
Figure 3:
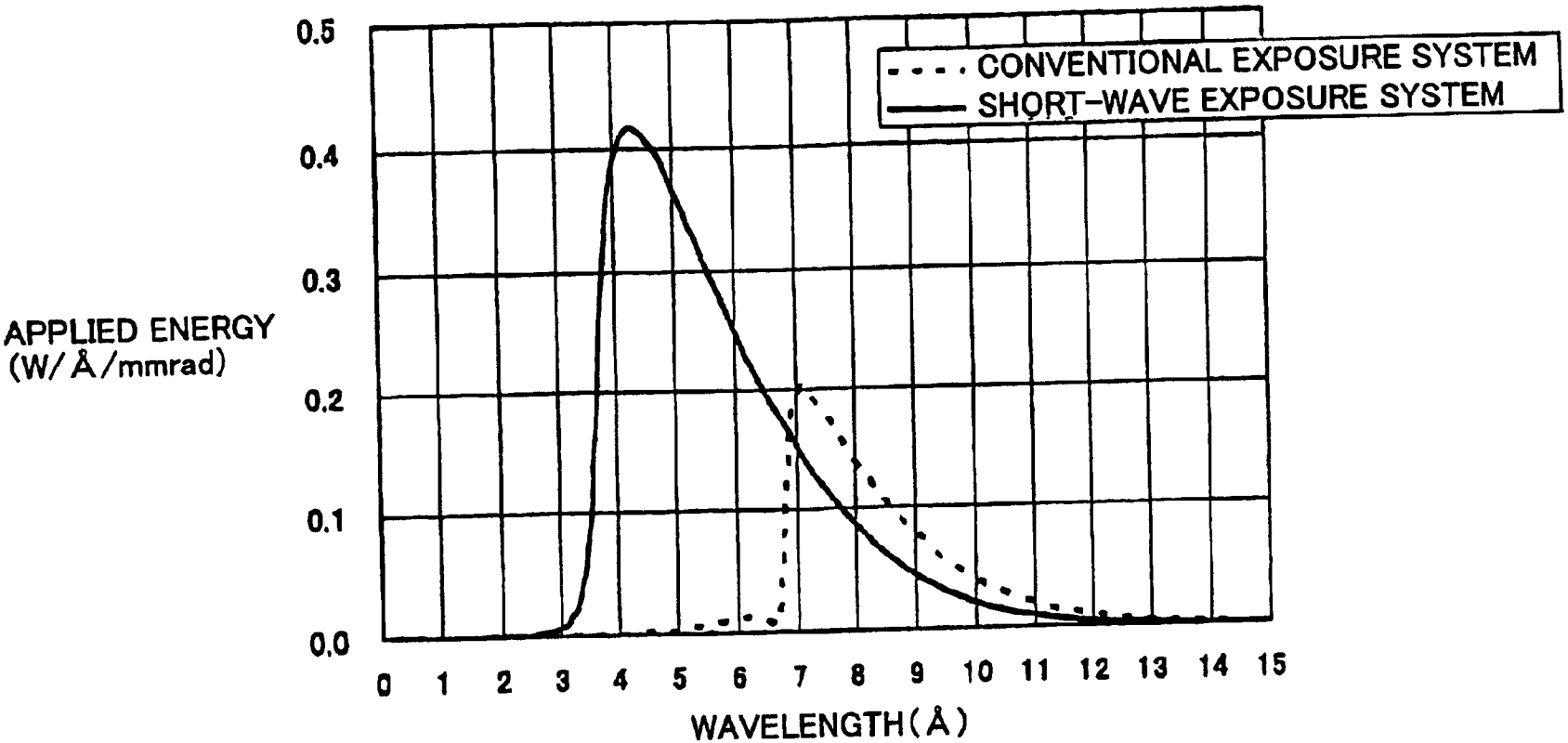
FIG. 3 illustrates an exemplary spectrum of exposure light employed for a short-wave exposure system.

FIG. 2 shows the structure of a short-wave exposure system assumed in the present invention. FIG. 3 illustrates an exemplary representative spectrum of exposure light employed in this short-wave exposure system. Referring to FIGS. 2 and 3, this system reflects synchrotron radiation 2 having a critical wavelength of 8.46 Å emitted from a radiation generator (SR device) 1 having a deflecting magnetic field of 4.5 T and electron acceleration energy of 0.7 GeV twice through rhodium mirrors 3 having an oblique incidence angle of 1° and transmits the synchrotron radiation 2 through a beryllium window 4 of 20 μm and an X-ray mask 5 prepared by forming an X-ray absorber pattern on a diamond mask substrate having a thickness of 2 μm for thereafter irradiating a resist surface 6 provided on a substrate with this synchrotron radiation 2.

For the purpose of comparison, FIG. 3 also shows an exemplary spectrum in a conventional X-ray exposure system employing silicon carbide mirrors and a silicon carbide mask substrate having a thickness of 2 μm. The conventional X-ray exposure system mainly employs light having a wavelength longer than 7 Å on an absorption edge of silicon. On the other hand, the short-wave exposure system according to the present invention employs light of a wavelength, including that shorter than 7 Å, up to about 3 Å.

While a system employing X-rays emitted from a radiation generator is mainly described, the present invention is not restricted to the X-rays emitted from the radiation generator but a similar effect is attained also in an exposure technique employing another X-ray source such as a plasma X-ray source. Further, a similar effect is attained also in an exposure technique employing an electron beam substantially identical in energy to the X-rays.

Exposure with short-wave X-rays has been regarded as difficult in relation to the X-ray proximity exposure technique since it has been regarded that the range of secondary electrons generated in a resist irradiated with exposure light decides the resolution limit, which in turn is reduced due to reduction of the wavelength. The resolution of an optical image is increased in proportion to the square root of the shortened exposure wavelength, and increased by reducing the distance between the mask and the wafer.

On the other hand, it has been regarded that blurring is caused on a short-wave side due to secondary electrons consisting of photoelectrons and Auger electrons and there is a limit resulting from the blurring limiting the resolution, i.e., a resolution limit resulting from the secondary electrons. The resolution limit resulting from the secondary electrons has recently been changed to a higher resolution side and corrected to a direction enabling reduction of the wavelength through experiments and calculations. However, the resolution is influenced by both of the resolution limit resulting from Fresnel diffraction and that resulting from the secondary electrons, and hence it has been concluded as difficult to increase the resolution by reducing the wavelength of the exposure light.

In other words, the present invention aims at solving the problem of limitation of the resolution caused by blurring resulting from secondary electrons in a resist irradiated with exposure light. An object of the present invention is to increase the resolution by short-wave exposure by solving this problem.

In exposure with light having energy by far higher than that necessary for chemical reaction in the X-ray proximity exposure technique or the like or with accelerated electrons or ions, i.e., high-energy exposure, secondary electrons such as photoelectrons and Auger electrons generated in a resist irradiated with the exposure light excite chemical reaction of the resist for forming a pattern. In other words, the electrons secondarily generated in the resist are important for exposure. The electrons generated upon irradiation with exposure light have been studied in detail.

Figure 1:
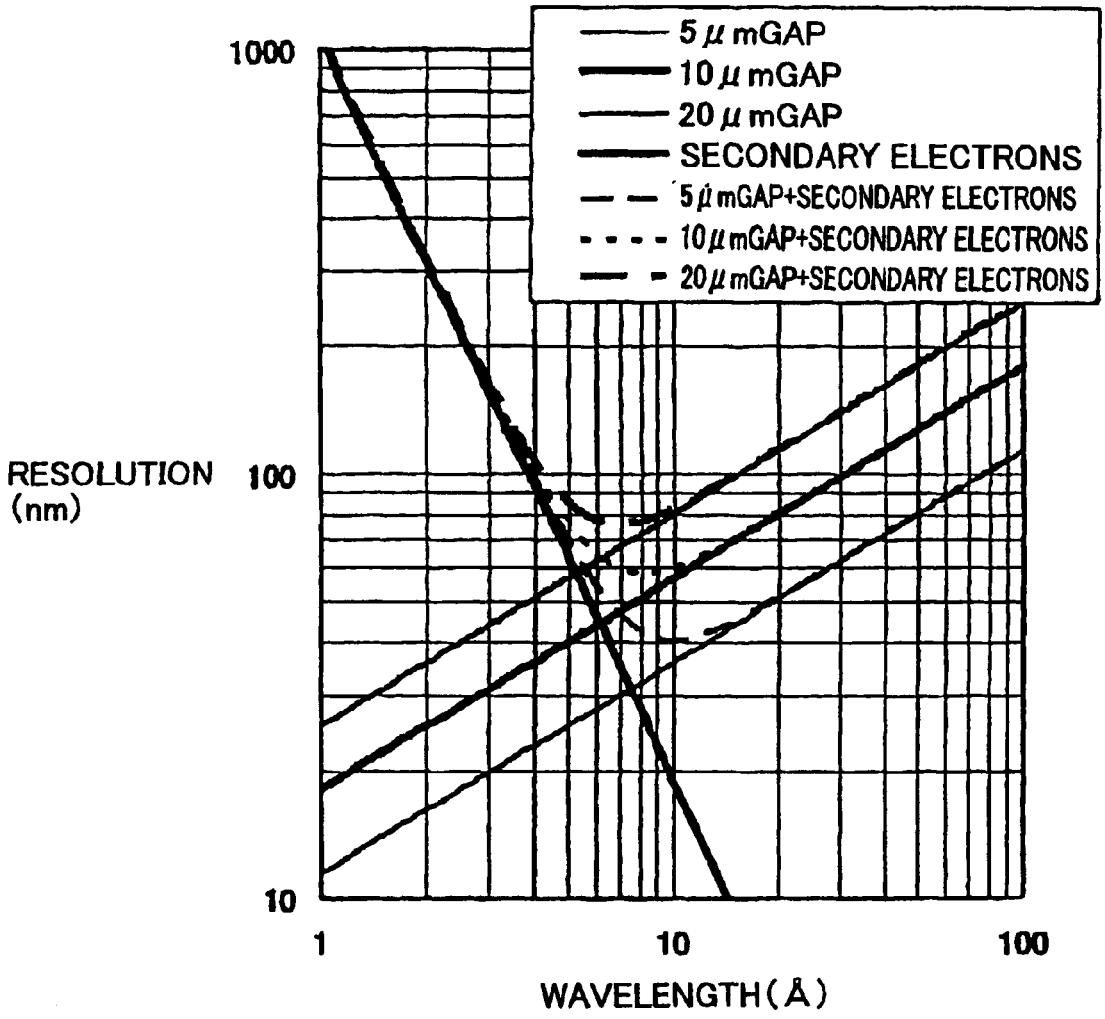
FIG.1 PRIOR ART
FIG. 1 is a representative diagram showing the relation between resolution in X-ray proximity exposure and exposure wavelengths.

As to values generally employed for deciding blurring resulting from secondary electrons in evaluation of the resolution in the X-ray proximity exposure shown in FIG. 1, the energy of the exposure wavelength has been regarded as the energy of generated electrons as such, for obtaining the straight lines of the resolution limits in consideration of the ground range of the electrons in the resist etc. This is because values substantially accounting for the experimental fact have been obtained in an exposure waveband longer than the conventionally employed wavelength of 7 Å.

It has been found out that the situation is remarkably changed by an element forming the resist in the inventive exposure waveband including the wavelength shorter than 7 Å. The present invention has been proposed on the basis of recognition obtained by studying secondary electrons generated from an element forming the resist in detail.

Absorption edges of various light elements are present in the exposure waveband for the short-wave exposure including X-rays having a wavelength shorter than 7 Å mainly assumed in the present invention, i.e., the energy band up to about 3 KeV. The situation of the generated photoelectrons and Auger electrons remarkably vary around the absorption edges. This has been utilized to propose the present invention. In other words, the present invention has been proposed not by directly employing the energy of the conventionally employed exposure light as the energy of electrons for deciding blurring but by noting that blurring is decided by the energy of electrons generated in a resist in practice and re-evaluating the resolution limit.

Figure 4:
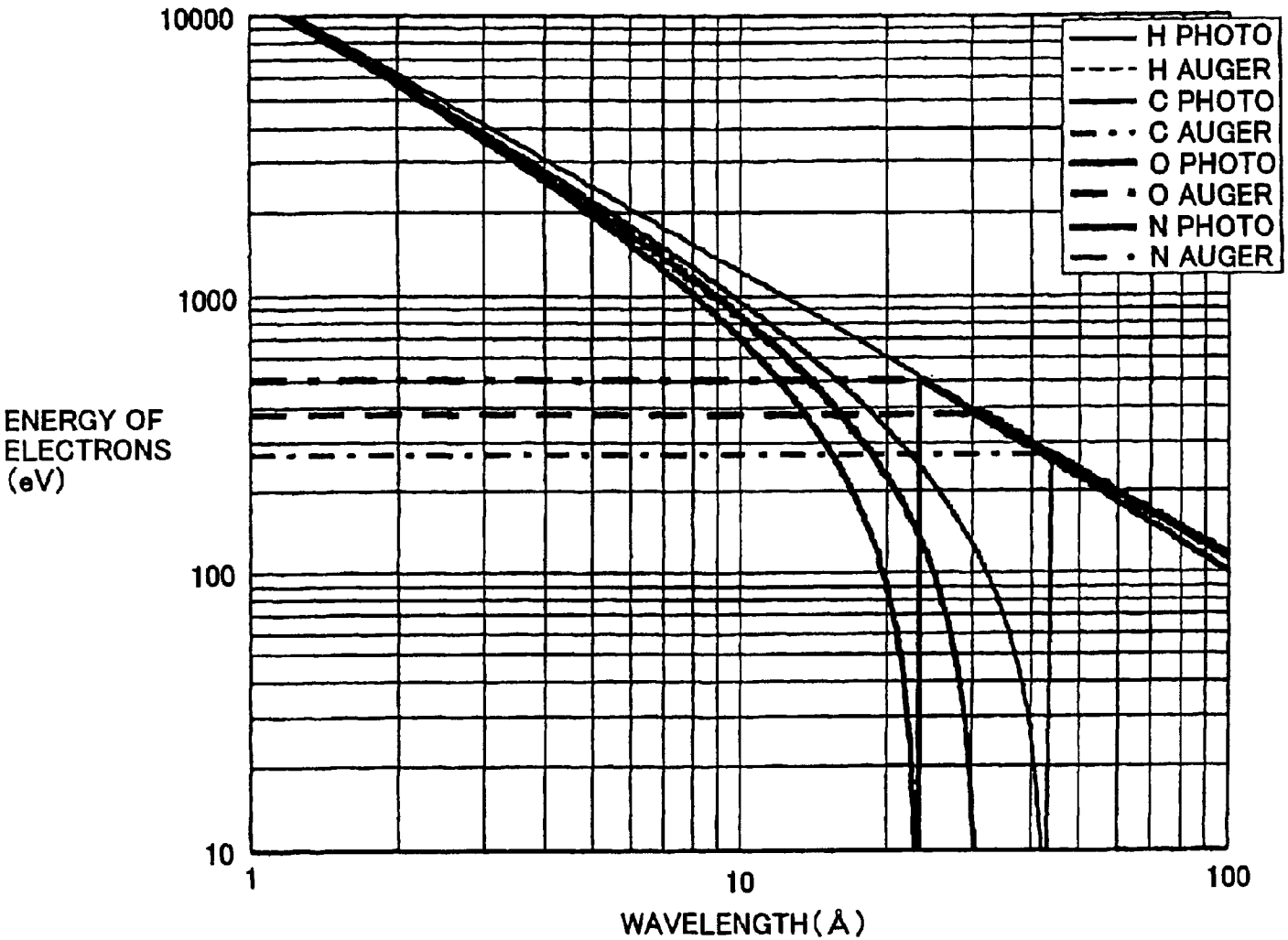
FIG. 4 illustrates energy levels of photoelectrons and Auger electrons generated from hydrogen, oxygen, carbon and nitrogen irradiated with X-rays.

FIG. 4 shows energy levels of secondary electrons generated from elements irradiated with X-rays. Referring to FIG. 4, the horizontal axis shows the wavelengths (Å) of the applied X-rays, and the vertical axis shows the energy levels (eV) of the generated secondary electrons. While photoelectrons and Auger electrons are generated by X-ray irradiation, the energy of the photoelectrons is obtained by subtracting binding energy of excited electrons from the energy of the exposure wavelength. The energy of the Auger electrons is obtained by further subtracting binding energy of outer-shell electrons from the energy difference between excited levels and the levels of the outer-shell electrons. If the binding energy of the outer-shell electrons is small, the energy of the Auger electrons substantially matches with the energy of simultaneously generated characteristic X-rays.

The ratio of generating not secondary electrons but X-rays is shown by a value referred to as a fluorescence yield. The fluorescence yield in this energy band is about 2 to 3 percent, and those generated in the resist exposed with the X-rays can be substantially regarded as secondary electrons.

Electrons generated in the resist exposed with the X-rays in the first place are secondary electrons consisting of photoelectrons and Auger electrons, with no generation of electrons having higher energy. The photoelectrons and Auger electrons as well as characteristic X-rays are absorbed by the resist again for generating low-energy electrons sensitizing the resist with lower energy than that of the secondary electrons generated in the first place.

Blurring resulting from secondary electrons is increased in proportion to the energy, and hence low-energy electrons generated from the resist re-absorbing the secondary electrons and the characteristic X-rays generated from the photoelectrons and the Auger electrons absorbed by the resist do not reduce the resolution as compared with the secondary electrons generated in the first place.

The photoelectrons and the Auger electrons must be regarded as the factor limiting the resolution in the X-ray exposure technique. In other words, the energy of electrons to be employed in the straight lines of the resolution resulting from the secondary electrons in FIG. 1 is not the energy of the exposure light but the energy of the secondary electrons consisting of photoelectrons and Auger electrons shown in FIG. 4 at the maximum. This electron energy decides the resolution limit caused by blurring resulting from secondary electrons.

PMMA (polymethyl methacrylate) forming a representative resist consists of hydrogen, carbon and oxygen. Absorption edges (i.e., binding energy of electrons) of these elements are on a low-energy side, and hence the energy of photoelectrons obtained as the difference between the energy of the applied X-rays and the binding energy is close to the energy of the exposure wavelength not only in the waveband of the conventional X-ray exposure but also in the waveband for the short-wave exposure.

So far as an organic resist mainly composed of carbon similar to PMMA is employed, therefore, the energy of electrons employed in the straight lines of resolution resulting from secondary electrons shown in FIG. 1 is close to the energy of the exposure wavelength. Consequently, it follows that the generally employed relation between the wavelengths and the resolution substantially holds also in the organic resist mainly composed of carbon similar to PMMA.

When a resist material having an X-ray absorption edge in the vicinity of the exposure waveband is irradiated with X-rays, however, the situation of generated secondary electrons is remarkably changed. For example, bromine has an X-ray absorption edge in the vicinity of 8 Å, and the quantity of generated secondary electrons is abruptly increased on an immediate short-wave side of the absorption edge. The energy of photoelectrons included in the secondary electrons, obtained by subtracting the binding energy of electron levels on the absorption edge from the energy of the X-rays employed for exposure, is abruptly reduced on the short-wave side of the absorption edge, not to exceed the energy on the absorption edge up to about 4 Å.

The energy of Auger electrons, in the range of 1.2 to 1.4 KeV, corresponds to a wavelength of 9 to 10 Å. Also when the energy of the exposure wavelength is increased to about 4 Å, electrons having higher energy than that corresponding to 9 to 10 Å are generated only in a small quantity. The present invention thus reduces blurring resulting from secondary electrons generated in a resist by short-wave exposure for forming a pattern of high resolution.

Means of the present invention, described with reference to bromine in the above, are now described.

[Means 1]

An exposing method of condensing or magnifying X-rays generated from an X-ray source through an X-ray mirror in a beam line, thereafter transmitting the X-rays through a window member serving as a vacuum barrier and further transmitting the X-rays through an X-ray mask consisting of a mask substrate and an absorber pattern formed thereon for irradiating a resist with the X-rays serving as exposure light employs a resist having a main absorption waveband in the wave range of 3 Å to 13 Å and containing an element generating Auger electrons having energy in the range of at least about 0.51 KeV and not more than 2.6 KeV upon exposure.

Also when the wavelength is reduced, blurring of electrons is hardly increased due to generation of Auger electrons having constant energy. Further, the energy of photoelectrons is lower than the energy of photoelectrons generated from a conventional resist mainly consisting of carbon, oxygen, nitrogen and hydrogen, and hence blurring of photoelectrons can also be reduced as compared with the case of employing the conventional resist.

[Means 2]

A resist containing an element mainly generating Auger electrons in the range of at least about 0.51 KeV and not more than 2.6 KeV upon exposure with an electron beam having an acceleration voltage of at least 1.5 KeV is employed. Also when the acceleration voltage is increased, blurring of electrons is hardly increased due to generation of Auger electrons having constant energy.

[Means 3]

A resist containing an element, mainly absorbing exposure light, generating Auger electrons having energy higher than the energy of photoelectrons is employed. Electrons generated from the resist upon exposure include Auger electrons having constant energy and photoelectrons having lower energy than the Auger electrons. Consequently, a pattern of high resolution can be formed with small blurring of electrons also when the wavelength of the exposure light is reduced.

[Means 4]

A resist having a main absorption waveband in the wave range of 3 to 13 Å and containing an element generating Auger electrons having energy higher than the energy of photoelectrons upon exposure is employed while selecting the wave range where the Auger electrons have higher energy than the photoelectrons for exposure. The energy of generated photoelectrons is limited to be lower than the energy of Auger electrons, and hence the quantity of high-energy electrons is reduced. Further, blurring of electrons can be reduced and a pattern of high resolution can be formed.

[Means 5]

A resist having a main absorption waveband in the wave range of 3 to 13 Å and containing an element generating Auger electrons having energy higher than the energy of photoelectrons upon exposure is employed while performing exposure in the wave range where the energy of photoelectrons is substantially equal to or not more than the energy of Auger electrons of carbon. Blurring of electrons is further suppressed due to employment of electrons having extremely low energy, for obtaining a pattern of ultrahigh resolution.

[Means 6]

A resist having a main absorption waveband in the wave range of 3 to 1.3 Å and containing an element generating Auger electrons having energy in the range of about 0.51 KeV to 2.6 KeV is employed while performing exposure in the wave range where the energy of photoelectrons is not more than 1.4 KeV. The energy of photoelectrons is smaller than the energy corresponding to the wavelength of 13 Å also in the short-wave range, and hence blurring of electrons can be reduced. The constant energy of Auger electrons is not increased also when the wavelength is reduced.

[Means 7]

An X-ray exposing method condensing or magnifying X-rays generated from an X-ray source in a beam line comprising an X-ray mirror and thereafter transmitting the X-rays through a window member serving as a vacuum barrier for transferring an X-ray mask pattern to a resist exposes the resist with an illumination optical system comprising a wavelength sweeper capable of changing a wavelength without changing an optical axis to a condensing X-ray mirror or a magnifying X-ray mirror in the beam line.

The exposure wave range can be selected without changing the material for or the X-ray oblique incidence angle of the condensing X-ray mirror or the magnifying X-ray mirror already built into the system.

The wavelength sweeper is now described.

Reflectance against a short wavelength is reduced when an X-ray oblique incidence angle in an X-ray mirror is increased. In this regard, the wavelength sweeper cuts a short-wave component by controlling the oblique incidence angle. The wavelength sweeper is an illumination optical system combined with at least two X-ray mirrors for cutting an X-ray wave component of a short-wave range without changing the original optical axis of the X-rays.

Figure 5:
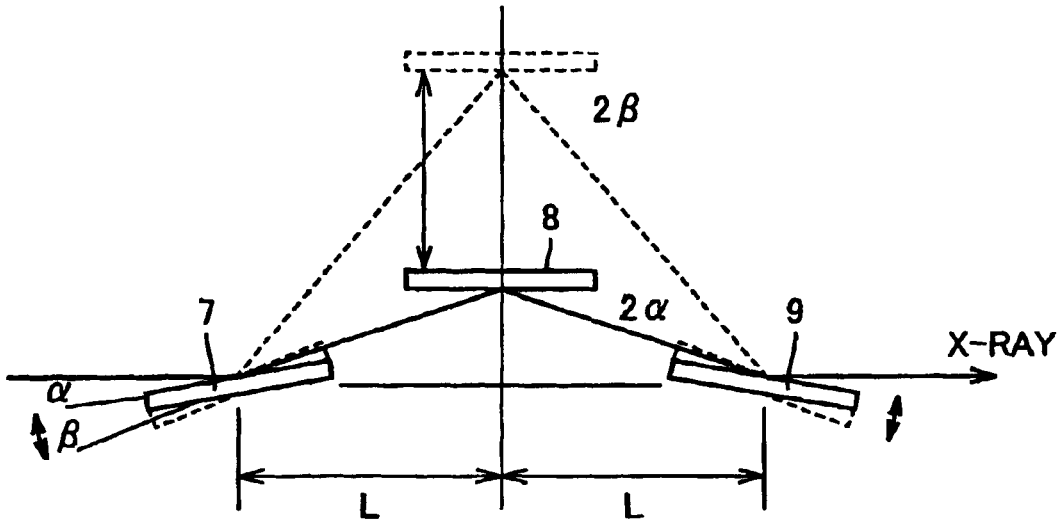
FIG. 5 illustrates the structure of a wavelength sweeper of a system employing three X-ray mirrors.

FIG. 5 is a block diagram showing a wavelength sweeper of a system employing three X-ray mirrors 7, 8 and 9. The distance L between the first and second X-ray mirrors 7 and 8 along the X-axis direction is constant. The distance L between the second and third X-ray mirrors 8 and 9 is also constant along the X-axis direction. The first and third X-ray mirrors 7 and 9 are fixed in position, and have rotation mechanisms about an axis perpendicular to the plane of FIG. 5.

The second X-ray mirror 8 has a function of making translation along the y-axis direction. The position of the second X-ray mirror 8 and the angle of the third X-ray mirror 9 are so adjusted that oblique incidence angles in the second and third X-ray mirrors 8 and 9 reach $2\alpha$ and $\alpha$ respectively when X-rays enter the first X-ray mirror 7 at an oblique incidence angle $\alpha$. Thus, the optical axes of the X-rays entering the first X-ray mirror 7 and outgoing from the third X-ray mirror 9 can be substantially equalized with each other.

The position of the second X-ray mirror 8 and the angle of the third X-ray mirror 9 are so adjusted that oblique incidence angles in the second and third X-ray mirrors 8 and 9 reach $2\beta$ and $\beta$ respectively when the first X-ray mirror 7 is so rotated that the X-rays enter the first X-ray mirror 7 at an oblique incidence angle $\beta$. Therefore, the optical axes of the X-rays can be substantially equalized with each other. Thus, the oblique incidence angles in the X-ray mirrors 7, 8 and 9 can be adjusted while leaving the optical axes of the X-rays substantially unchanged, so that the wave range of the X-rays can be selected through difference in reflectance varying with the oblique incidence angles.

[Means 8]

An exposing method of condensing or magnifying X-rays generated from an X-ray source through a beam line comprising an X-ray mirror and thereafter transmitting the X-rays through an X-ray filter and a window member serving as a vacuum barrier for transferring an X-ray mask pattern to a resist employs a beam line comprising an illumination optical system formed by combining at least two plane mirrors having surface coating materials varying with positions of the surfaces of the mirrors. A short-wave component can be reduced without changing a condensing or magnifying X-ray mirror.

[Means 9]

A resist contains a material selected from a group consisting of fluorine, iodine and germanium. The absorption edge of such an element is on a side longer than 10 Å, and hence a pattern is formed with secondary electrons having lower energy than photoelectrons of carbon with respect to conventional X-ray exposure light of 7 to 10 Å, thereby improving resolution.

[Means 10]

A resist having a main absorption waveband in the wave range of 3 to 13 Å or containing an element generating Auger electrons having energy in the range of at least about 0.51 KeV and not more than 2.6 KeV upon exposure with an electron beam of at least 1.5 KeV is employed for forming a resist pattern on a substrate and fabricating a semiconductor device by working the resist pattern.

[Function]

A technique of improving resolution by reducing a wavelength includes a method of reducing an irradiation wavelength and a method of reducing a wavelength absorbed by a resist while leaving the irradiation wavelength intact. An object of the present invention implementing improvement of resolution by obtaining an optical image having high resolution through exposure with X-rays having a short wavelength is to reduce blurring resulting from secondary electrons in a resist. Therefore, the present invention proposes a method of controlling the energy of secondary electrons generated in the resist by selecting the element forming the resist and a wave range.

Figure 6:
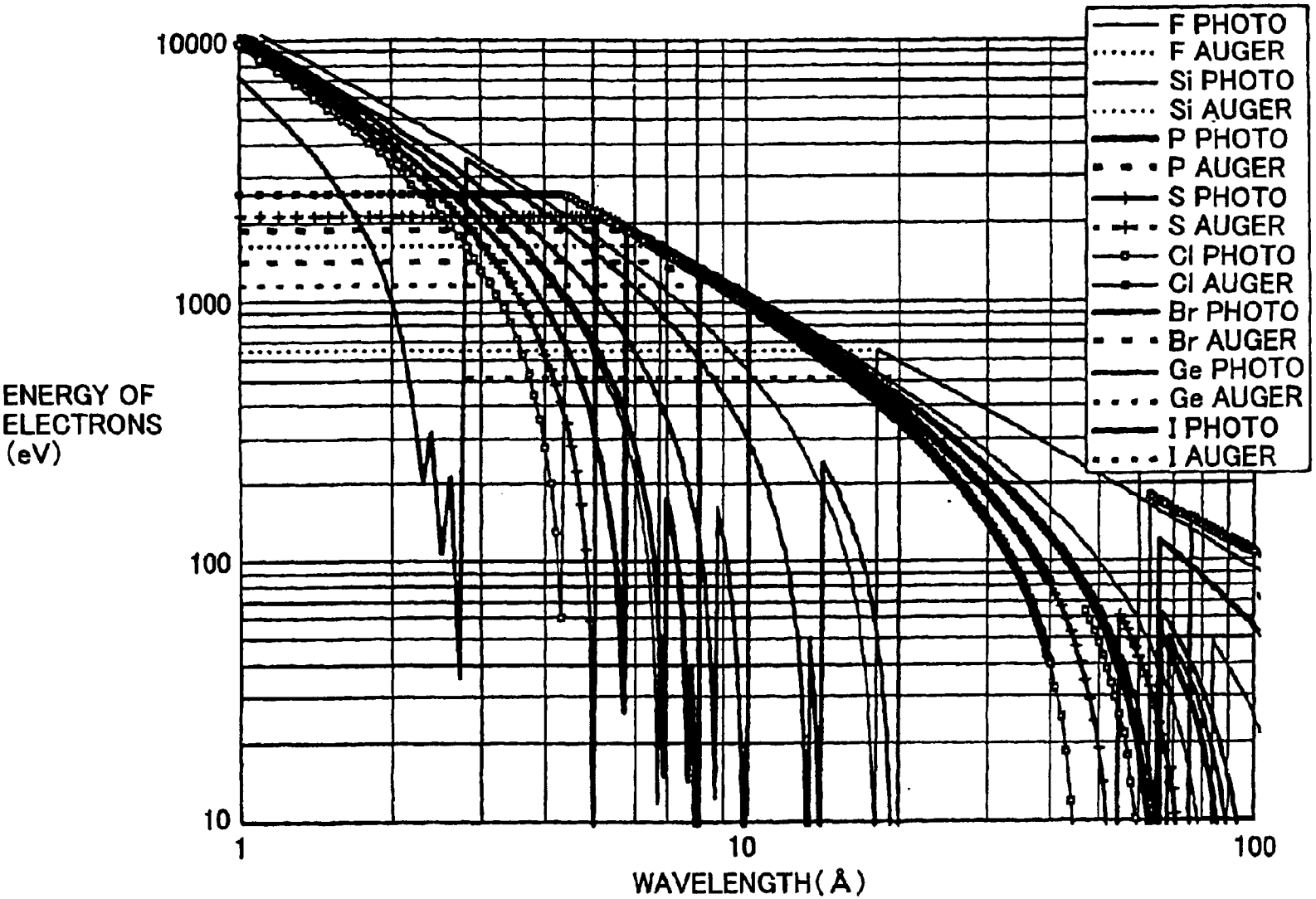
FIG. 6 illustrates excitation wavelength dependence of energy levels of photoelectrons and Auger electrons generated from fluorine, silicon, phosphorus, sulfur, chlorine, bromine, germanium and iodine, which are candidate elements for forming a resist.

FIGS. 4 and 6 illustrate excitation wavelength dependence of energy of photoelectrons and Auger electrons generated from candidate elements for forming the resist. The energy of photoelectrons, increased as the excitation wavelength is reduced, is abruptly reduced once on a short-wave side of the absorption edge of each element. On the other hand, the energy of Auger electrons takes a constant value on the short-wave side of the absorption edge. In other words, generated electron energy is not increased on an immediate short-wave side of the absorption edge also when the wavelength for exposure is reduced but it follows that Auger electrons taking a constant value and photoelectrons having energy lower by at least one digit are generated.

In any case, the energy of these electrons generated in the resist irradiated with X-rays is generally reduced as compared with the energy of the X-rays applied for exposure, and the electrons of this energy provide blurring influencing the resolution. The quantity absorbed by the resist is reduced as the energy of electrons is increased, and low-energy electrons are readily absorbed by the resist. These factors influence the resolution, to come to decide blurring resulting from secondary electrons.

Figure 7:
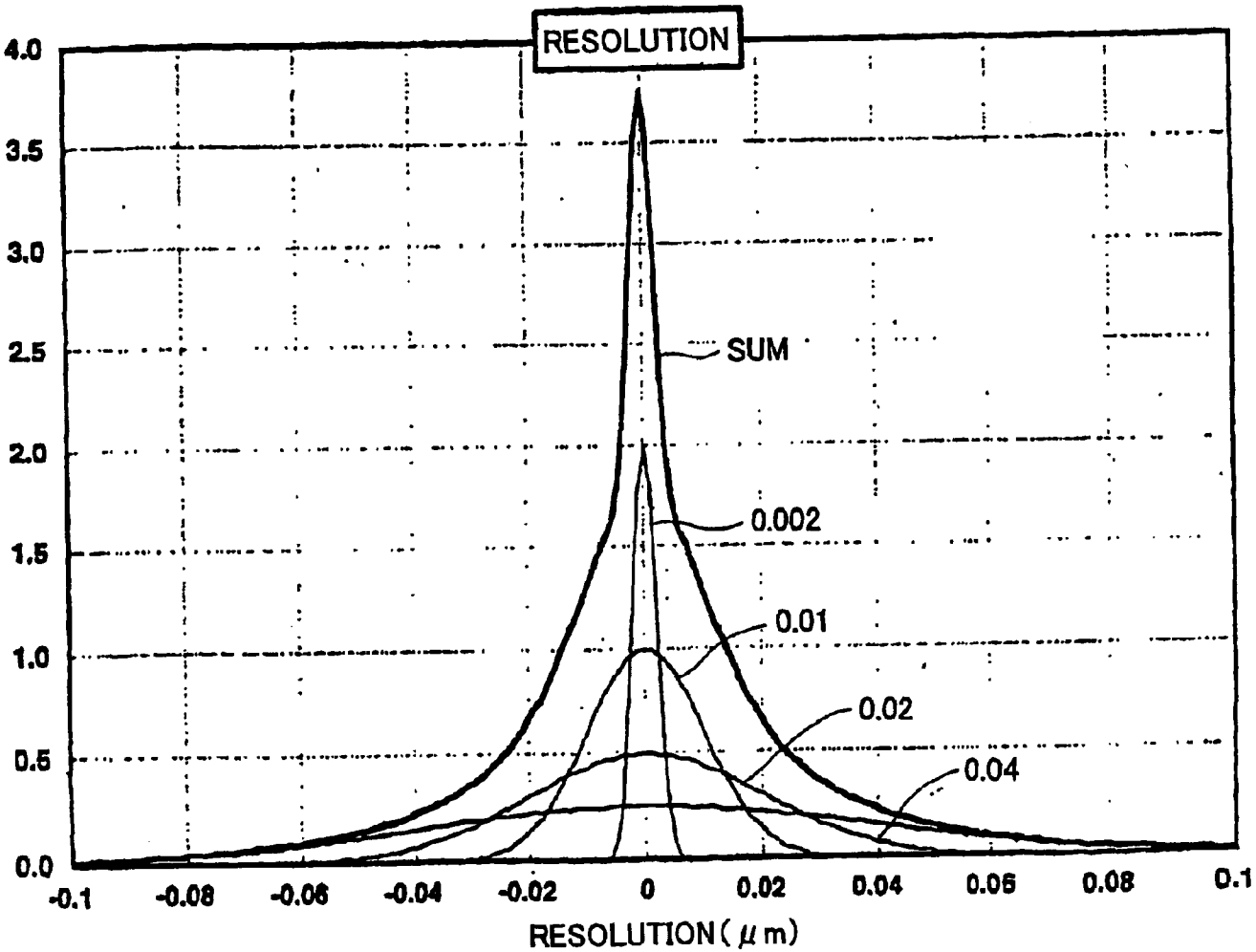
FIG. 7 illustrates the sum of energy storage distribution of four types of electrons having different energy levels generated at different ratios.

FIG. 7 shows results of evaluation of influence exerted on resolution by electrons, having various energy levels, generated in a resist at different ratios. It is assumed that four types of electrons having different energy levels are generated at different ratios. Referring to FIG. 7, the vertical axis shows stored energy in the resist, and the horizontal axis shows the arrival ranges of electrons, i.e., resolution. High-energy electrons cause blurring over a wide range and exert influence between patterns, while low-energy electrons have high absorption power in the resist with a small arrival range and small blurring resulting from secondary electrons, to influence the pattern quality.

Observing the stored energy in the resist containing low-energy electrons, it follows that a stored energy distribution profile having a sharp spire by the low-energy electrons is obtained. When setting a slice level in a development process to this spire part, it follows that a high-resolution pattern is obtained. When the ratio of low-energy electrons is large, it follows that the slice level range is wide to spread selection ranges for the resist material and development conditions. It is consequently obvious that the range of conditions for obtaining a high-resolution pattern is so wide that a high-resolution pattern can be readily obtained.

Observing this relation, it is understood that not only the range of high-energy electrons but electrons of a low-energy range may rather strongly influence the resolution, and electrons of optimum energy most influencing the resolution are present. The influence by high-energy electrons is observed as influence on an adjacent pattern in a case of a high-density pattern, to influence the resolution.

Figure 8:
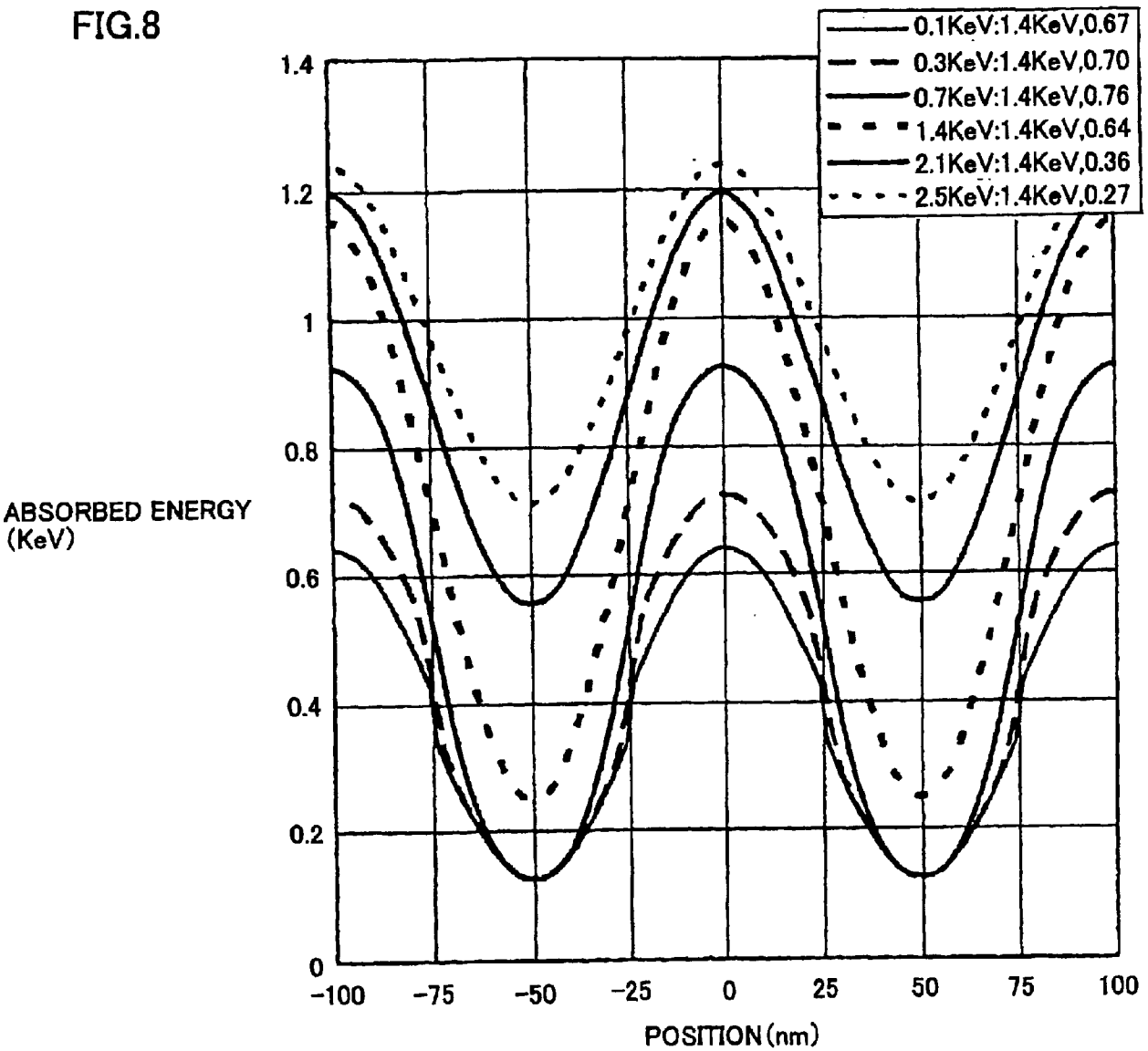
FIG. 8 shows absorbed energy images formed by two types of electrons having different energy levels generated in a resist irradiated with X-rays assuming that X-ray intensity on the resist is 0 in a mask line part and 1 in a mask space part with respect to a mask pattern having lines and spaces of 50 nm.
Figure 9:
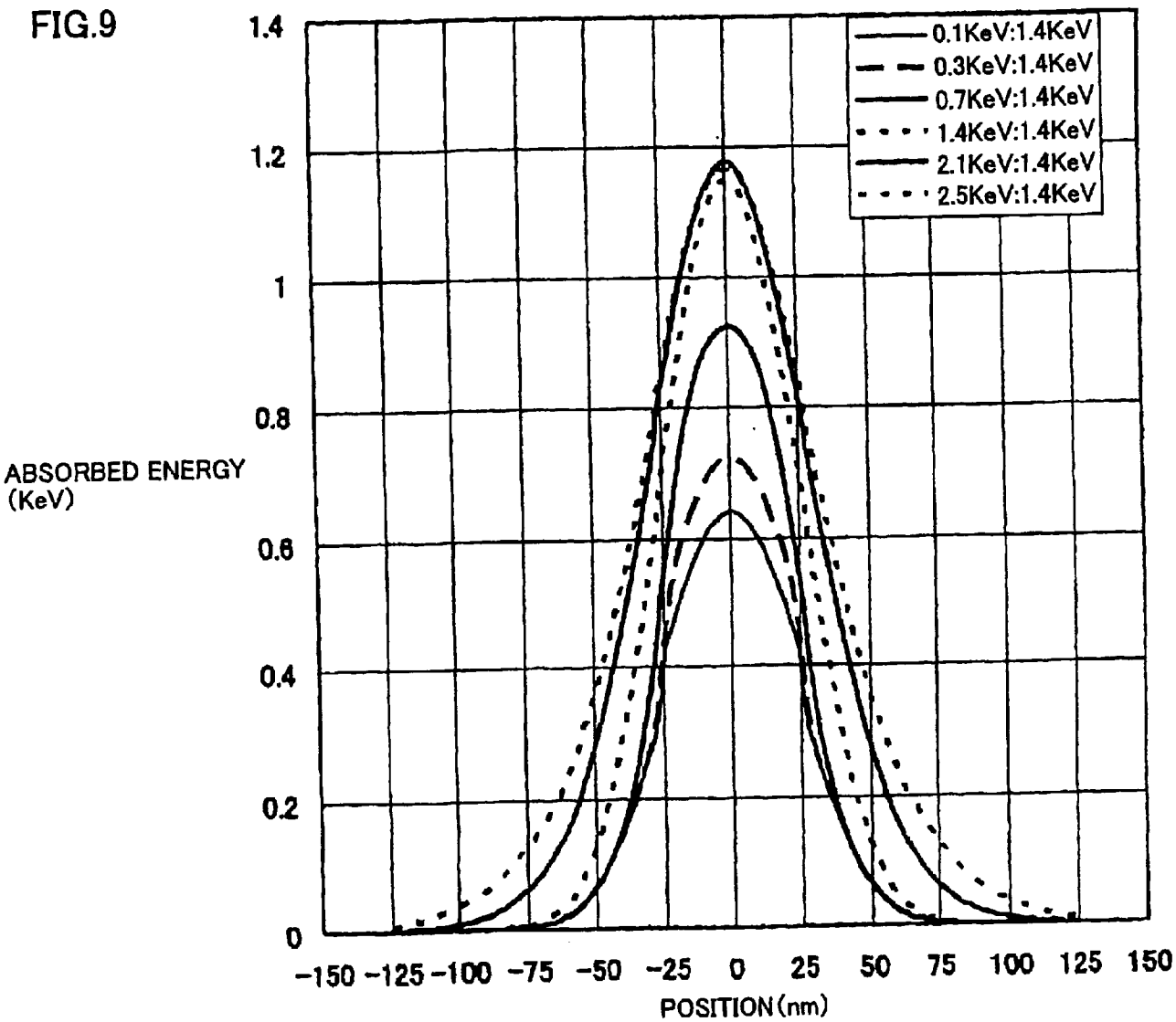
FIG. 9 shows absorbed energy images formed by two types of electrons having different energy levels generated in a resist irradiated with X-rays assuming that X-ray intensity on the resist is 0 in a mask line part and 1 in a mask space part with respect to a mask pattern having spaces of 50 nm.

Results of study of influence exerted on resolution by two types of electrons having different energy levels are now shown. Images of absorbed energy in a resist were obtained while fixing the energy of the first electrons to 1.4 KeV and varying the energy of the second electrons in the range of 0.1 KeV to 2.5 KeV. FIG. 8 shows a case of a mask pattern having lines and spaces of 50 nm, and FIG. 9 shows a case of a mask pattern having spaces of 50 nm. X-ray intensity on the resist was set to zero on a mask line part and to 1 on a mask space part.

In both cases, the images of absorbed energy are gradually steepened as the energy of the electrons is increased from 0.1 KeV, to exhibit the highest contrast around the electron energy of 0.7 KeV to 1.4 KeV. When the energy exceeds 2.1 KeV, blurring is rather increased When forming a pattern with electrons such as Auger electrons having constant energy and photoelectrons increased in energy due to reduction of the wavelength, the photoelectrons may strongly contribute to improvement of the resolution if the energy thereof is lower than that of the Auger electrons. Thus, there is combination of energy levels of photoelectrons and Auger electrons most increasing the resolution. This combination of the electron energy levels varies with the pattern dimension and the energy of the Auger electrons.

In view of a wave band shorter than 20 Å as to the energy levels of secondary electrons of the elements shown in FIG. 6, absorption edges of iodine, fluorine, germanium, bromine, silicon, sulfur, phosphorus and chlorine are present on a short-wave side in this order and the energy levels of Auger electrons generated from these elements are increased in this order. However, wavelengths reducing energy of photoelectrons shift toward the short-wave side in this order of elements. In other words, it follows that wavelengths reducing the energy levels of photoelectrons generated in the resists can be selected in this order of the elements by selectively reducing the exposure wavelength, and the resolution can be improved in consideration of reduction of Fresnel diffraction due to the capability of reducing the wavelength.

The ratio of generation of electrons of each energy level is decided by the element contained in the resist, the ratio of the element and the wavelength spectrum of the exposure light. In other words, it follows that the ratio of electrons generated in the resist is decided by X-ray absorption power in the resist at each wavelength, i.e., the X-ray absorption spectrum of the resist. This is because the quantity of generated electrons is increased as the quantity of absorption of X-rays is increased. The absorption spectrum of the resist is not much dependent on the binding state of a compound but decided by the absorption spectrum of each element and the weight ratio of the element in the resist in an energy band of a level assumed in X-ray exposure.

Figure 10:
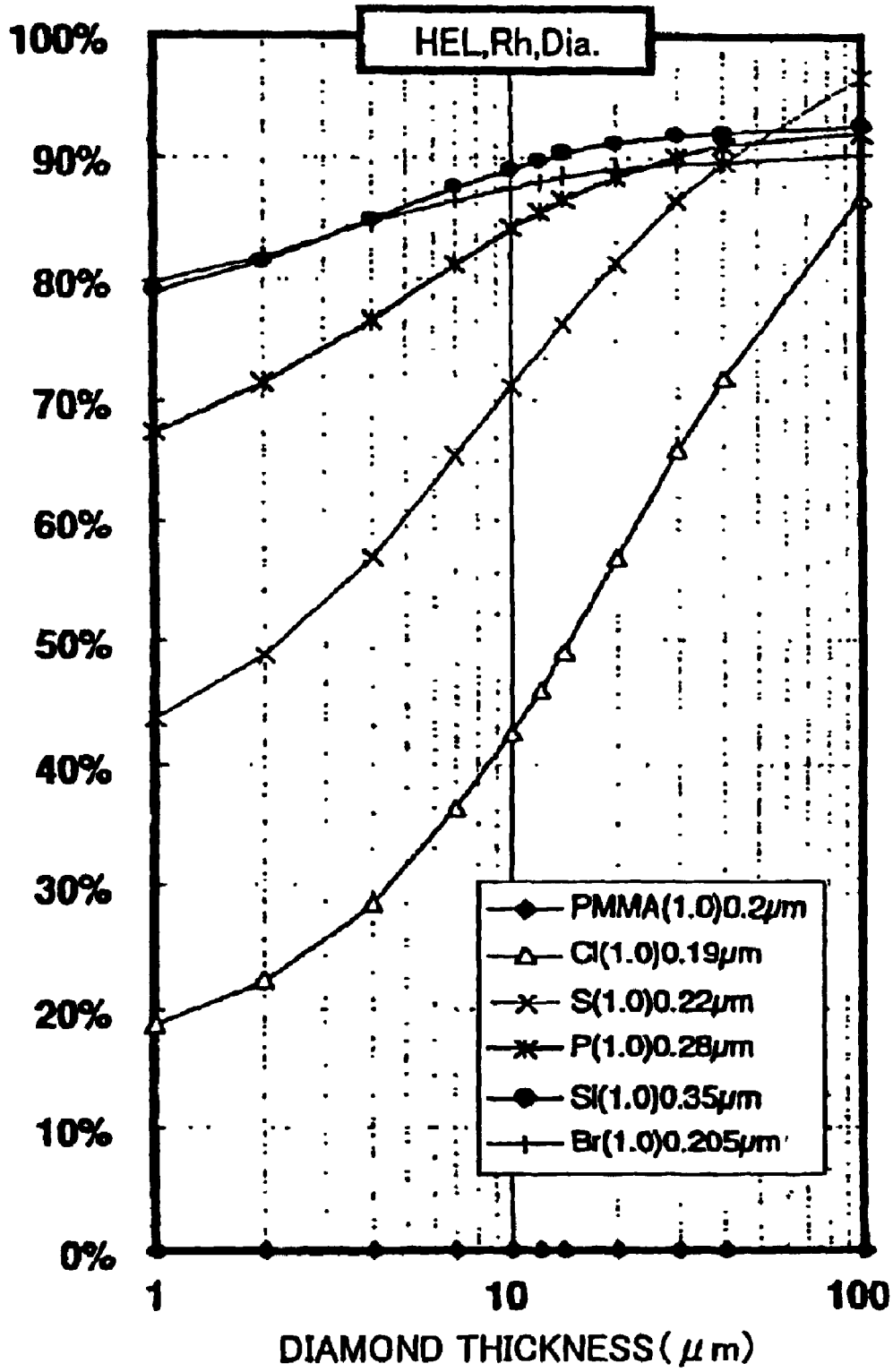
FIG. 10 illustrates the ratios of photoelectrons and Auger electrons on absorption edges present in an exposure waveband among secondary electrons generated in a resist exposed with X-rays in a short-wave exposure system employing platinum mirrors.
Figure 11:
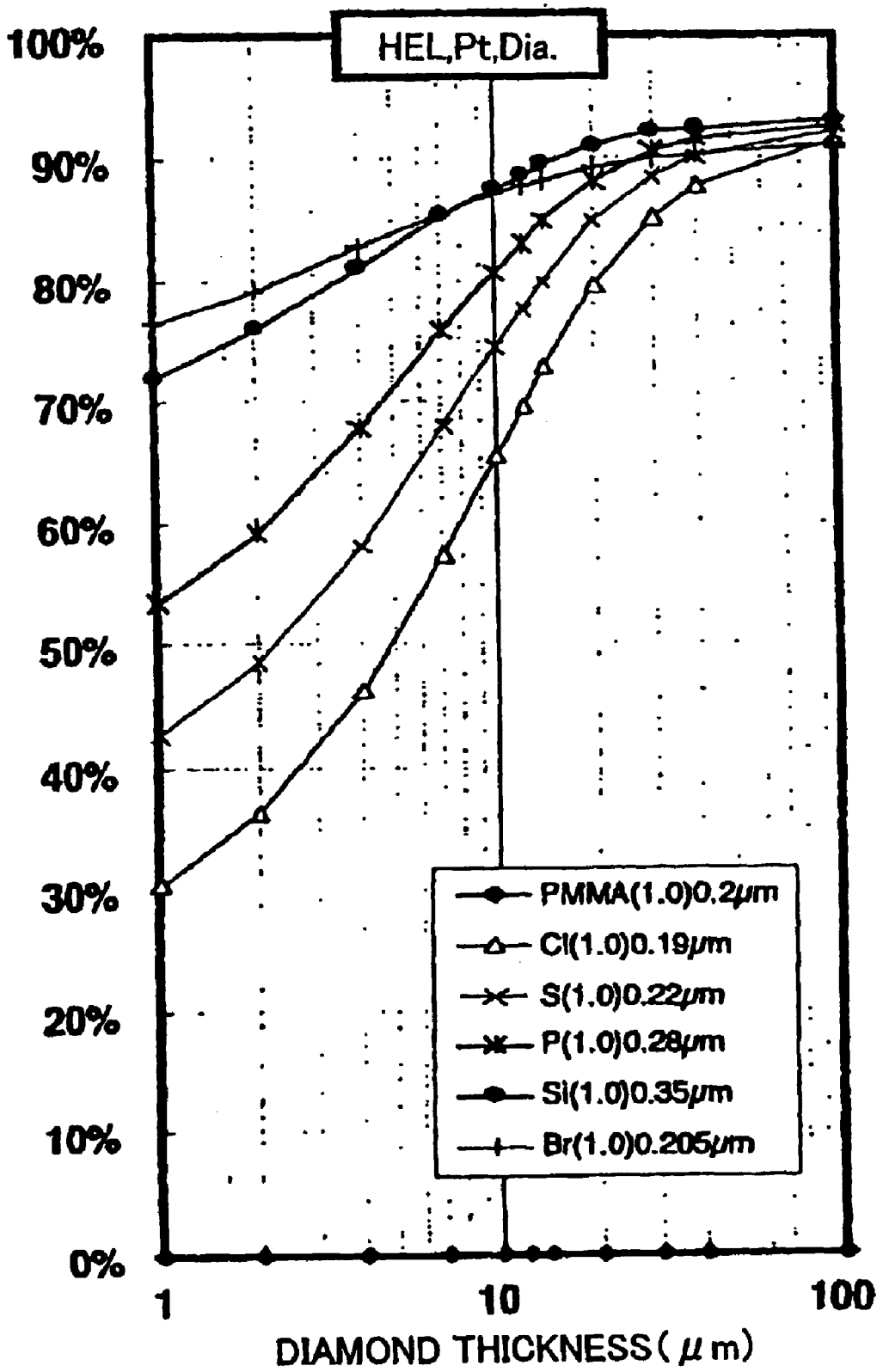
FIG. 11 illustrates the ratios of photoelectrons and Auger electrons on absorption edges present in an exposure waveband among secondary electrons generated in a resist exposed with X-rays in a short-wave exposure system employing rhodium mirrors.

FIGS. 10 and 11 show results of ratios of photoelectrons and Auger electrons resulting from absorption edges present in the exposure waveband among secondary electrons generated in resists exposed with X-rays. FIG. 10 shows results in a system employing platinum mirrors, and FIG. 11 shows results in a system employing rhodium mirrors. In each system, the ratios of the electrons are low in resists containing elements such as PMMA, fluorine and iodine having no absorption edges in the exposure waveband. In the remaining resists containing elements having absorption edges in the exposure waveband, the ratios of electrons related to the absorption edges present in the exposure waveband are increased to exceed 90% as the thicknesses of membranes are increased, i.e., as the average exposure wavelengths are reduced.

Under standard conditions employing a diamond membrane of 2 $\mu$m in thickness, the ratios of electrons related to absorption edges in the exposure waveband are increased as the wavelengths of the absorption edges are increased in order of bromine, silicon, phosphorus, sulfur and chlorine. A large quantity of electrons related to absorption edges in the exposure waveband indicates that the resist contains a large quantity of photoelectrons having low energy among the secondary electrons, to enable improvement of the resolution.

Figure 12:
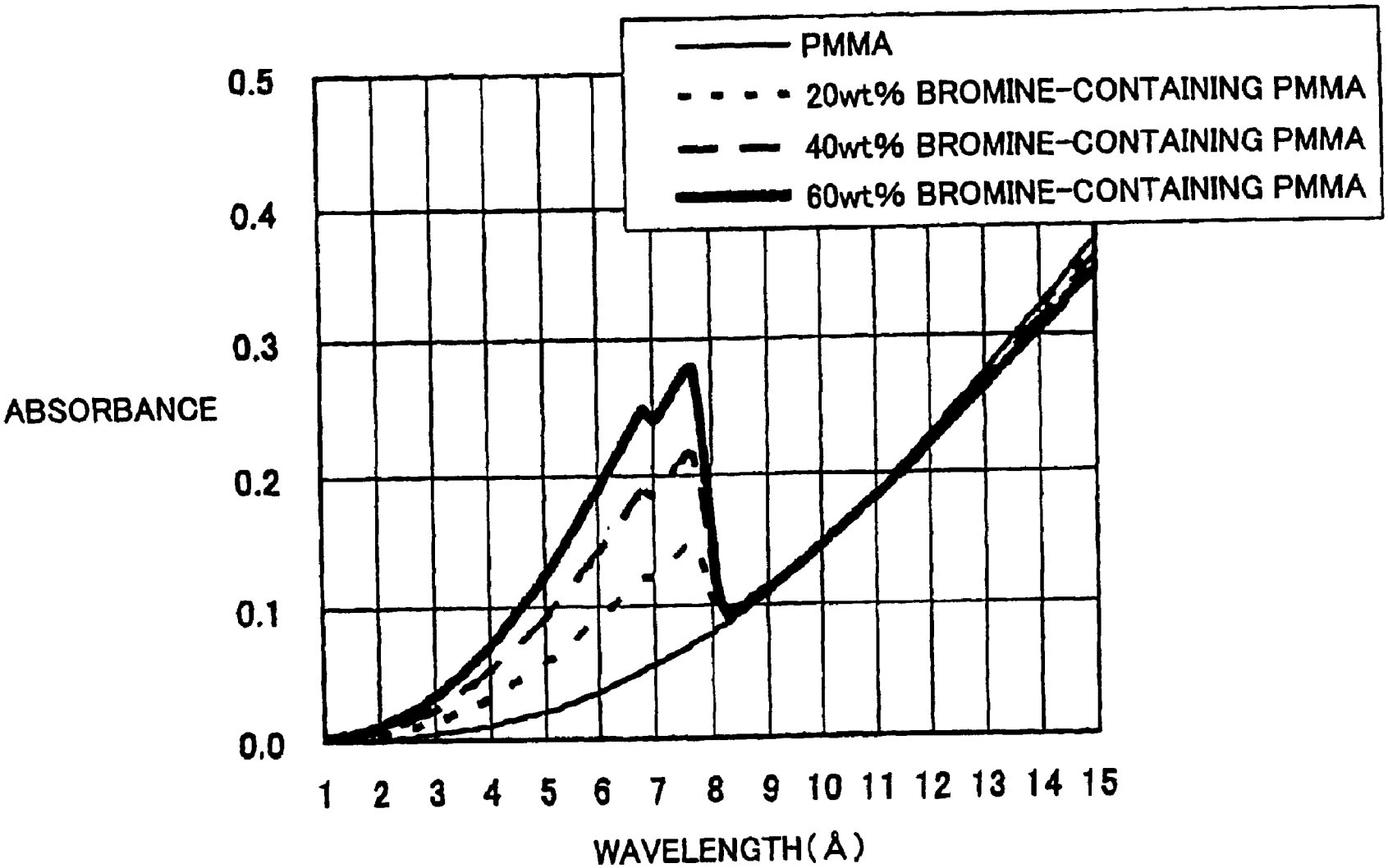
FIG. 12 illustrates X-ray absorption spectra of bromine-containing PMMA resists with respect to weight ratios of bromine.
Figure 13:
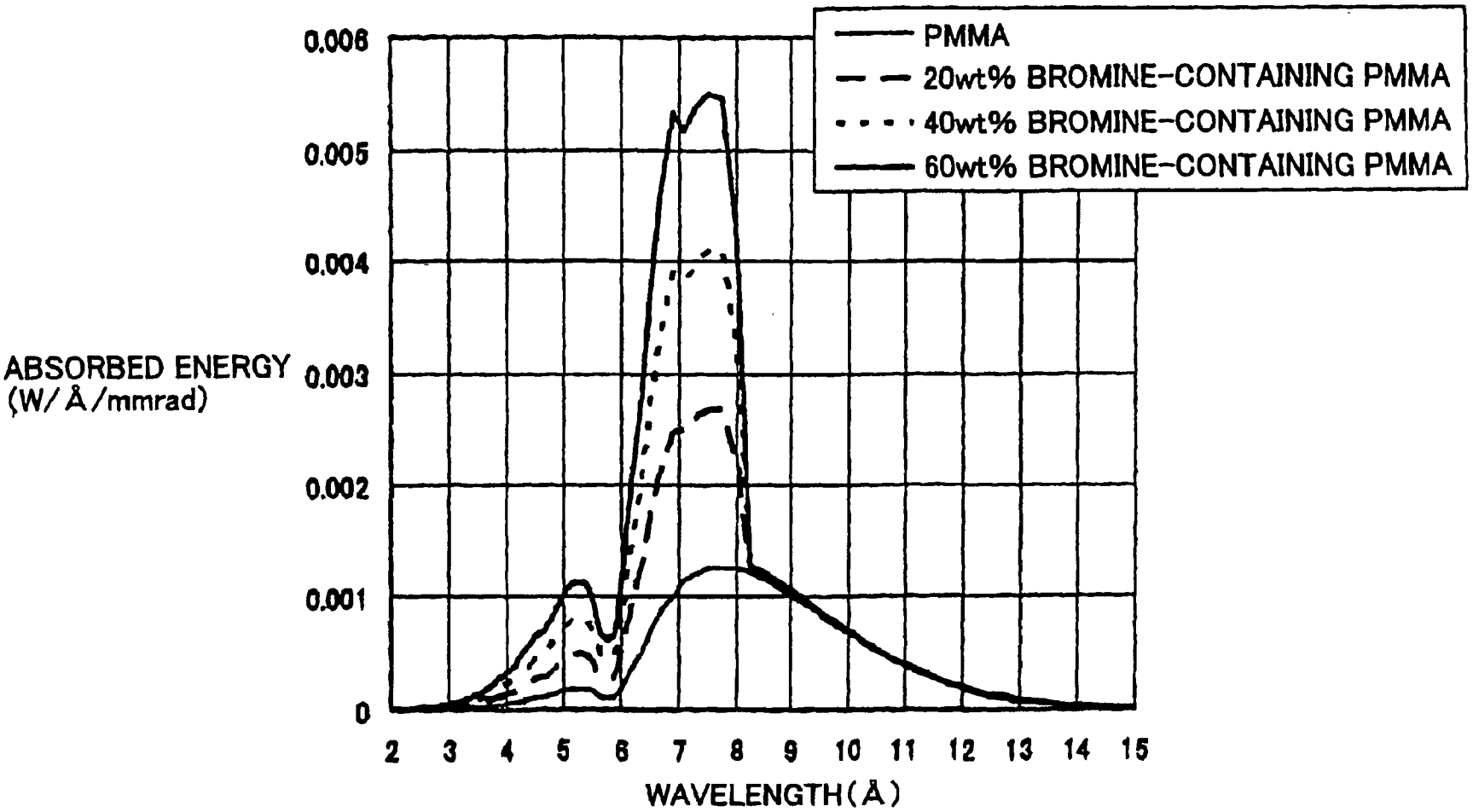
FIG. 13 illustrates wavelength dependence of absorbed energy with respect to bromine-containing PMMA resists in a short-wave exposure system employing platinum mirrors.
Figure 14:
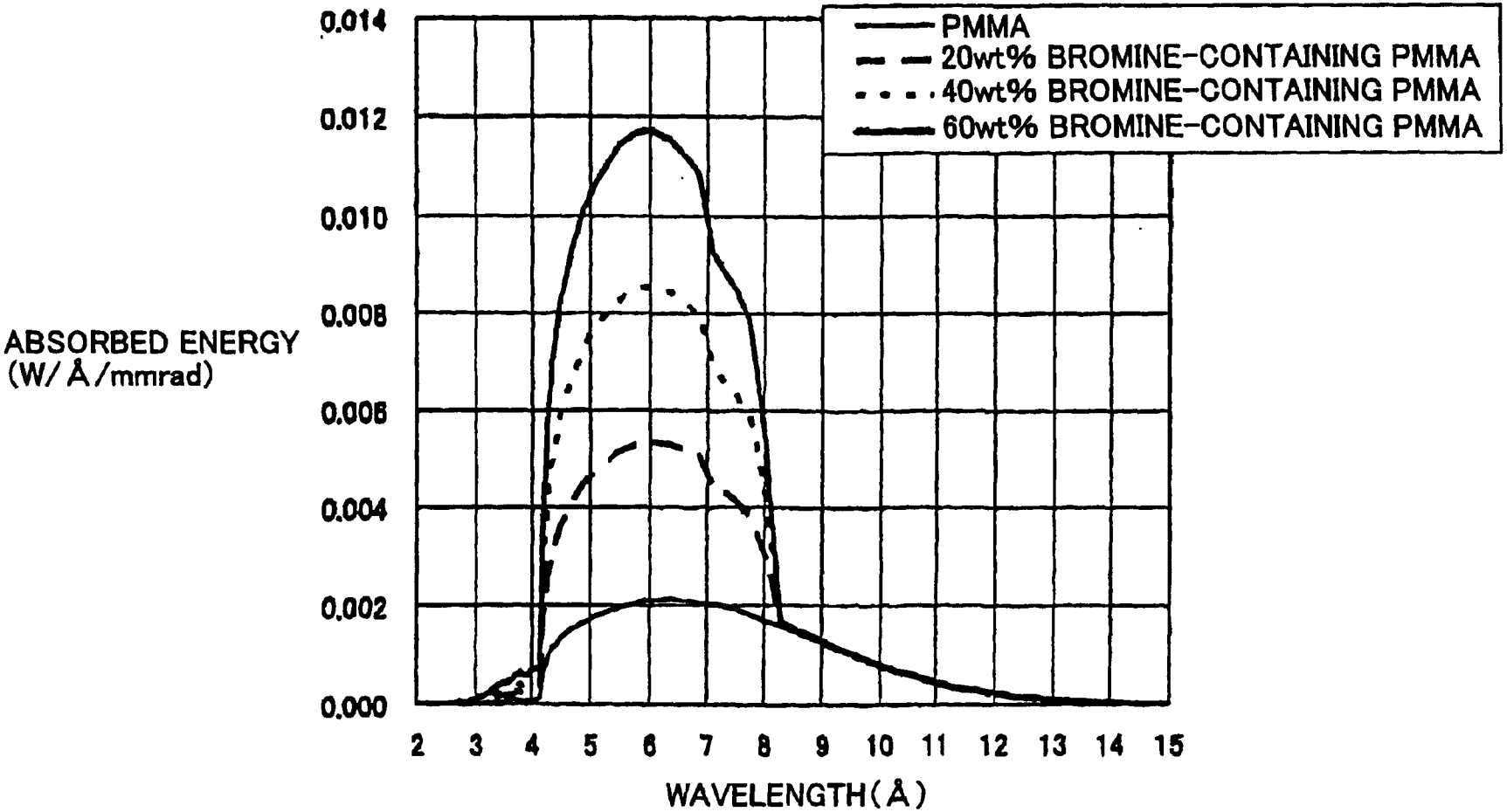
FIG. 14 illustrates wavelength dependence of absorbed energy with respect to bromine-containing PMMA resists in a short-wave exposure system employing rhodium mirrors.

As to the ratios of photoelectrons and Auger electrons of respective energy levels, content dependence of elements contained in the resists was studied. FIG. 12 shows X-ray spectra in bromine-containing PMMA resists, for example, having various weight ratios of bromine. All specific gravity levels were set to 1, and film thicknesses were set to 1 $\mu$m. The ratios of photoelectrons and Auger electrons are also decided by the spectrum of excited exposure light. FIG. 13 shows wavelength dependence of absorbed energy levels in a case of employing a system including platinum mirrors. FIG. 14 shows wavelength dependence of absorbed energy levels in a case of employing a short-wave exposure system including rhodium mirrors. Diamond membranes of 2 $\mu$m in thickness were obtained.

Referring to FIG. 12, it is understood that absorbance on a shorter-wave side of the absorption edge of bromine is increased when the ratio of bromine is increased in the bromine-containing PMMA resist. As shown in FIGS. 13 and 14, therefore, the ratio of absorbed energy on the shorter-wave side of the absorption edge can be increased by exposing a resist of a material including an absorption edge in the exposure waveband. In the case of the bromine-containing PMMA resist, the ratios of photoelectrons and Auger electrons having low energy generated from bromine atoms in an exposure wave range on a shorter wave-side of the absorption edge of bromine are increased. Consequently, resolution is not deteriorated but can expectedly be rather improved also in short-wave exposure.

First Embodiment

Figure 15:
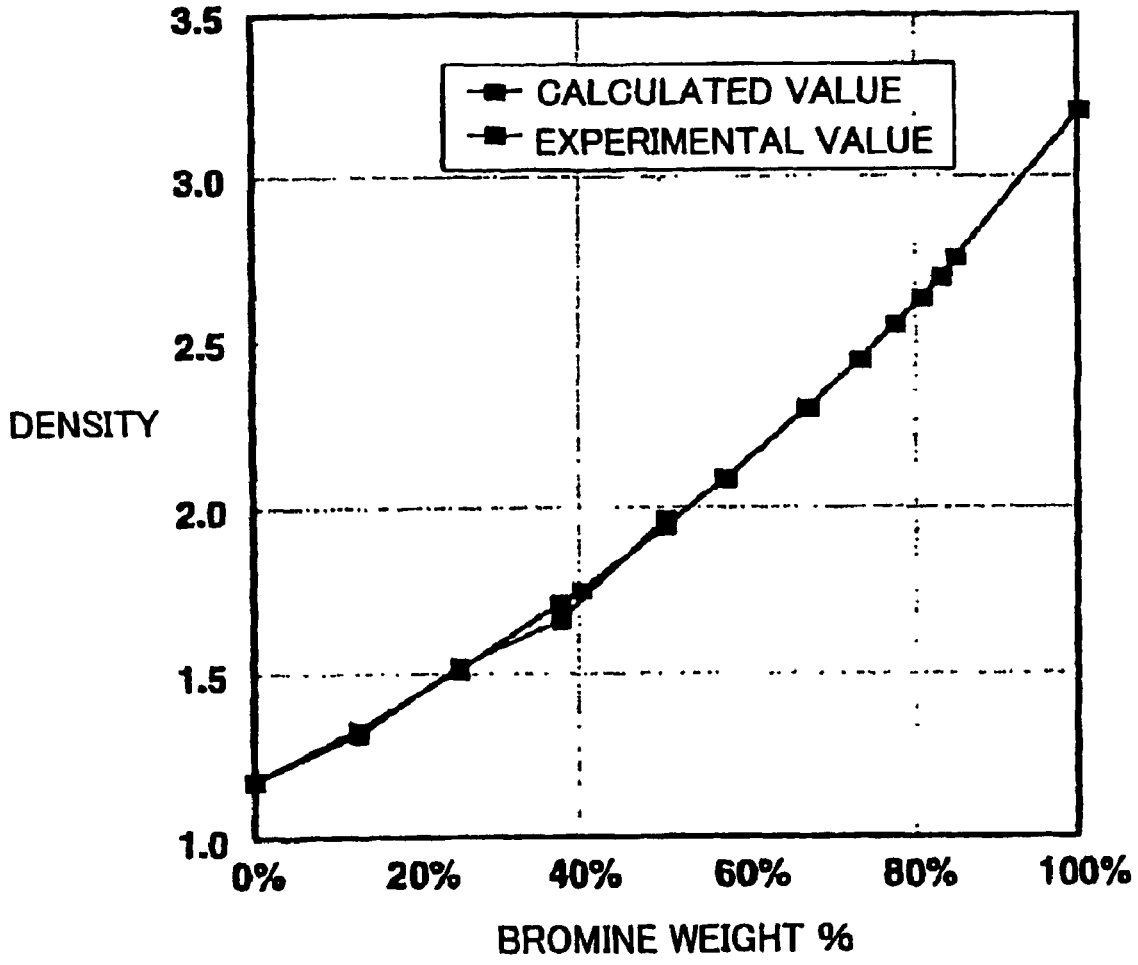
FIG. 15 illustrates specific gravity with respect to weight ratios of bromine in a brominated PHS resist in a first embodiment of the present invention.

The weight ratio of bromine in a resist prepared by brominating PHS (polyhydroxystyrene) was varied in the range of 0% to 50.2% for measuring specific gravity. FIG. 15 shows the results of measurement (experimental values) along with results of calculation (calculated values). The specific gravity is increased as the bromination ratio is increased such that the specific gravity reaches about 1.8 times that of a general PHS resist when the Br weight ratio is 50%, and a resist of about 2.5 times can also be obtained at the maximum.

Similar relation holds as to the effect of bromination also in novolac resin or another polymeric resist such that the specific gravity is increased as the bromine content is increased and a resist having specific gravity of almost three times can also be obtained. In this waveband, X-ray absorbance is increased in proportion to the specific gravity, and hence it follows that a resist having sensitivity higher by at least one digit as compared with a PHS resist containing no bromine can be expected depending on the exposure wavelength as a result of the bromine content and as a result of the effect on the absorption edge of bromine and the effect of the increased specific gravity.

Figure 16:
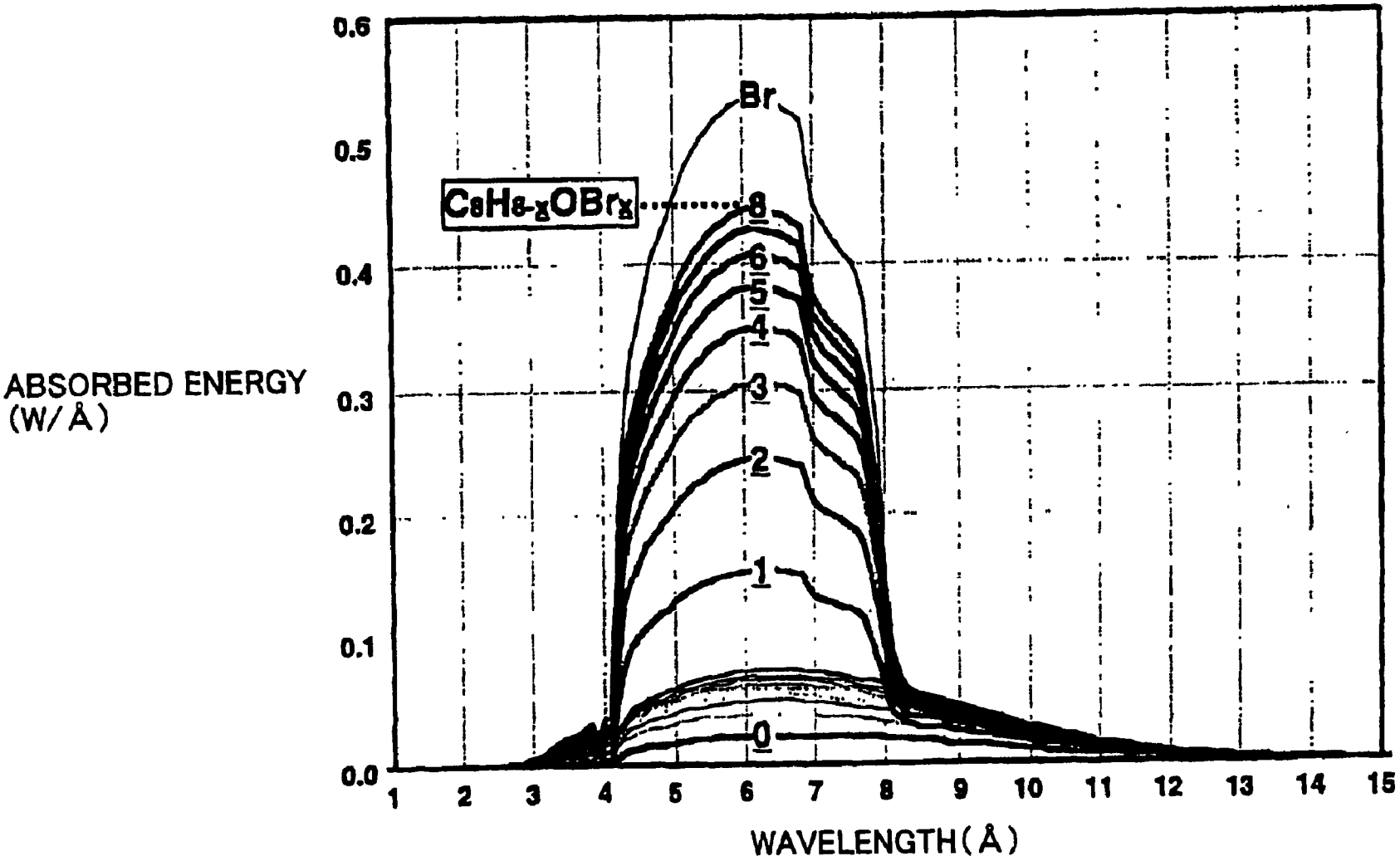
FIG. 16 illustrates absorbed energy of each resist prepared by replacing hydrogen and bromine in the brominated PHS resist with each other with respect to each wavelength in the first embodiment.

FIG. 16 shows this relation. Light prepared by condensing synchrotron radiation emitted from a radiation generator having deflecting magnetic field intensity of 4.5 T and acceleration energy of 0.7 GeV through a beam line employing two rhodium mirrors having an oblique incidence angle of 1° and transmitting the synchrotron radiation through a beryllium window of 20 μm in thickness serving as a vacuum barrier and a diamond mask substrate of 2 μm in thickness was employed for exposure. Energy absorbed by a resist of 0.2 μm in thickness was obtained.

Figure 17:
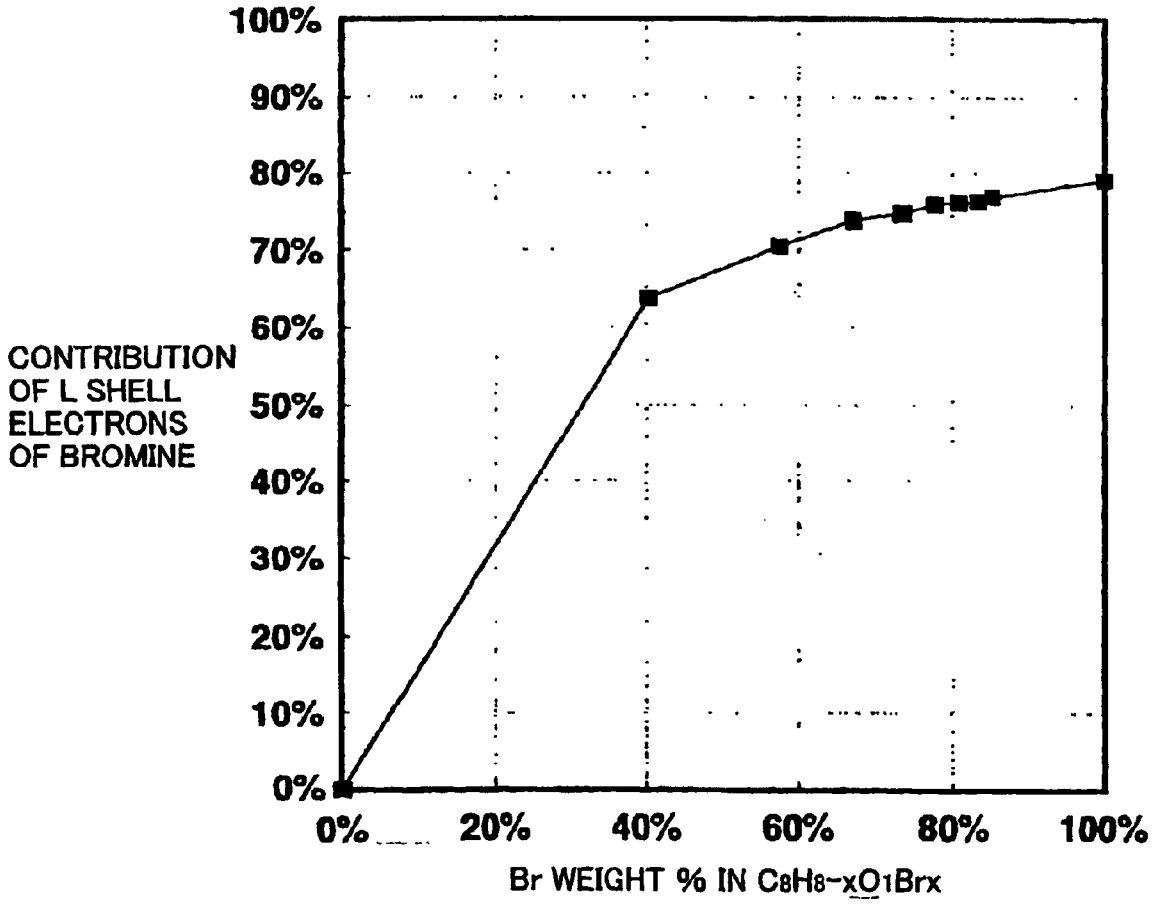
FIG. 17 illustrates the ratio of electrons resulting from L shells of bromine every weight percentage of bromine in a molecular formula $C_8H_{8-x}O_1Br_x$ in the first embodiment.

It follows that light of 4 to 8 Å is mainly employed for exposure at this exposure wavelength. As clearly understood from FIG. 4, it follows that the energy of photoelectrons resulting from L shells of bromine having an absorption edge at 8 Å is lower than the energy of Auger electrons under this condition. Electrons resulting from orbits other than the L shells and those resulting from carbon, oxygen and hydrogen are also generated as a matter of course, and hence FIG. 17 shows results of ratios of electrons resulting from L shells of bromine.

It is understood that the ratio of electrons already exceeds 60% in a resist having a bromine weight ratio of 40%, i.e., that prepared by replacing one of eight hydrogen components forming hydroxystyrene with bromine, and the ratio of electrons reaches 70% when two hydrogen components are replaced. In other words, it can be said that electrons generated by exposure in this waveband and related to resolution mainly result from L shells of bromine.

Among the 70% of secondary electrons, Auger electrons of bromine have the maximum energy of about 1.4 KeV, which is by far lower than the energy of photoelectrons of carbon exceeding 2 KeV in this waveband. Therefore, it follows that a pattern of high resolution can be formed by employing a bromine-containing resist for exposure employing light in the waveband of 4 to 8 Å.

Also in the bromine-containing resist, no electrons result from L shells of bromine when the resist is irradiated with light having a wavelength longer than 8 Å but only resolution substantially similar to that in a resist containing no bromine can be expected.

While the system employing X-rays emitted from a radiation generator has been mainly described, the present invention is not restricted to the X-rays from the radiation generator but a similar effect is attained also when employing another X-ray source including a plasma X-ray source due to the principle of the present invention.

Second Embodiment

Ratios of photoelectrons and Auger electrons resulting from absorption edges present in an exposure waveband were obtained as to other elements. FIGS. 10 and 11 shows the results, which were obtained as to a case of employing rhodium mirrors similar to those in the first embodiment and a case of employing platinum mirrors having an oblique incidence angle of 1°. Referring to each of FIGS. 10 and 11, the horizontal axis plots the thickness of a diamond film forming a mask substrate, for obtaining thickness dependence of the substrate.

When the thickness of the diamond film is increased, it follows that the diamond film is employed as an X-ray filter for cutting a long-wave side and performing short-wave exposure. Therefore, a similar effect is attained also in a filter employing another material such as beryllium or boron nitride in place of diamond. The ratio of secondary electrons resulting from an absorption edge of each element present in an absorption waveband is increased on a short-wave side not only in the case of rhodium mirrors but also in the case of platinum mirrors. A ratio of electrons exceeding 60% is implemented not only in bromine but also in silicon or phosphorus when the thickness of the diamond film is at least 2 μm, and it is understood that there is a condition satisfying the electron ratio of at least 60% also in sulfur or chlorine. It follows that exposure of low photoelectron energy is implemented at least under this condition.

Third Embodiment

Figure 18A:
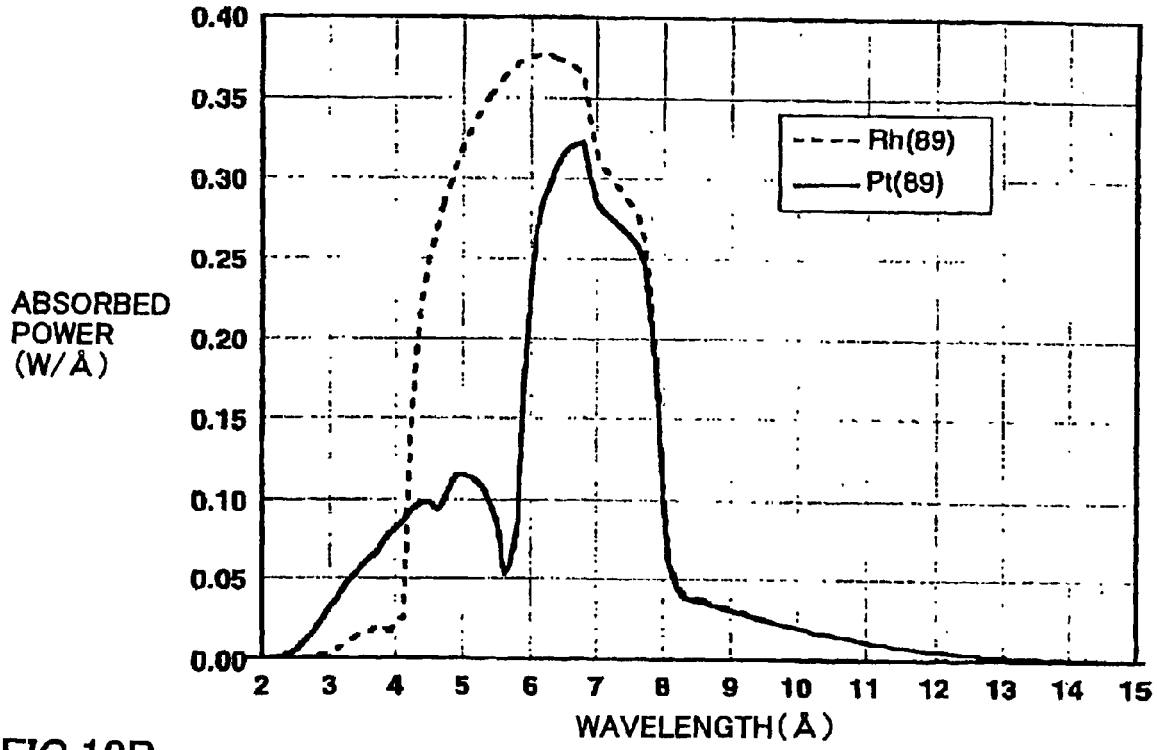
FIGS. 18A and 18B illustrate absorbed spectra of a bromine-containing resist prepared by replacing two hydrogen components in novolac resin with bromine with respect to rhodium mirrors, ruthenium mirrors, platinum mirrors and osmium mirrors in a third embodiment of the present invention.
Figure 18B:
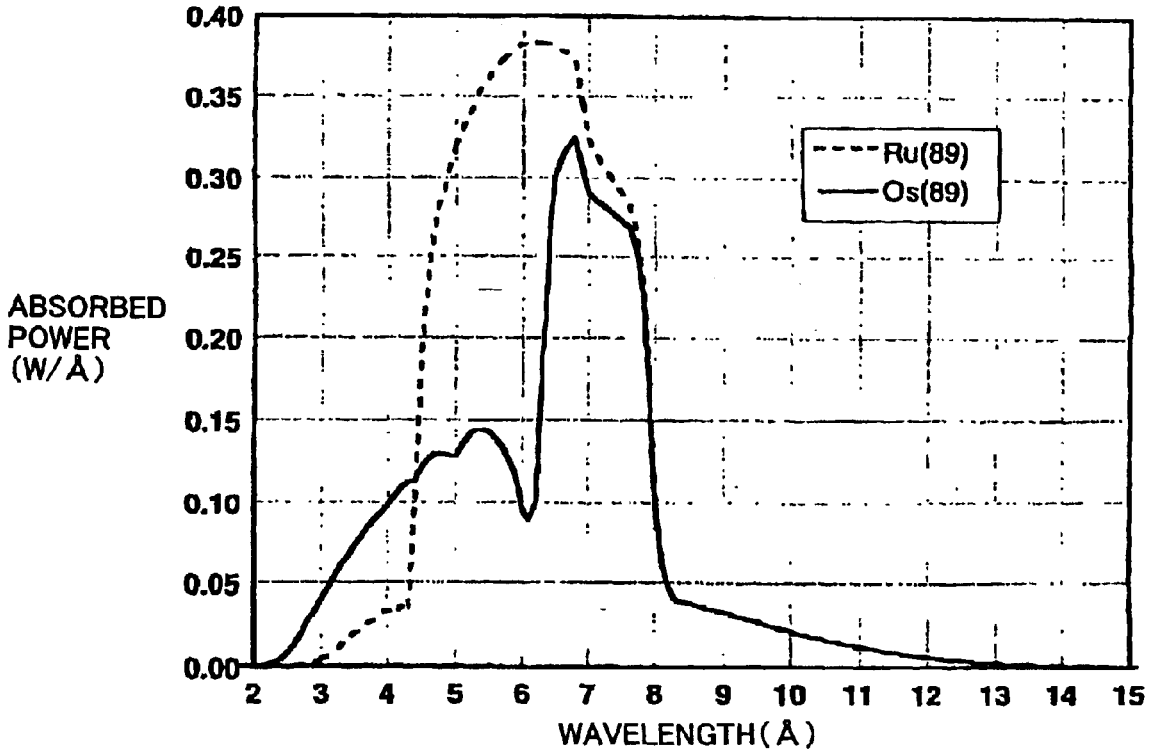

When performing exposure with light on a slightly shorter-wave side of the absorption edge of an element contained in a resist, photoelectrons of low energy are generated in the resist to enable improvement of resolution. Therefore, combination of irradiation light for exposure and the element contained in the resist is important. FIGS. 18A and 18B show absorption spectra to resists in a case of employing novolac resin prepared by replacing two hydrogen components with bromine as a base polymer of a bromine-containing resist.

In an illumination optical system employing rhodium (Rh) mirrors or ruthenium (Ru) mirrors having an oblique incidence angle of 1°, light in the band of 4 to 8 Å can be effectively utilized to enable high-speed exposure. In an optical system employing platinum (Pt) mirrors or osmium (Os) mirrors having an oblique incidence angle of 1°, on the other hand, it follows that light in the band of 6 to 8 Å is mainly utilized, and photoelectron energy of bromine in this waveband can be reduced below that of Auger electrons of carbon, and it follows that pattern transfer of ultrahigh resolution can be implemented.

Fourth Embodiment

In order to select an irradiation wavelength for exposure in response to an element contained in a resist without changing a condensing/magnifying mirror, a method employing a wavelength sweeper comprising beryllium (Be) mirrors having a variable incidence angle was studied.

Figure 19:
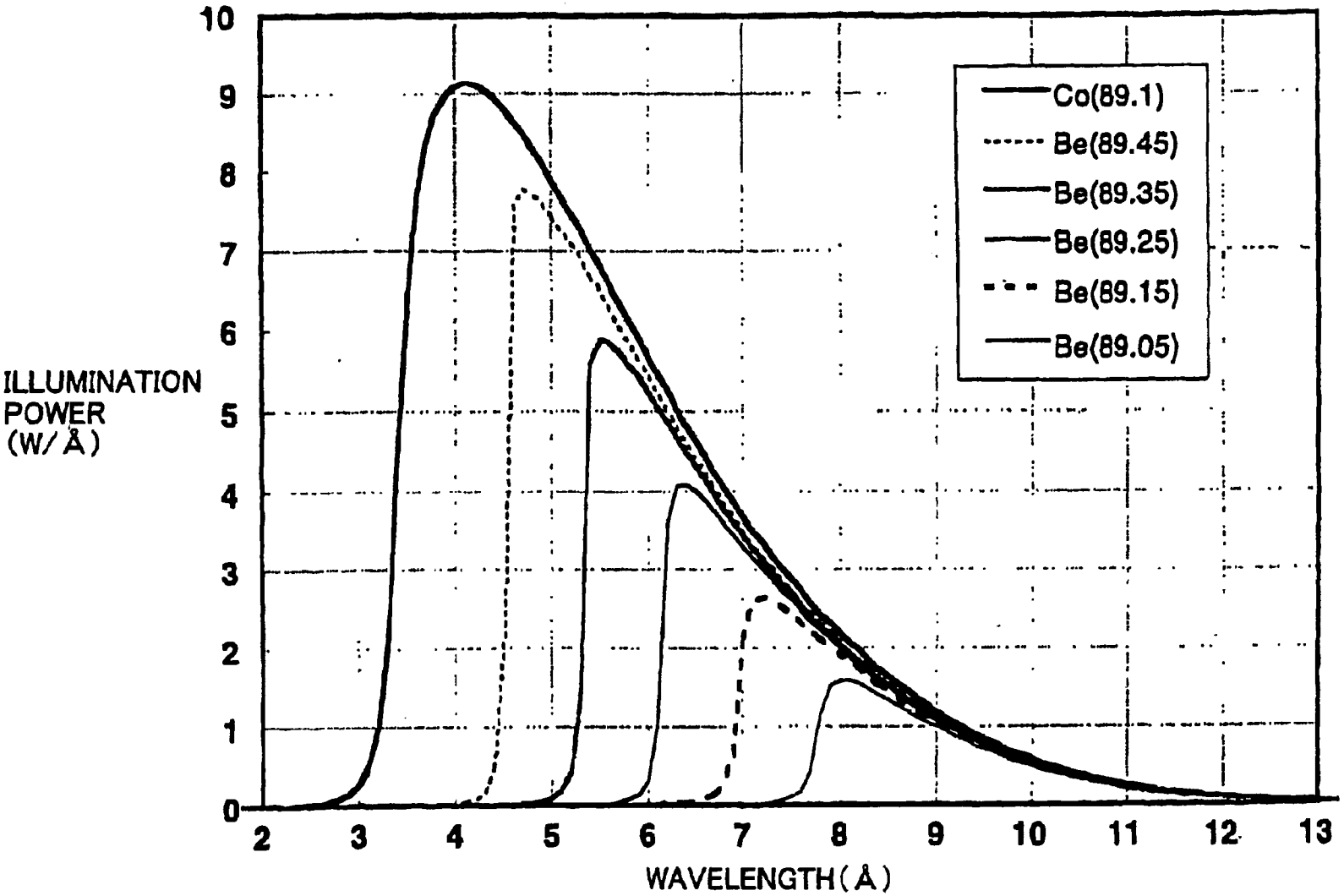
FIG. 19 illustrates spectra of exposure light with respect to incidence angles in beryllium mirrors in a fourth embodiment of the present invention.

A beam line including two cobalt (Co) mirrors having an incidence angle of 89.1° was employed as an illumination optical system while setting a wavelength sweeper formed by three plane mirrors of beryllium (Be) in front of the cobalt (Co) mirrors. The wavelength was selected with the wavelength sweeper capable of varying a cut wavelength on a short-wave side by changing the incidence angle in the beryllium (Be) mirrors. FIG. 19 shows spectra of irradiation light for exposure obtained through the aforementioned wavelength sweeper. The wavelength of the applied light can be continuously changed in the range of about 3 Å to at least 8 Å by simply changing the incidence angle in the variable beryllium (Be) mirrors without changing a condensing/magnifying mirror.

Figure 20:
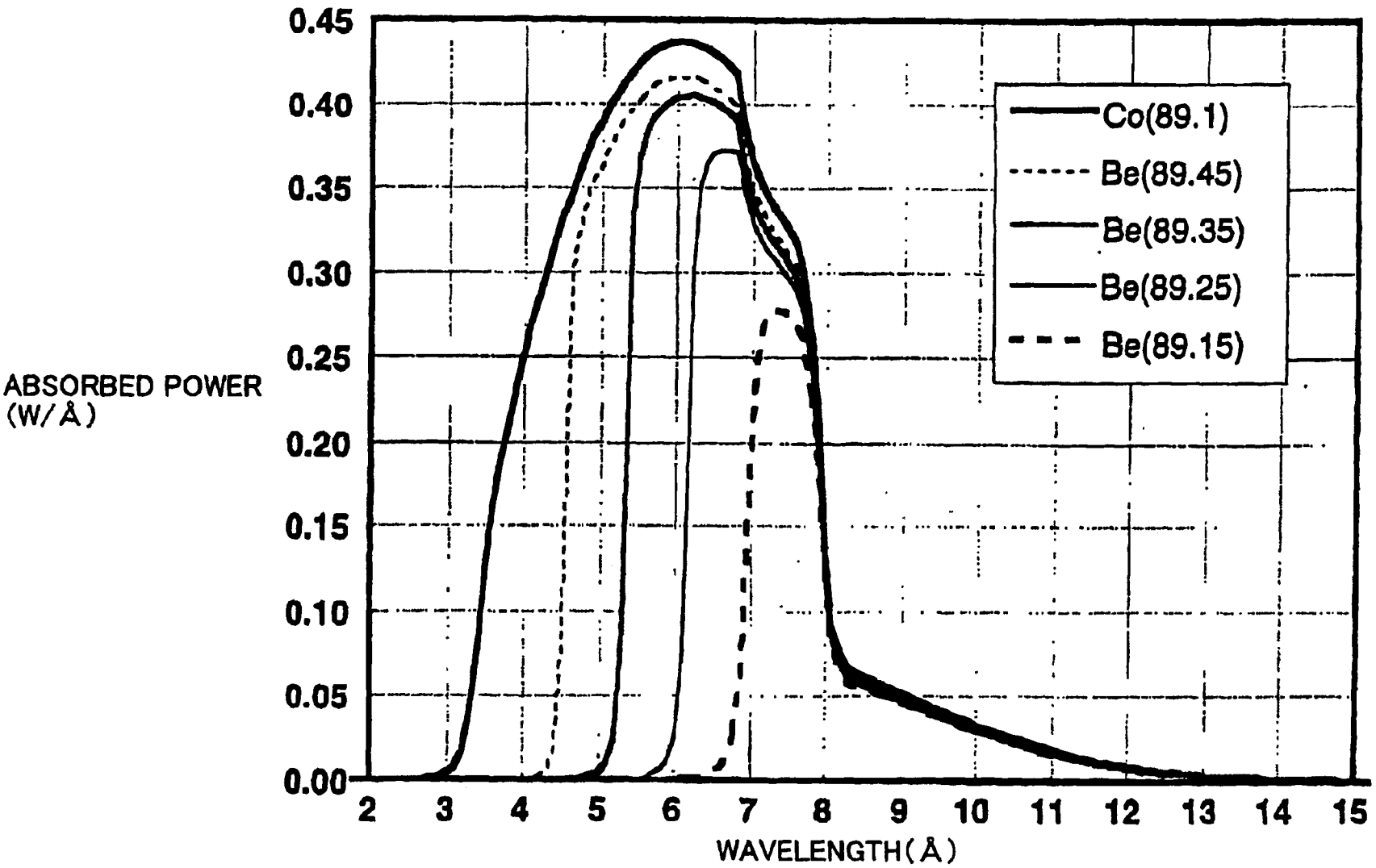
FIG. 20 illustrates absorbed spectra in brominated PHS resists with respect to incidence angles in beryllium mirrors in the fourth embodiment.

FIG. 20 shows absorption spectra in a brominated PHS resist, similar to that employed in the first embodiment, exposed in this illumination system. The short-wave side can be arbitrarily adjusted through the wavelength sweeper, and this means that the maximum energy of photoelectrons resulting from L shells of bromine can be freely adjusted. In other words, the energy of photoelectrons resulting from L shells of bromine can be reduced below that of Auger electrons of carbon by cutting the wavelength at 6 Å. Further, the energy of photoelectrons resulting from L shells of bromine can be reduced below that of Auger electrons of itself by cutting the wavelength at 4 Å.

Fifth Embodiment

Figure 21:
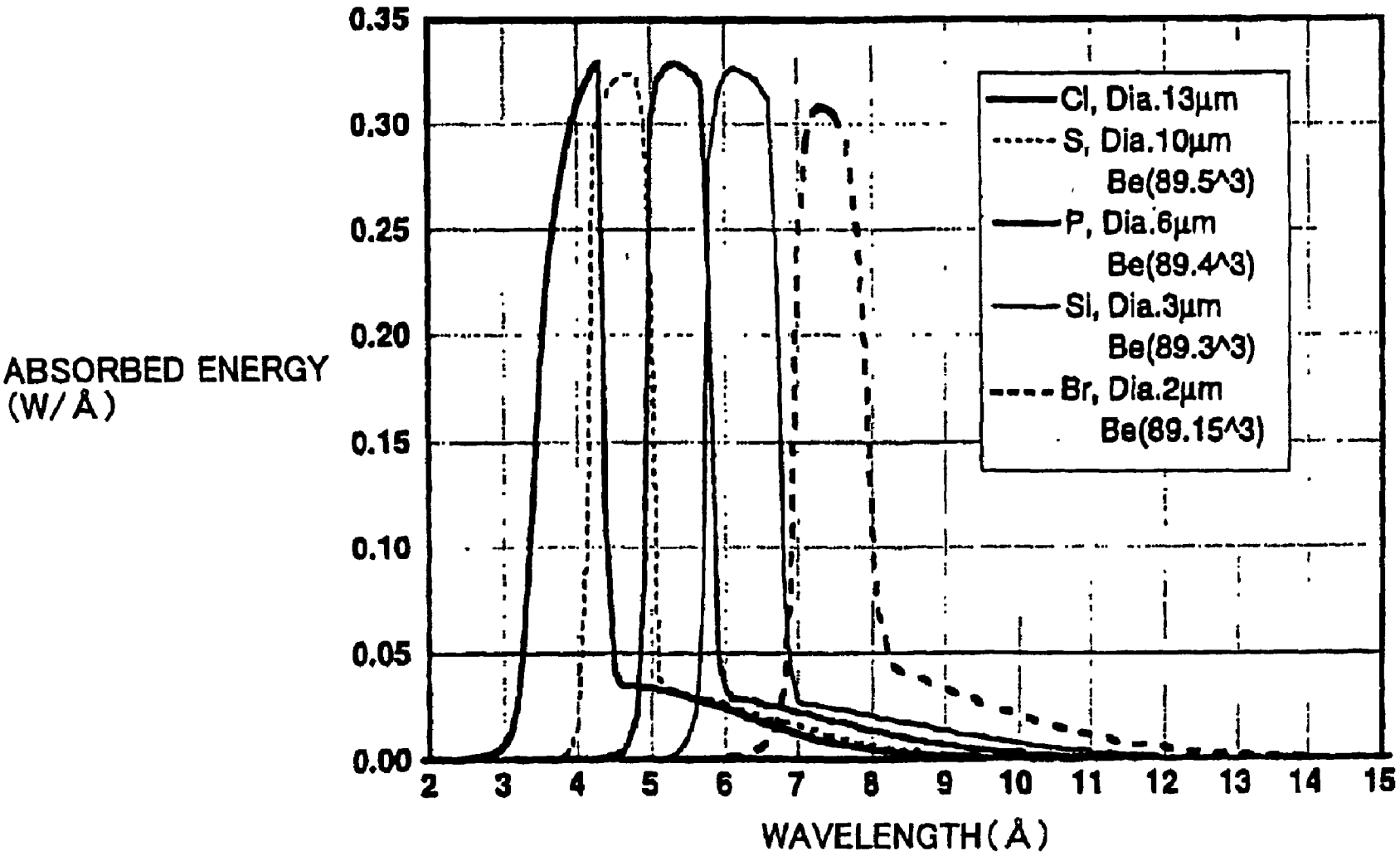
FIG. 21 illustrates absorbed energy spectra in resists containing various elements in an exposure apparatus employing an illumination optical system comprising a beam line including two cobalt mirrors having an incidence angle of 89.1° and a wavelength sweeper in a fifth embodiment of the present invention.

FIG. 21 shows spectra of absorbed energy in resists, containing various elements, exposed in an exposure apparatus employing an illumination optical system including a beam line employing two cobalt mirrors having an incidence angle of 89.1° and a wavelength sweeper similarly to the fourth embodiment. A radiation generator having a deflecting magnetic field of 4.5 T and electron acceleration energy of 0.8 GeV was employed. Each resist was normalized to contain 100% of the element with specific gravity of 1. The incidence angle in beryllium mirrors of the wavelength sweeper and the thickness of a diamond filter were varied with the element.

Direct light from cobalt mirrors having an incidence angle of 89.10 was employed for a chlorine-containing resist with a diamond filter having a thickness of 13 μm and specific gravity of 3.52. Light obtained by reflecting light from cobalt mirrors three times by a wavelength sweeper having beryllium mirrors to have an incidence angle of 89.5° was employed for a sulfur-containing resist with a diamond filter having a thickness of 10 μm. The incidence angle to beryllium mirrors was set to 89.15° and the thickness of a diamond filter was set to about 2 μm for a bromine-containing resist.

Thus, absorbed energy was substantially equally set to around 0.3 W in each resist, and the average absorption wavelength was changed from 7.93 Å to 4.31 Å in each resist. This indicates that resolution can be improved from 50 nm to 37 nm in consideration of Fresnel diffraction without changing the throughput by changing the resist material while keeping the distance between a mask and a wafer at 10 μm, and a thick diamond mask substrate can be utilized on a high resolution side.

The maximum object resides in that only a constant wave range on an immediate short-wave side from the absorption edge of each resist is absorbed into the resist. In other words, the resolution is improved by utilizing only a part having low energy of photoelectrons resulting from the absorption edge.

Sixth Embodiment

Figure 22:
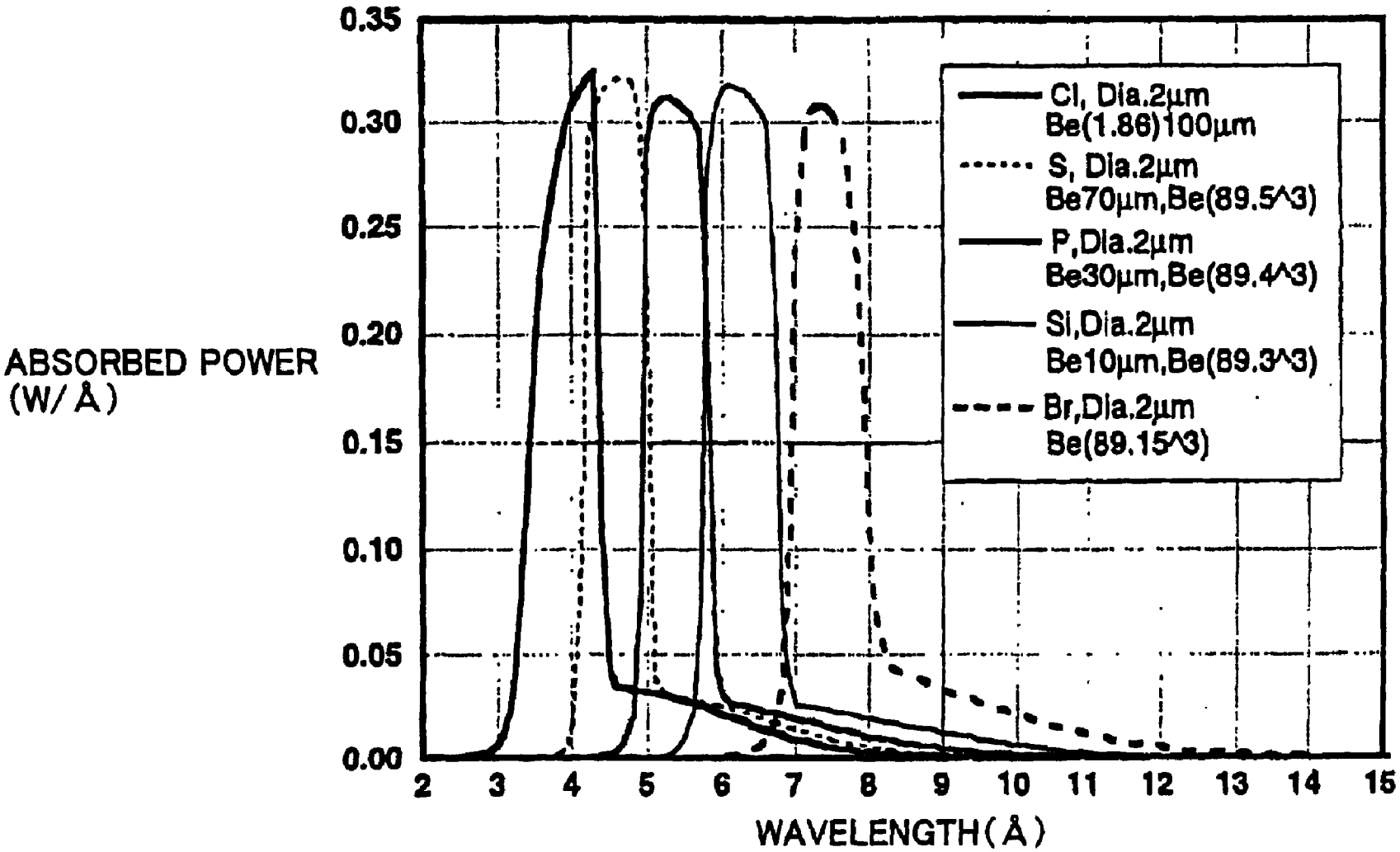
FIG. 22 illustrates absorbed energy spectra in resists containing various elements while changing only the material for a filter employed in a system similar to that in the fifth embodiment from diamond to beryllium.
Figure 23:
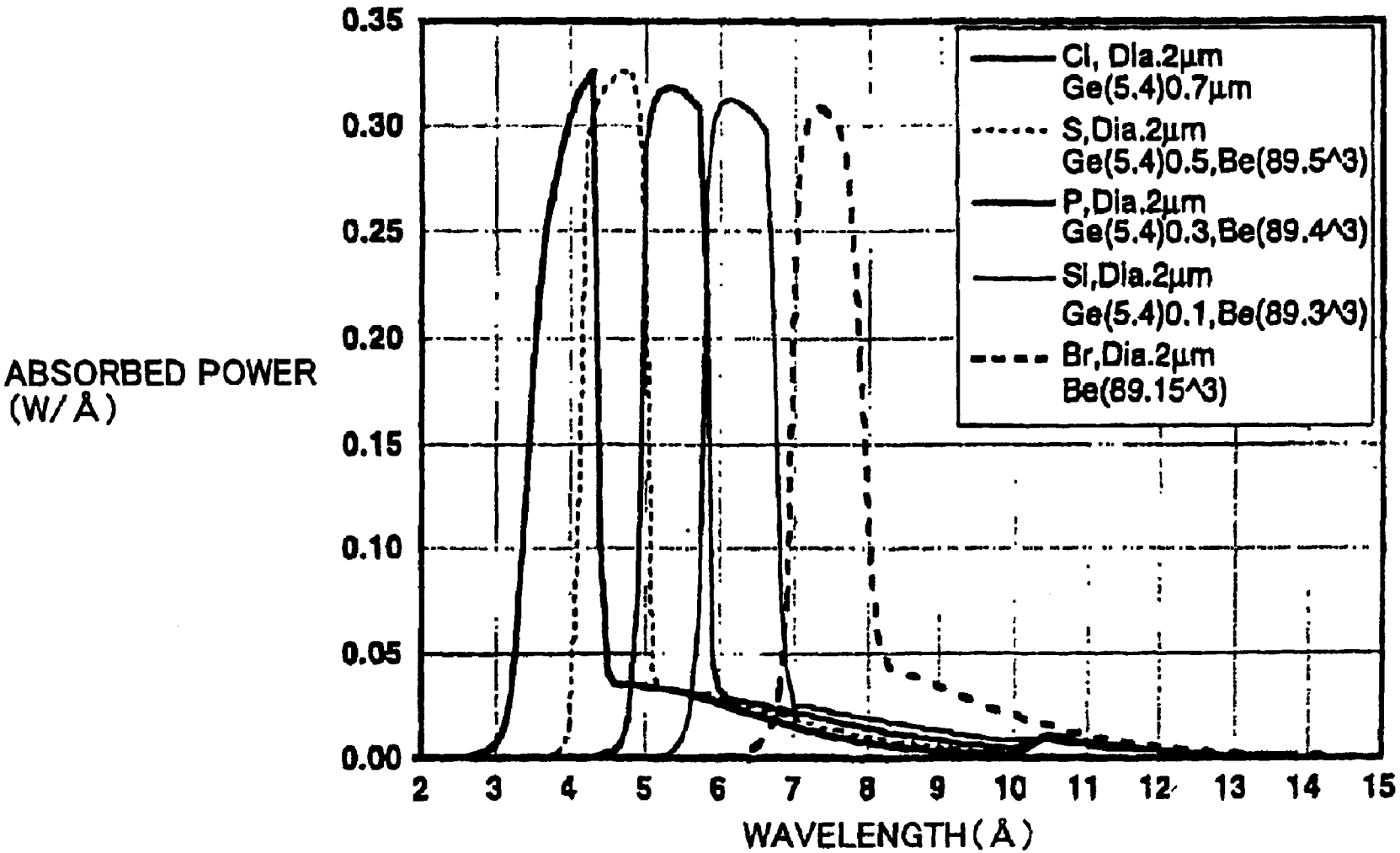
FIG. 23 illustrates absorbed energy spectra of resists containing various elements in a system similar to that of the fifth embodiment, employing a filter of germanium provided on a mask substrate in a sixth embodiment of the present invention.

Only the material for filters employed in systems similar to those in the aforementioned fifth embodiment was changed from diamond to beryllium to obtain absorbed energy levels. Mask substrates were prepared from diamond substrates of 2 μm in thickness. FIG. 22 shows results in cases from direct exposure to passage through a beryllium filter of 100 μm having specific gravity of 1.86. FIG. 23 shows results in a case of employing germanium filters provided on mask substrates.

The beryllium filter can obtain a spectrum substantially equal to that obtained through a diamond filter with a thickness larger by about one digit. It is understood that the thickness of a germanium filter can be reduced by about 1 digit as compared with a diamond filter. It follows that the thickness of a beryllium filter utilized as a window member serving as a vacuum barrier can be increased while the thickness of a germanium filter applied to a mask can be reduced. The material applied to the mask substrate is not restricted to germanium but a substantially similar effect can be attained also in a polymer film or a boron nitride substrate employed as a filter, as confirmed by calculation from the X-ray absorption coefficient of each material.

Seventh Embodiment

Figure 24:
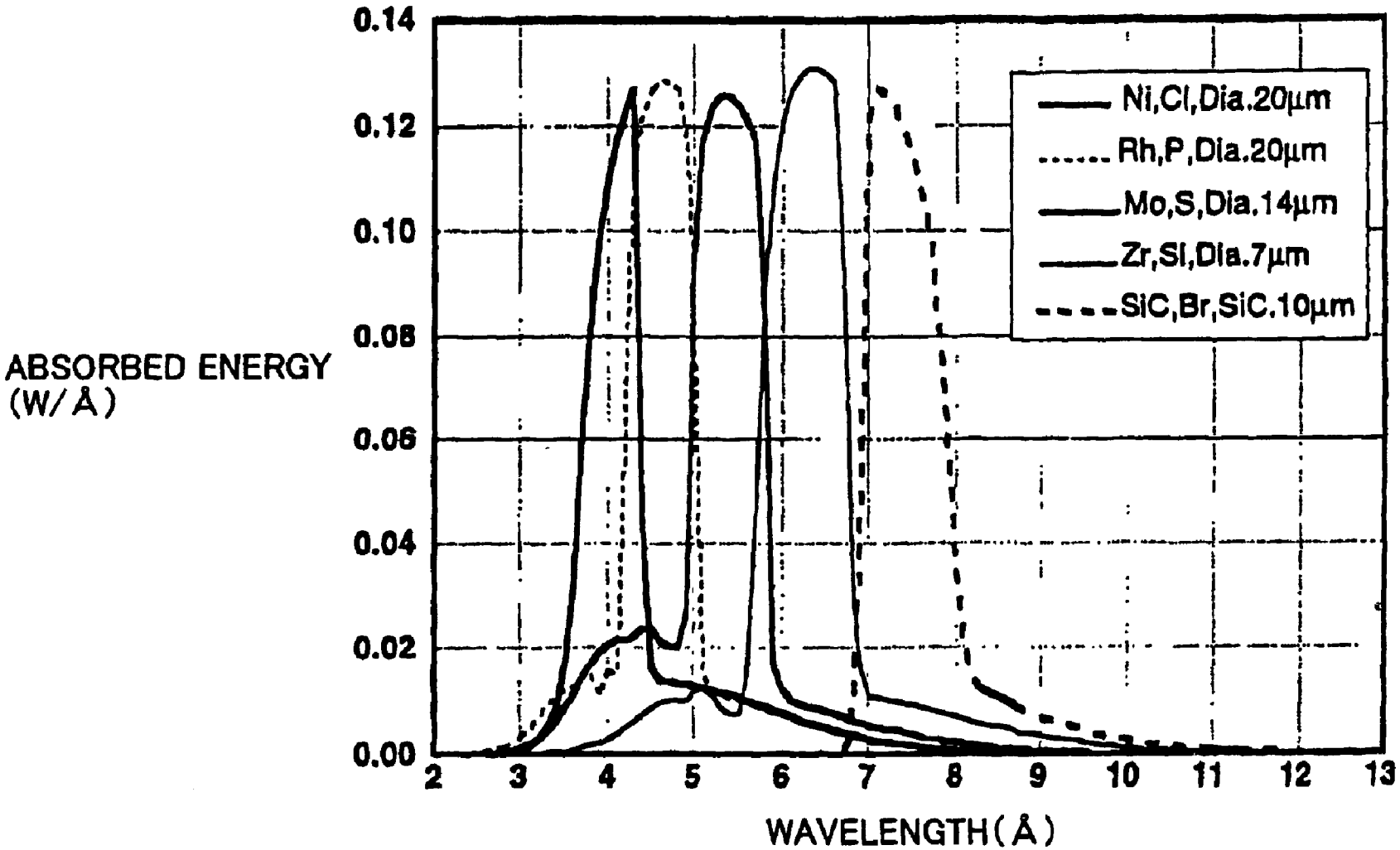
FIG. 24 illustrates absorbed energy spectra of resists containing various elements while varying only surface materials with the resists in a seventh embodiment of the present invention.

A method of varying the surface materials for mirrors was employed as a method of cutting a short-wave side of exposure light without utilizing a wavelength sweeper. FIG. 24 shows examples thereof. All mirrors were set to an oblique incidence angle of 1°, and only surface materials were varied with resist materials. In other words, mirrors of nickel, rhodium and silicon carbide were employed for chlorine-, phosphorus- and bromine-containing resists respectively. It is obvious in principle that filters can be employed for optimization similarly to the aforementioned fifth and sixth embodiments, and the thicknesses of mask substrates of diamond, silicon carbide etc. were varied in this embodiment.

Eighth Embodiment

Figure 25:
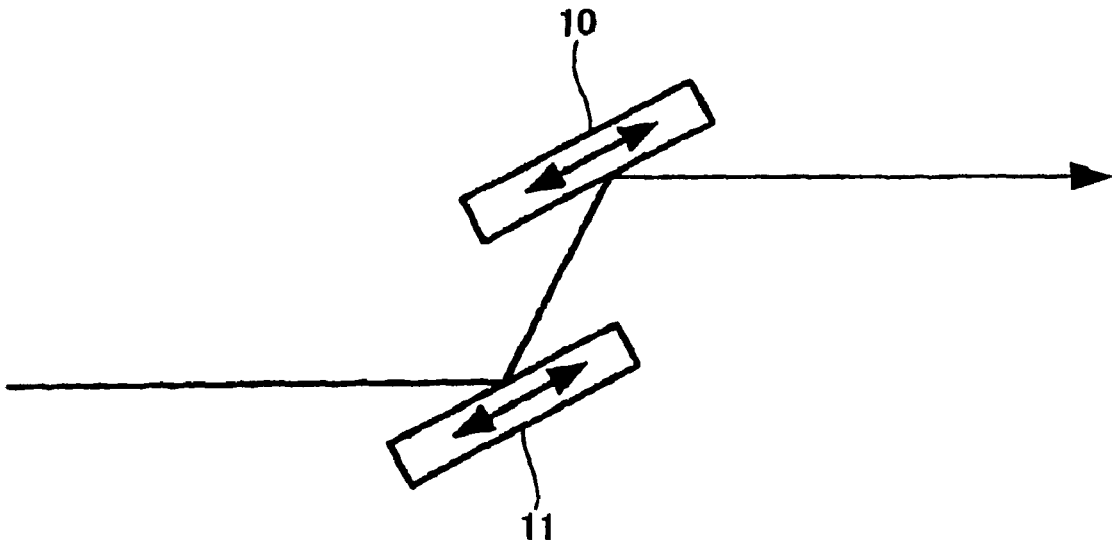
FIG. 25 illustrates an optical system employing two plane mirrors having variable mirror positions and a constant incidence angle in an eighth embodiment of the present invention.

FIG. 25 shows an optical system employed for the method of changing the surface materials for mirrors. Referring to FIG. 25, two plane mirrors 10 and 11 having variable mirror positions and a constant incidence angle are combined with each other. Surface coating materials are varied with positions of the plane mirrors 10 and 11 irradiated with X-rays.

Figure 26:
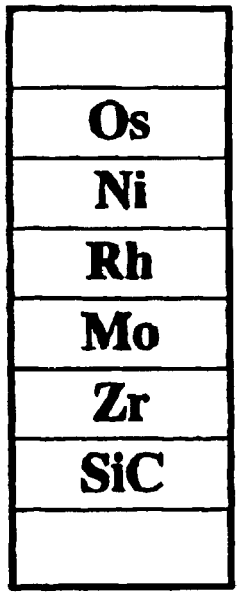
FIG. 26 illustrates exemplary mirror surface coating materials varying with positions on the mirror surface in the eighth embodiment.

FIG. 26 shows exemplary mirror surface coating materials varying with the mirror positions. When the mirrors 10 and 11 are vertically moved, the various mirror surface materials reflect light to change the cut wavelength in this optical system. This optical system can change the cut wavelength while changing neither the optical axis nor the mirrors 10 and 11. While the optical system employs two mirrors 10 and 11 in this embodiment, an optical system not changing an optical system can be implemented with a single or at least three mirrors due to the constant incidence angle.

While movable mirrors fixed to the oblique incidence angle of 1° are employed in the seventh embodiment, the oblique incidence angle is not restricted to 1° but a similar effect can be expected with a deeper or shallower angle depending on the material. A metal such as beryllium or boron nitride belonging to the group 2 or 4 of the periodic table having no absorption edge in the target wave range of the present invention can be utilized as the material for mirrors of a wavelength sweeper selecting a wavelength by changing the incidence angle.

However, the reflection characteristics of mirrors having a surface material of a metal belonging to the group 5 or 6 of the periodic table is influenced by an absorption edge and hence an optical system capable of arbitrarily selecting a wavelength by only changing the incidence angle cannot be implemented with such a material. When wavelength dependence of reflectance is optimally selected for such a mirror surface material, however, an optical system acting similarly to a wavelength sweeper can be implemented and is important in a sense. The structure of a mirror moving mechanism is simplified in a point that the direction of movement of optical elements is one-dimensional, and light of a short wavelength can be obtained through a mirror system having a deep incidence angle. Consequently, advantages such as miniaturization of mirrors can be implemented only according to the present invention.

Ninth Embodiment

Figure 27:
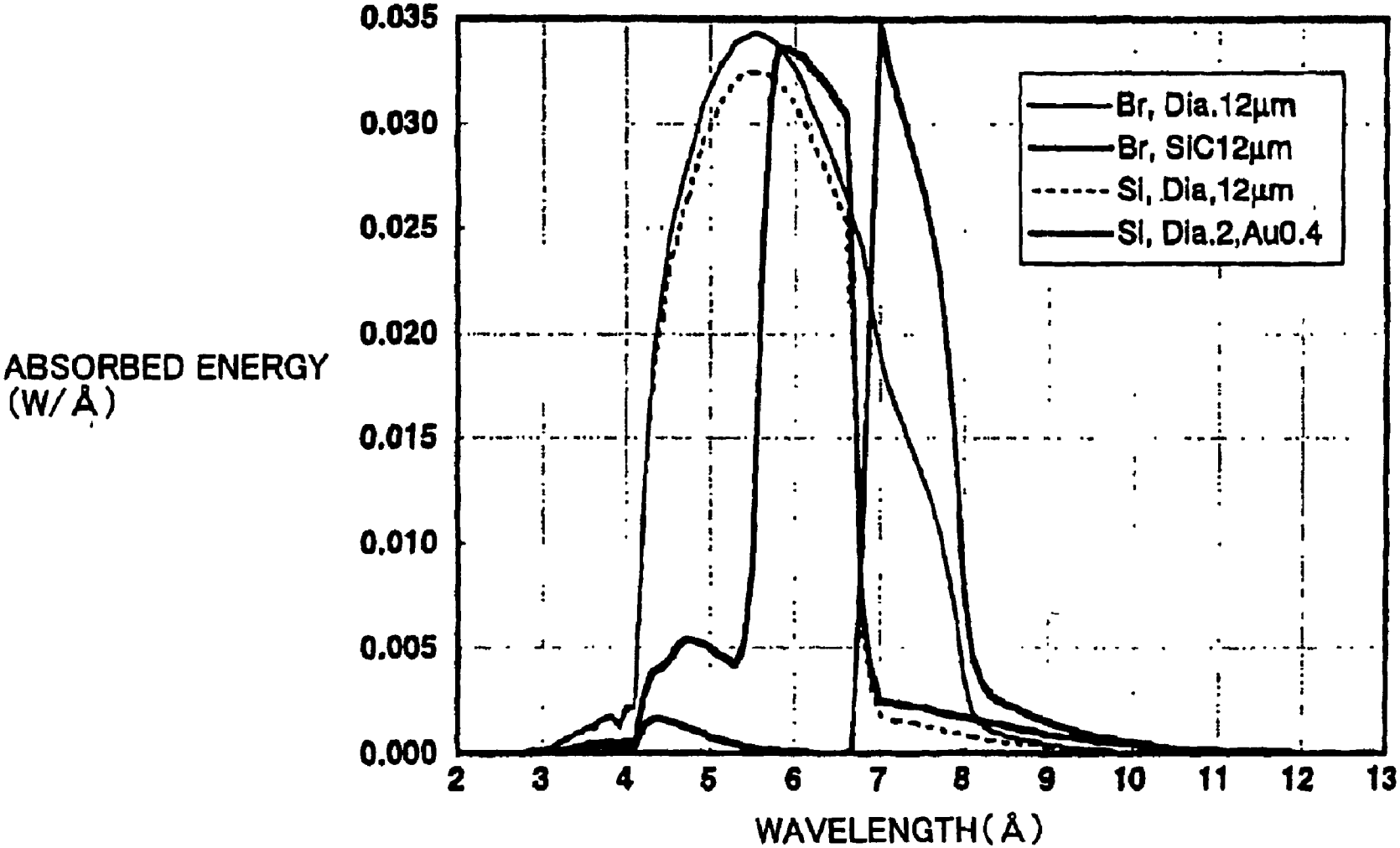
FIG. 27 illustrates absorbed energy spectra of silicon-containing resists and bromine-containing resists obtained by combining filters and resists in an illumination optical system employing two rhodium mirrors having an oblique incidence angle of 1° in a ninth embodiment of the present invention.

A method employing a filter material is shown as a method of cutting short-wave light and obtaining exposure light having the optimum wavelength. FIG. 27 shows an embodiment in cases of bromine- and silicon-containing resists. This figure shows spectra of X-rays absorbed by bromine-containing resists of 0.2 μm in thickness exposed through an exposure apparatus having an illumination optical system employing two rhodium mirrors having an oblique incidence angle of 1°. This illumination system applies light of about 4 to 10 Å to mask surfaces.

When exposing the bromine-containing resists with this exposure apparatus, the peaks of absorbed light are in the range of 4 to 8 Å in a diamond filter of 12 μm in thickness. FIG. 27 also shows an example implementing a waveband having low photoelectron energy by cutting a short-wave side. In an example employing a silicon carbide filter of 12 μm in thickness, the quantity of light having a wavelength shorter than 7 Å is remarkably reduced in energy absorbed in the resist, for performing optimization to the bromine-containing resist utilizing light in the band of 7 to 8 Å.

FIG. 27 also shows an example employing gold as a filter material for a silicon-containing resist. The optimum wavelength for the silicon-containing resist can be selected in the range of 7 to 5.5 Å by employing the gold filter of 0.4 μm in thickness. While the thickness of the silicon carbide filter is 12 μm in this example, a similar result was obtained through a silicon carbide filter of 10 μm in exposure with a diamond mask of 2 μm in thickness.

Figure 28:
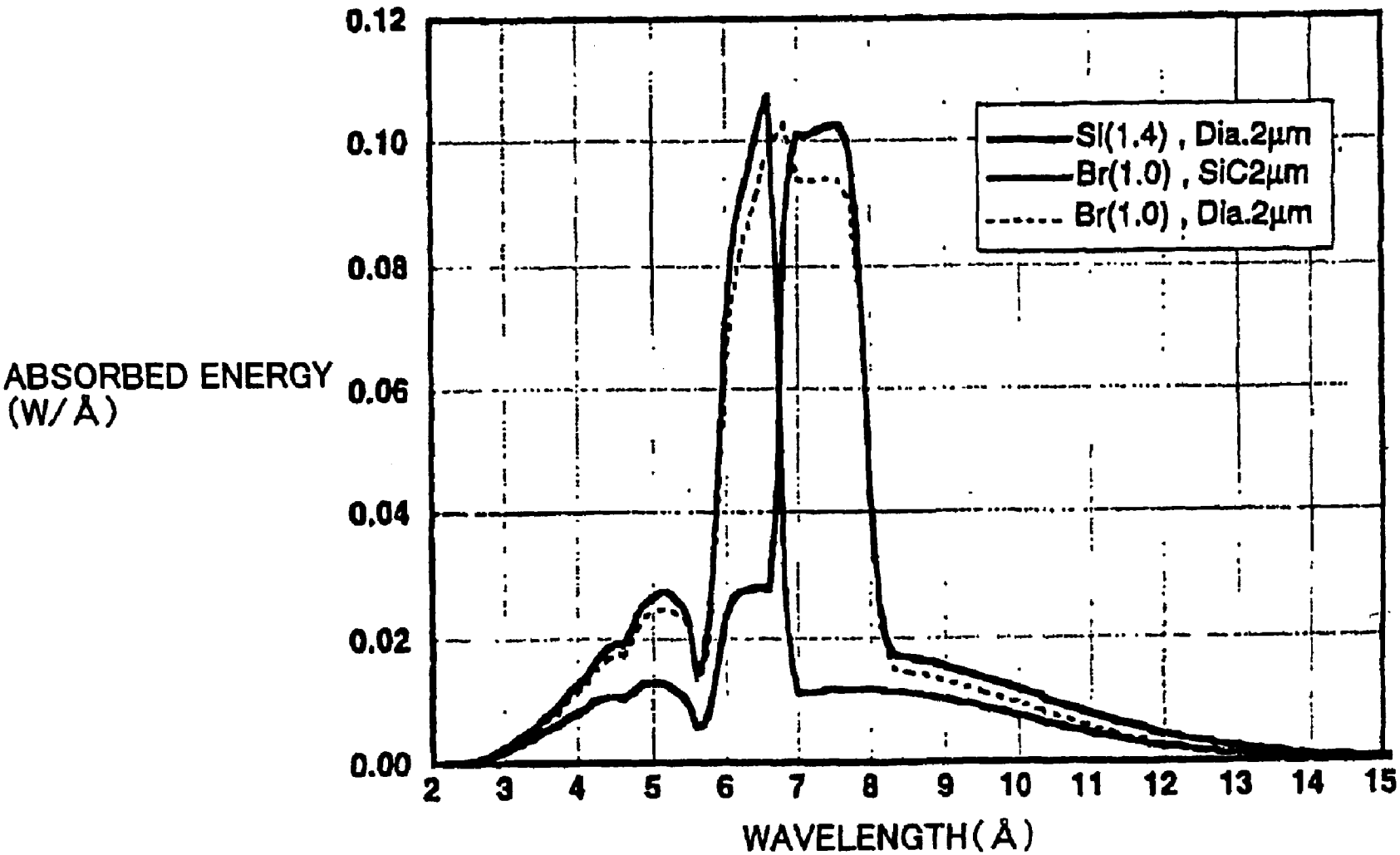
FIG. 28 illustrates absorbed energy spectra of a silicon-containing resist and bromine-containing resists obtained by combining filters and resists in an illumination optical system employing two platinum mirrors having an oblique incidence angle of 1° in the ninth embodiment.

FIG. 28 shows a case of an exposure apparatus of an illumination system having platinum mirrors. This apparatus, connected to a light source having a deflecting magnetic field of 3.29 T and acceleration energy of 0.585 GeV, is approximately optimum for a silicon-containing resist, and can be used as such. FIG. 28 shows that remarkable improvement is attained also with respect to a bromine-containing resist by simply changing a diamond substrate mask to a silicon carbide substrate mask of 2 μm.

As hereinabove described, the short-wave side can be cut by employing the absorption edge of the element, for implementing exposure with the optimum wavelength. The absorption edge of silicon effectively functions as a filter and hence silicon carbide or silicon nitride is effective in the case of a bromine-containing resist, and it is effective to apply this material not only to a filter but also to a mask substrate.

When employing a mask of a substrate, such as a diamond mask, transparent up to a short wavelength, a material such as tantalum or tungsten having an absorption edge in the vicinity of 7 Å is suitable as the filter material. As to a silicon-containing resist, a material having an absorption edge in the vicinity of 6 Å is suitable as the filter material for selecting the optimum wavelength among metals such as rhenium, osmium, iridium, platinum and gold belonging to the group 6.

This material is applied to a mask substrate or a window member serving as a vacuum barrier by vacuum deposition or sputtering. A metal such as zirconium, niobium, molybdenum, ruthenium, rhodium, palladium or silver belonging to the group 5 or an alloy of this metal is effective for optimizing the wavelength for exposing a sulfur-containing resist. This embodiment is particularly effective in the point that the wavelength can be optimized through a filter every resist material when an exposure system employing an optical system including light of the necessary waveband is already present.

Tenth Embodiment

Figure 29:
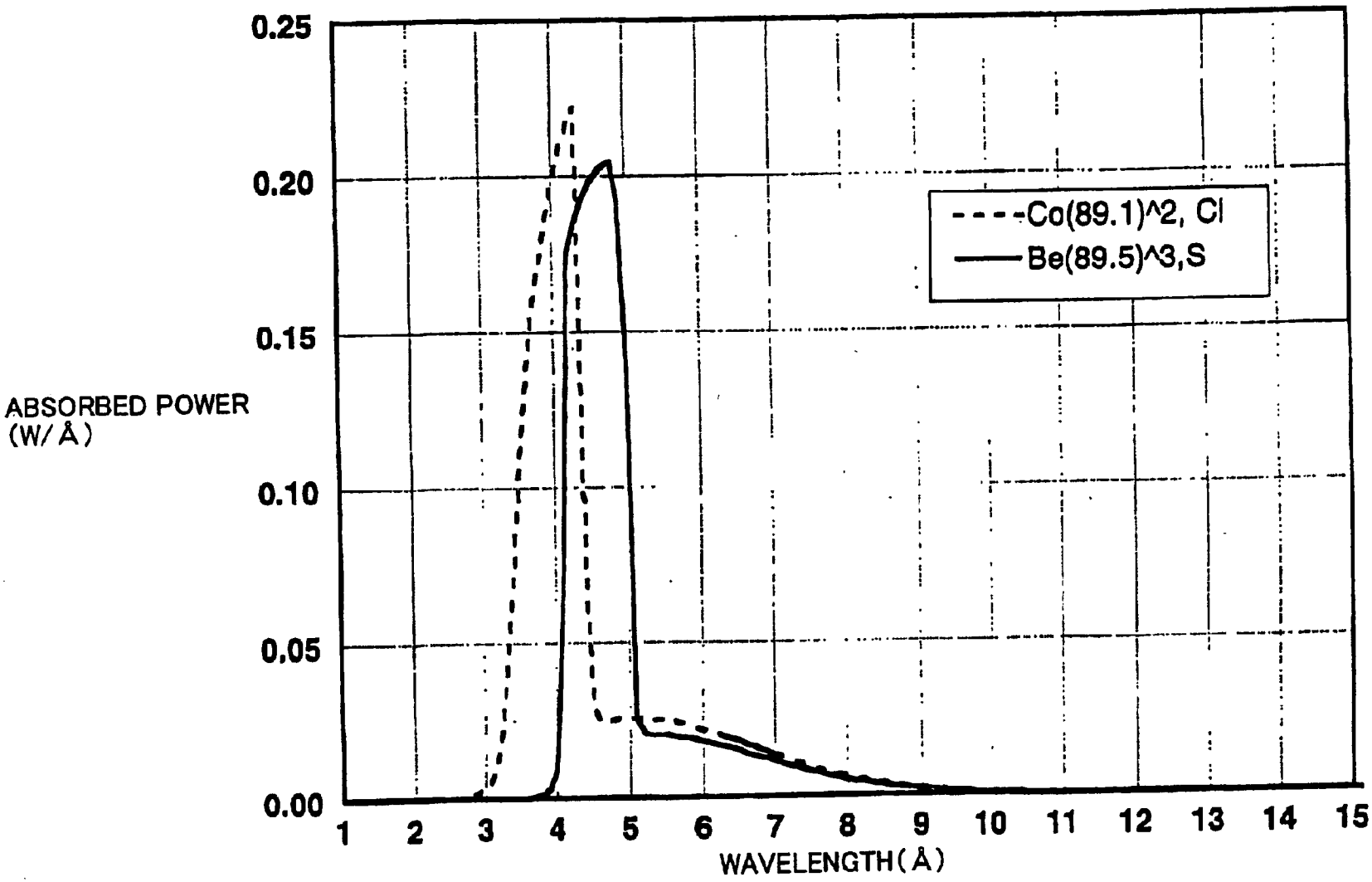
FIG. 29 illustrates absorbed energy spectra of resists containing chlorine and sulfur in a system similar to that of the fourth embodiment employing a mask of a diamond substrate having a thickness of 10 $\mu$m in a tenth embodiment of the present invention.
Figure 30:
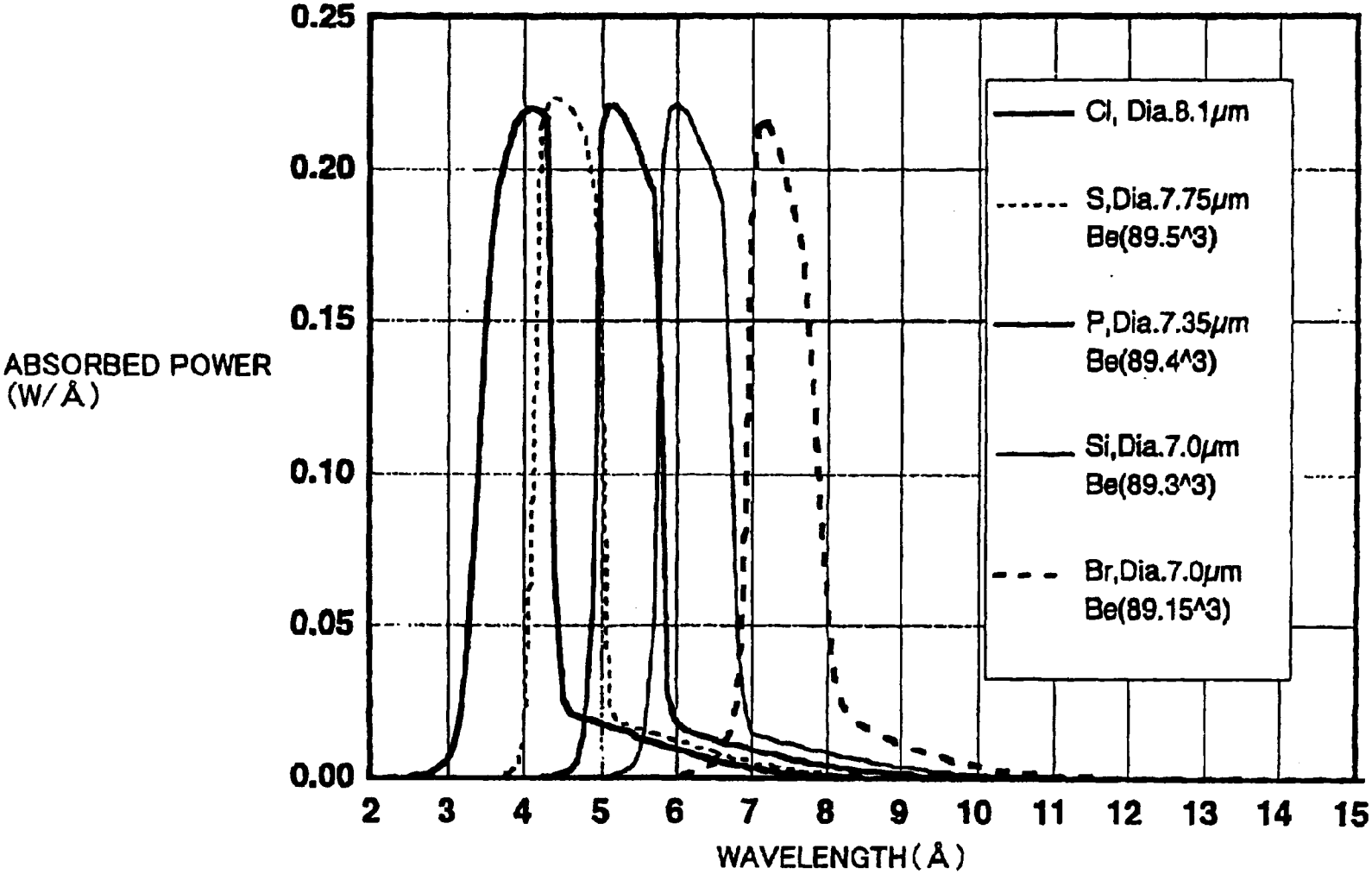
FIG. 30 illustrates absorbed energy spectra of resists containing chlorine, sulfur, phosphorus, silicon and bromine in a system similar to that of the fourth embodiment employing a mask of a diamond substrate having a thickness of 10 $\mu$m in the tenth embodiment.

Illumination light for exposure optimum for an element contained in a resist can be obtained by employing the aforementioned system of the fourth embodiment. FIG. 29 shows results of application to resists containing chlorine and sulfur. This figure indicates that the exposure wavelength can be optimized through a mask of a diamond substrate of 10 μm. FIG. 30 shows absorption spectra of not only the resists containing chlorine and sulfur but also those containing phosphorus, silicon and bromine. Not only wavelength sweepers but also the thicknesses of diamond filters are so varied that the quantities of absorption in the resists are substantially similar to each other.

According to these results, it follows that the average wavelength of absorbed light is reduced from 7.6 Å to about 4.1 Å and the resolution of an optical image is improved. The energy of photoelectrons is low on a short-wave side of an absorption edge and apparently effective for high resolution, while the bandwidth of exposure light is more important. In other words, the energy of photoelectrons generated on an immediate short-wave side is extremely low and hence the quantity of energy stored in the resist is small, and it follows that contribution to the resolution is decided by electrons other than the noted photoelectrons. Therefore, it is important to select not only the optimum wavelength but also the optimum waveband not only in view of high-speed exposure but also in view of high resolution.

In this embodiment, mask contrast, which is 2.35 in a mask employing a tantalum absorber of 0.3 μm in thickness with respect to a bromine-containing resist, is increased to 6.21 in a case of a silicon-containing resist. In other words, it follows that mask contrast similar to that in the case of 0.3 μm with respect to the bromine-containing resist can be obtained when employing the silicon-containing resist with a thin absorber of about 0.1 μm in thickness.

Illumination light for exposure having a shorter wavelength than a system including two cobalt mirrors having an incidence angle of 89.1° can be implemented by employing a beam line system including a condensing/magnifying mirror having a shallower oblique incidence angle.

Figure 31:
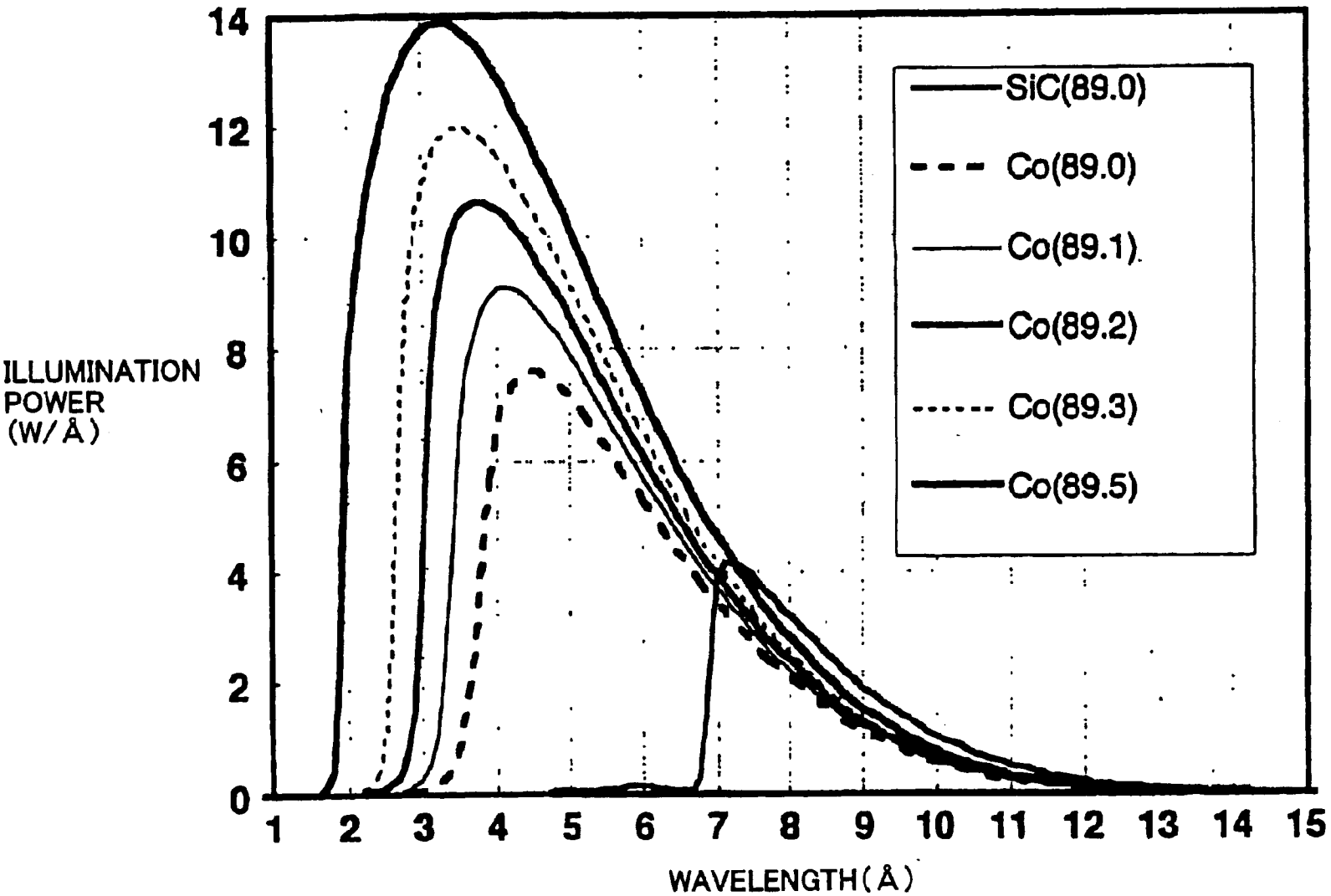
FIG. 31 illustrates exemplary illumination light with reference to mirrors having different oblique incidence angles in a system similar to that of the fourth embodiment in the tenth embodiment.

FIG. 31 shows examples of illumination light in a case of employing cobalt mirrors having different oblique incidence angles. Illumination light having a wavelength reduced to about 1 Å can be obtained in a cobalt mirror system having an oblique incidence angle of 0.5°, i.e., an incidence angle of 89.5°. As to mirror surface materials capable of reducing wavelengths by reducing oblique incidence angles, not only cobalt but also metals such as nickel, copper and iron belonging to the group 4 and alloys thereof can also provide similar illumination light by employing different oblique incidence angles.

Further, mirrors of metals such as tantalum, tungsten, osmium, iridium, platinum and gold belonging to the group 6 and alloys thereof can also provide short-wave illumination light including light of a shorter wavelength than 2 Å with deeper oblique incidence angles although reflectance is slight reduced.

Figure 32:
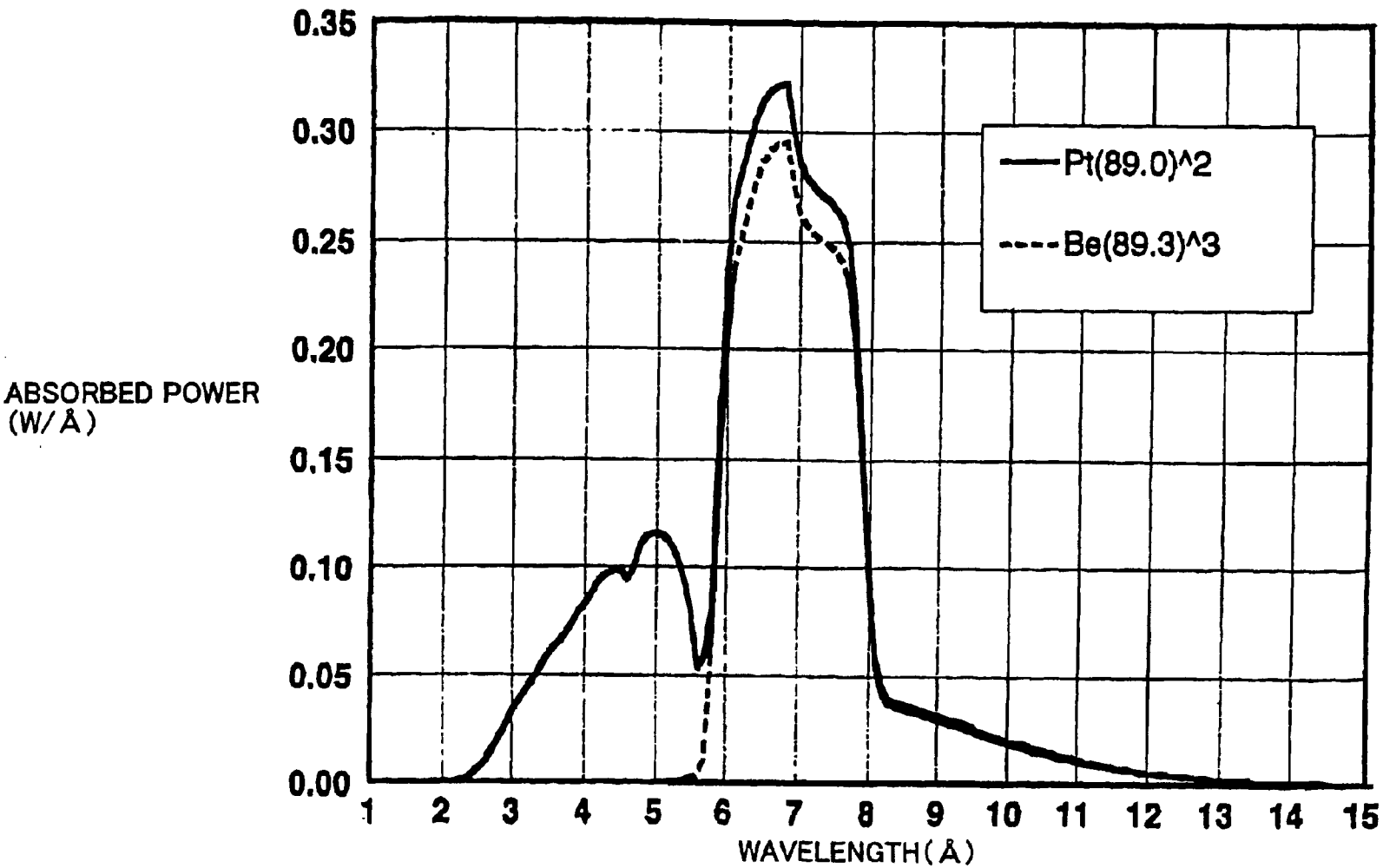
FIG. 32 illustrates absorbed energy spectra of a bromine resist cutting a satellite peak of a short-wave side in a system, similar to that of the fourth embodiment, employing platinum mirrors having an oblique incidence angle of 1° and a wavelength sweeper in the tenth embodiment.

FIG. 32 shows an example cutting satellite peaks on short-wave sides in a system employing platinum mirrors having an oblique incidence angle of 1° and a wavelength sweeper.

Eleventh Embodiment

Figure 33:
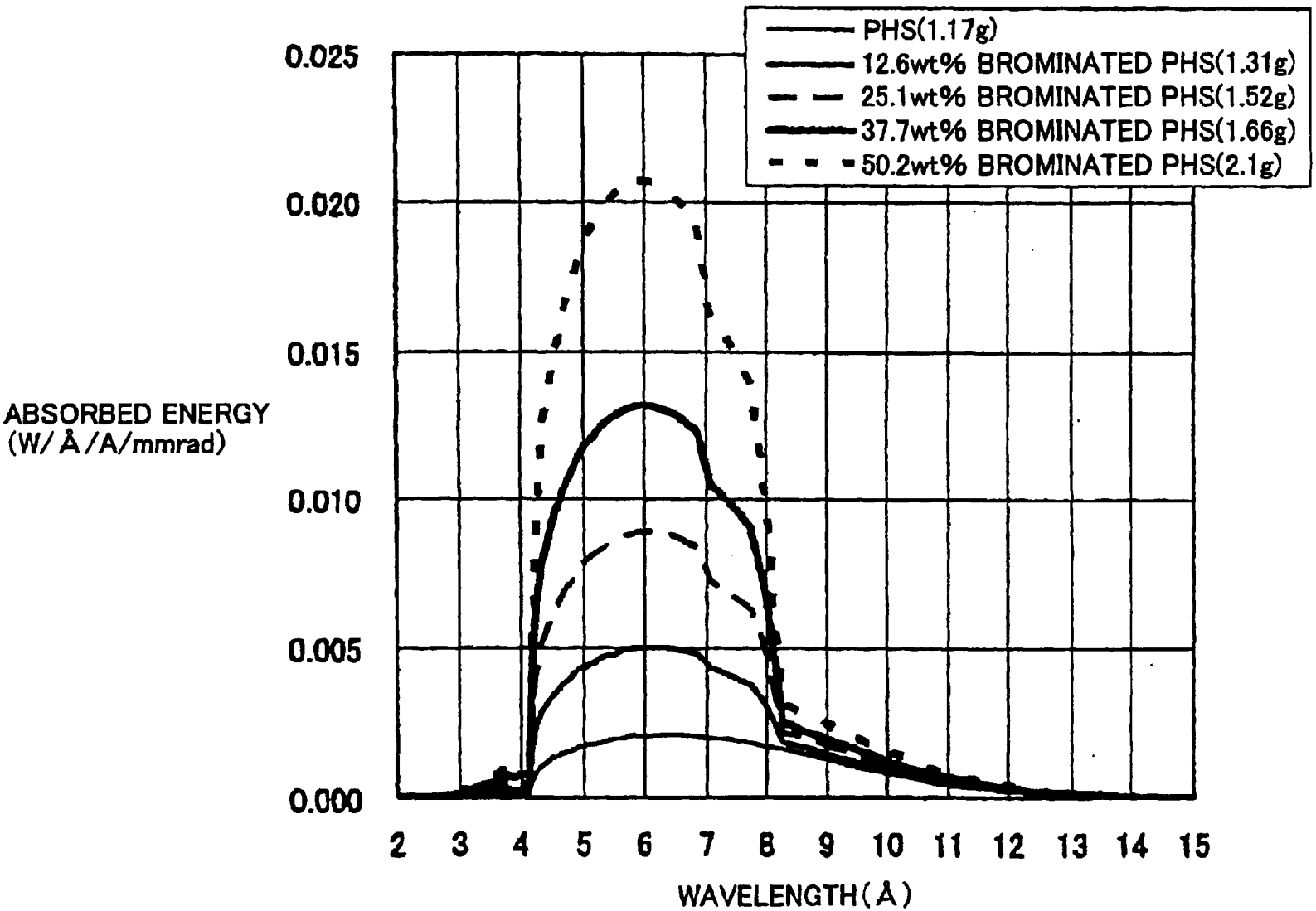
FIG. 33 illustrates energy absorption spectra of brominated PHS resists in a system similar to that of the first embodiment employing rhodium mirrors in an eleventh embodiment of the present invention.
Figure 34:
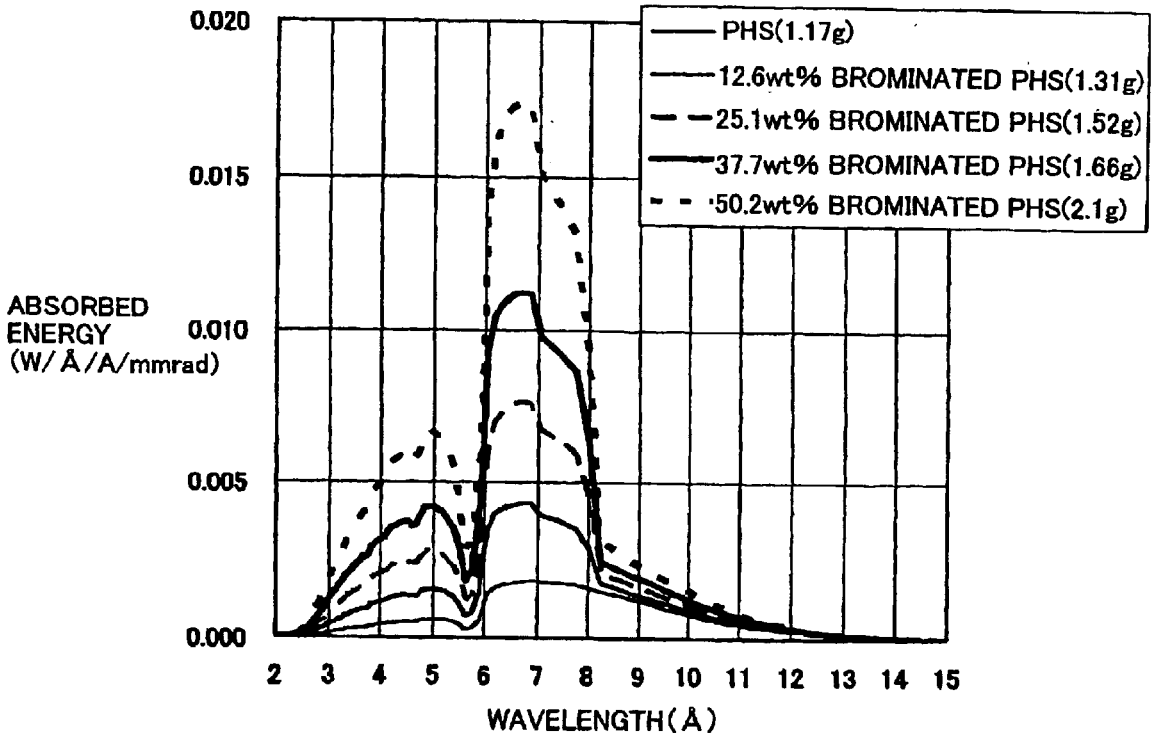
FIG. 34 illustrates energy absorption spectra of the brominated PHS resists in a system similar to that of the first embodiment employing platinum mirrors in the eleventh embodiment.

FIG. 33 shows energy absorption spectra of brominated PHS resists, employed in the aforementioned first embodiment, exposed with light emitted from a radiation generator (0.7 GeV and 4.5 T) and reflected twice by rhodium mirrors having an oblique incidence angle of 1°. FIG. 34 shows energy absorption spectra of resists in a case of employing platinum mirrors in place of the rhodium mirrors.

The thickness of a beryllium window in the exposure system was 20 μm, and that of a diamond substrate was 2 μm. It is understood that absorption on a shorter-wave side of the absorption edge (7.8 Å) of bromine is remarkably increased as the bromine weight ratio is increased. The quantity of energy absorbed in the brominated PHS resist having a bromine weight ratio of about 50% was 7 to 8 times in the case of the exposure system employing rhodium mirrors and 5 to 6 times in the case of the exposure system employing platinum mirrors as compared with a PHS resist containing no bromine. This indicates that sensitivity can be improved by employing a resist containing a material such as bromine having an absorption edge in the exposure wave range. Increase of absorption of a component having a shorter wavelength than the absorption edge of bromine remarkably changes the quantities of energy of photoelectrons and Auger electrons generated in the exposed resist.

A material, such as a PHS resist, containing no bromine, mainly consisting of carbon, oxygen and hydrogen and having no absorption edge in the exposure wave range generates Auger electrons having low energy and photoelectrons having energy close to that of the exposure light. The energy of photoelectrons is increased as the exposure wavelength is reduced, and hence it follows that blurring of electrons influencing resolution is increased.

Bromine has an absorption edge in the exposure wave range, and hence low-energy photoelectrons from L shells and Auger electrons from M shells, having energy of about 1.4 KeV corresponding to a wavelength of about 9 Å, are generated due to exposure light on an immediate short-wave side of the absorption edge (7.8 Å) of bromine. While photoelectrons and Auger electrons from other electron levels are also generated as a matter of course, the energy thereof is smaller than that of the Auger elections from the M shells, and blurring of electrons is smaller. In the case of short-wave exposure light, the energy of Auger electrons remains unchanged and hence blurring of electrons also remains unchanged.

The energy of photoelectrons is gradually increased and substantially equalized with that of Auger electrons with exposure light of about 4 Å. The energy of photoelectrons is lower than that of Auger electrons and blurring of electrons is also small as compared with the Auger electrons up to 4 Å. In bromine, therefore, electrons having lower energy than the energy (about 1.4 KeV) of the Auger electrons from the M shells are generated also when the wavelength is reduced from about 7.8 Å to 4 Å, and hence blurring of electrons influencing resolution is suppressed also when the wavelength is reduced, whereby high resolution is obtained.

When absorption on a shorter-wave side of the absorption edge of bromine is increased in a bromine-containing resist, this indicates that absorption of the exposure light by bromine gets dominant as compared with carbon, oxygen and hydrogen. This particularly indicates generation of a large quantity of electrons having lower energy than the energy of Auger electrons corresponding to the wavelength of 9 Å with respect to exposure light from the absorption edge (7.8 Å) of bromine up to 4 Å. When employing a brominated PHS resist having a high bromine weight ratio, therefore, it can be expected that blurring of secondary electrons resulting from reduction of the wavelength is suppressed as compared with a PHS resist mainly made of carbon, oxygen and hydrogen.

Figure 35:
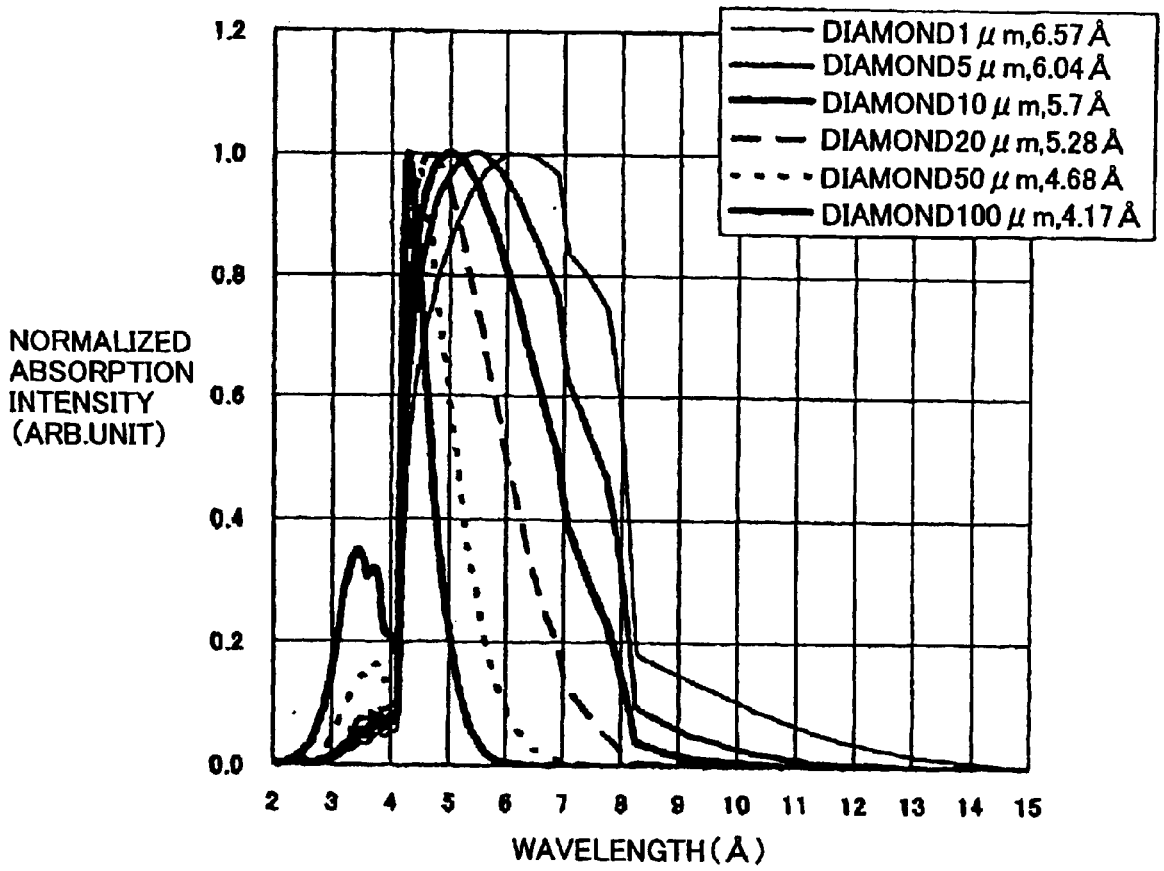
FIG. 35 illustrates energy absorption spectra of a brominated PHS resist in a system similar to that of the first embodiment employing platinum mirrors and a diamond film in the eleventh embodiment.
Figure 36:
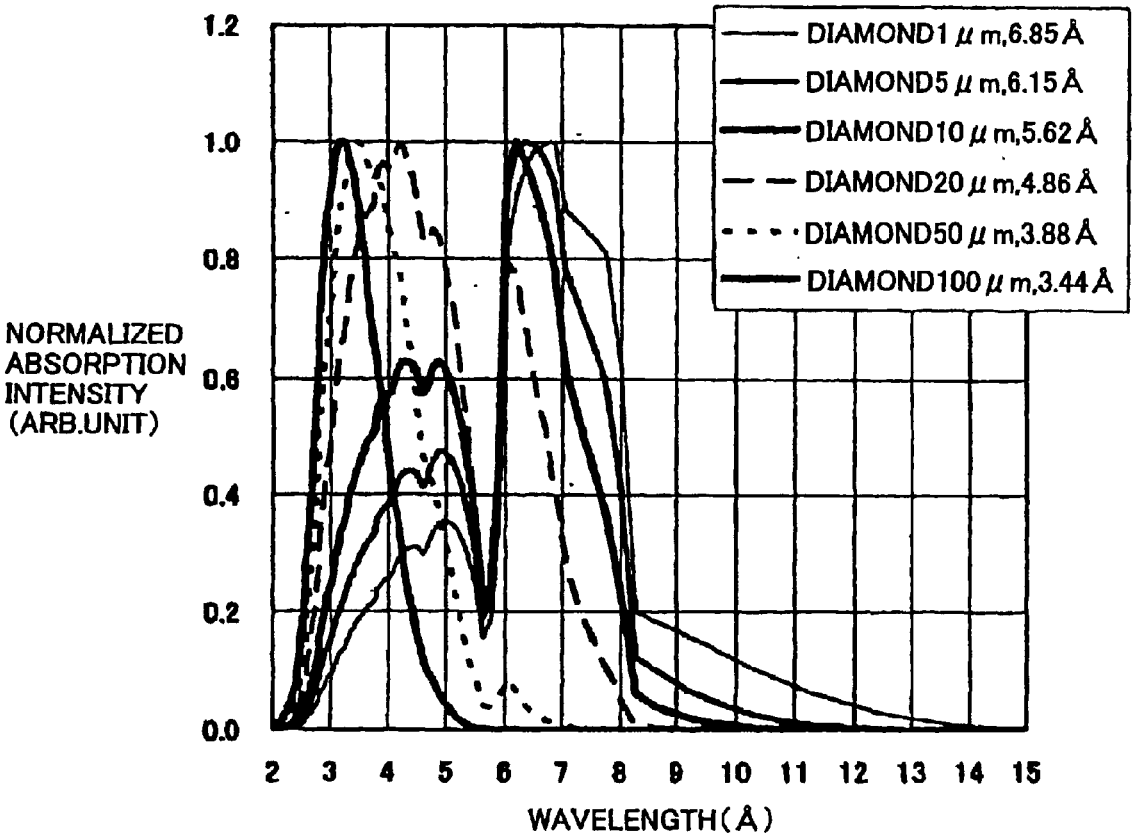
FIG. 36 illustrates energy absorption spectra of the brominated PHS resist in a system similar to that of the first embodiment employing rhodium mirrors and a diamond film in the eleventh embodiment.

The thickness of a diamond film of an X-ray mask membrane was varied from 1 μm to 100 μm for studying the effect of reduction of the wavelength. FIG. 35 shows absorption spectra in a brominated PHS resist having a bromine weight ratio of 50% in a case of a short-wave exposure system employing rhodium mirrors having an oblique incidence angle of 1°, and FIG. 36 shows those in a case of a short-wave exposure system employing platinum mirrors. The absorption spectra are normalized and plot with reference to maximum absorption intensity.

It is understood that a long-wave component is gradually cut and the wavelength is reduced when the thickness of the diamond film is increased from 1 μm to 100 μm. The average absorption wavelength is reduced from 6.57 Å to 4.17 Å in the case of the short-wave exposure system employing rhodium mirrors, and can be reduced from 6.85 Å to 3.44 Å in the case of the short-wave exposure system employing platinum mirrors.

Figure 37:
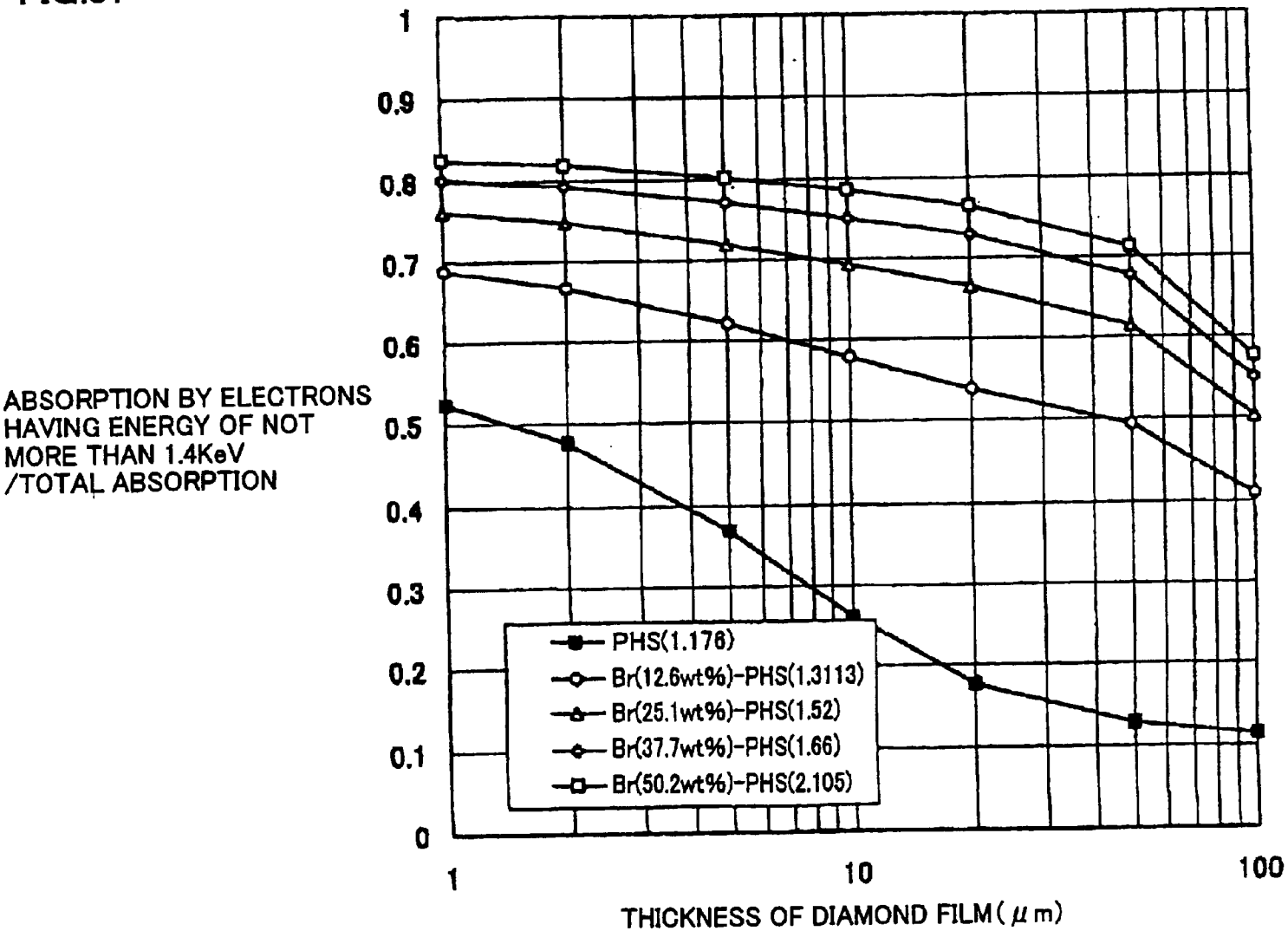
FIG. 37 illustrates ratios of absorption by Auger electrons and photoelectrons having lower energy than the energy (about 1.4 KeV) of Auger electrons in bromine with respect to the total quantity of absorbed energy in resists while varying the thickness of a diamond film in a system similar to that of the first embodiment employing brominated PHS resists and rhodium mirrors in the eleventh embodiment.
Figure 38:
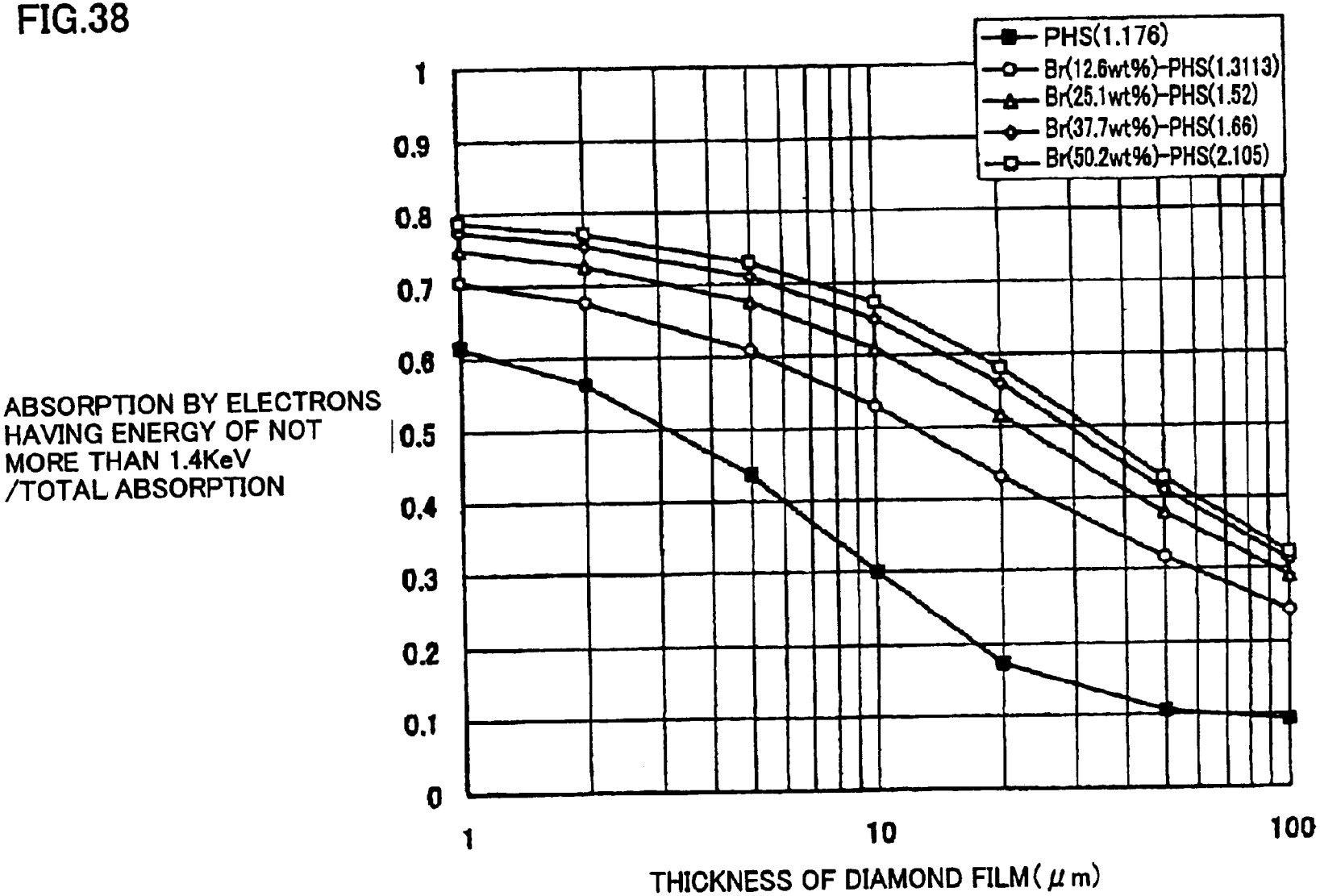
FIG. 38 illustrates ratios of absorption by Auger electrons and photoelectrons having lower energy than the energy (about 1.4 KeV) of Auger electrons in bromine with respect to the total quantity of absorbed energy in resists while varying the thickness of a diamond film in a system similar to that of the first embodiment employing brominated PHS resists and platinum mirrors in the eleventh embodiment.

The relation between energy levels of electrons generated from brominated PHS resists irradiated with exposure light reduced in wavelength and the quantities of absorption in the resists was investigated. FIG. 37 is a graph plotting the ratios of absorption by Auger electrons and photoelectrons having lower energy levels than the energy (about 1.4 KeV) of Auger electrons of bromine with respect to the total quantity of energy absorbed by the resists in the short-wave exposure system employing rhodium mirrors according to this embodiment while varying the thickness of the diamond film. FIG. 38 shows results in the short-wave exposure system employing platinum mirrors in place of the rhodium mirrors.

If this ratio is in excess of 0.5, it means that the ratio of electrons having lower energy than Auger electrons of bromine is large in the absorbed energy in the resist. In other words, this is an index showing the ratio of electrons having lower energy than the energy (1.4 KeV) corresponding to the wavelength of about 9 Å in the total quantity of absorption, and if this ratio is in excess of 0.5, it means that the resist dominantly absorbs electrons exerting small influence on blurring among the total quantity of absorption. If this ratio is smaller than 0.5, it means that the resist dominantly absorbs electrons exerting large influence on blurring.

Referring to FIG. 37, the ratio of absorption of electrons having energy of not more than 1.4 KeV is reduced from 0.5 in the PHS resist when the thickness of the diamond film exceeds 2 μm to reduce the wavelength in the system employing rhodium mirrors, and reaches a low level of about 0.1 when the thickness of the diamond film is 100 μm to further reduce the wavelength. This indicates that high-energy electrons exerting remarkable influence on blurring are dominantly absorbed in the resist. The ratio is remarkably increased in the bromine-containing PHS resist as compared with the PHS resist as the bromine weight ratio is increased. While this ratio is reduced when the thickness of the diamond film is increased to increase the short-wave component, a value of at least 0.5 is obtained in the brominated PHS resist having a bromine weight ratio of 50% also when the thickness of the diamond film is 100 μm while low-energy electrons exerting small influence on blurring occupy a ratio of at least 50% of absorption also in the case of an average absorption wavelength of 4.17 Å, and it is understood that blurring of electrons can be suppressed also when the wavelength is reduced.

According to the present invention, the energy of Auger electrons is higher than that of photoelectrons and the ratio of absorption of low-energy electrons is dominant in the exposure wave range so that a pattern of high resolution can be obtained while suppressing blurring of electrons also when the wavelength is reduced.

In a resist containing a material having an absorption edge in the exposure wave range, it follows that the ratios of Auger electrons having constant energy and photoelectrons having lower energy are remarkably increased on a shorter-wave side of the absorption edge. In the range where the energy of photoelectrons is not in excess of the energy of Auger electrons, blurring of the photoelectrons is lower than that of the Auger electrons also when the wavelength is reduced, and hence a pattern having high resolution is obtained The energy of Auger electrons of bromine is higher than that of photoelectrons in the range of about 8 Å to 4 Å, and the quantity of absorption is large due to the shorter wave range than the absorption edge. Further, the exposure wave range of the exposure system employing rhodium mirrors is mainly longer than 4 Å and substantially matches with the wave range where the energy of Auger electrons of bromine exceeds that of photoelectrons. Therefore, the combination of the bromine-containing resist and the exposure system employing rhodium mirrors is particularly effective since absorption of low-energy electrons is dominant and blurring of electrons can be kept low.

If the bromine weight ratio is lower than 37.7%, however, the ratio of absorption of electrons having energy of not more than 1.4 KeV may be reduced below 0.5 when the thickness of the diamond film is increased. Thus, the ratio of high-energy electrons is gradually increased when the wavelength is reduced, and hence the optimum wave range depends on the bromine weight ratio.

When resolution necessary for the pattern is increased, blurring of electrons must be further reduced. Therefore, the optimum exposure wave range must be selected in response to the necessary pattern dimension.

Referring to FIG. 36, the aspect changes in the case of platinum mirrors since the exposure light contains a component having a wavelength shorter than 4 Å. Absorption by low-energy electrons is large as compared with a PHS resist containing no bromine, similarly to the case of rhodium mirrors. The quantity of light of a wavelength of about 6 to 8 Å is large when the thickness of the diamond film is up to about 10 $\mu$m, and hence the energy of photoelectrons from bromine is low.

When the thickness of the diamond film is further increased to reduce the wavelength, however, it follows that the ratio of a component having a wavelength shorter than 4 Å is increased in the case of platinum mirrors as compared with the case of rhodium mirrors. In bromine, the energy of Auger electrons is not changed by the exposure light having a wavelength shorter than 4 Å, while the energy of photoelectrons exceeds that of Auger electrons to increase blurring of electrons. Thus, it is understood that the ratio of absorption by electrons having energy higher than 1.4 KeV is rapidly increased in the bromine-containing PHS resist when the wavelength is reduced in the case of platinum mirrors. The ratio is reduced to about 0.3 when the thickness of the diamond film is 100 $\mu$m. Therefore, the system employing platinum mirrors is preferably employed in an exposure wave range exhibiting an average absorption wavelength substantially longer than 4 Å.

It has been shown that conditions capable of forming a pattern having high resolution with low energy of photoelectrons and Auger electrons, i.e., with small blurring by secondary electrons, can be implemented by employing a resist containing an element having an absorption edge in the vicinity of the exposure waveband. It is obvious from the principle of the present invention that the ratio of the element having the absorption edge in the vicinity of the exposure waveband in the resist is important.

While the effect in view of X-ray absorptivity is increased as the quantity of the element having the absorption edge in the vicinity of the exposure waveband is increased, influence is exerted on other elements to be considered such that solubility of the resist is reduced as the bromination ratio is increased, and hence it follows that there is an optimum value.

In the case of a bromine-containing resist, the atomic weight of bromine is large and hence a resist containing 1 to 4 elements per monomer is preferable. In the case of silicon, the atomic weight is small and hence it follows that a larger quantity is preferable. Therefore, a resist such as siloxane resist containing silicon in the polymer skeleton and including side chains having a small molecular weight or containing silicon also in side chains is preferable. A more desirable effect is attained by introducing bromine into the siloxane resist.

Twelfth Embodiment

Energy of electrons generated by exposure has been considered as to silicon having an absorption edge at about 7 Å. Auger electrons having energy of about 1620 eV and low-energy photoelectrons are generated with reference to light having a wavelength slightly shorter than the absorption edge (6.9 Å) of silicon. In other words, Auger electrons having energy corresponding to a wavelength of about 7.6 Å are generated at the maximum, and hence blurring of electrons can be reduced also when the wavelength is reduced. When the wavelength is further reduced, the energy of photoelectrons is gradually increased while the energy of Auger electrons remains constant, to be substantially equal to the energy of the Auger electrons at an exposure wavelength of about 3.6 Å.

In other words, the energy of electrons generated from silicon is lower than the energy corresponding to the wavelength of about 7.6 Å with reference to the exposure light in the range of about 6.9 Å to about 3.6 Å, and hence blurring of electrons is not increased but a pattern of high resolution is obtained also when the wavelength is reduced. Therefore, it is an effective method for improvement of resolution to limit the main exposure wave range to this range. The energy of photoelectrons exceeds that of Auger electrons and blurring of electrons is gradually increased when the wavelength is further reduced.

In order to study resolution in siloxane resist or polysilazane resist containing silicon, the ratio of absorption by electrons having lower energy than that of Auger electrons of silicon with respect to total absorbed energy was obtained.

Figure 39:
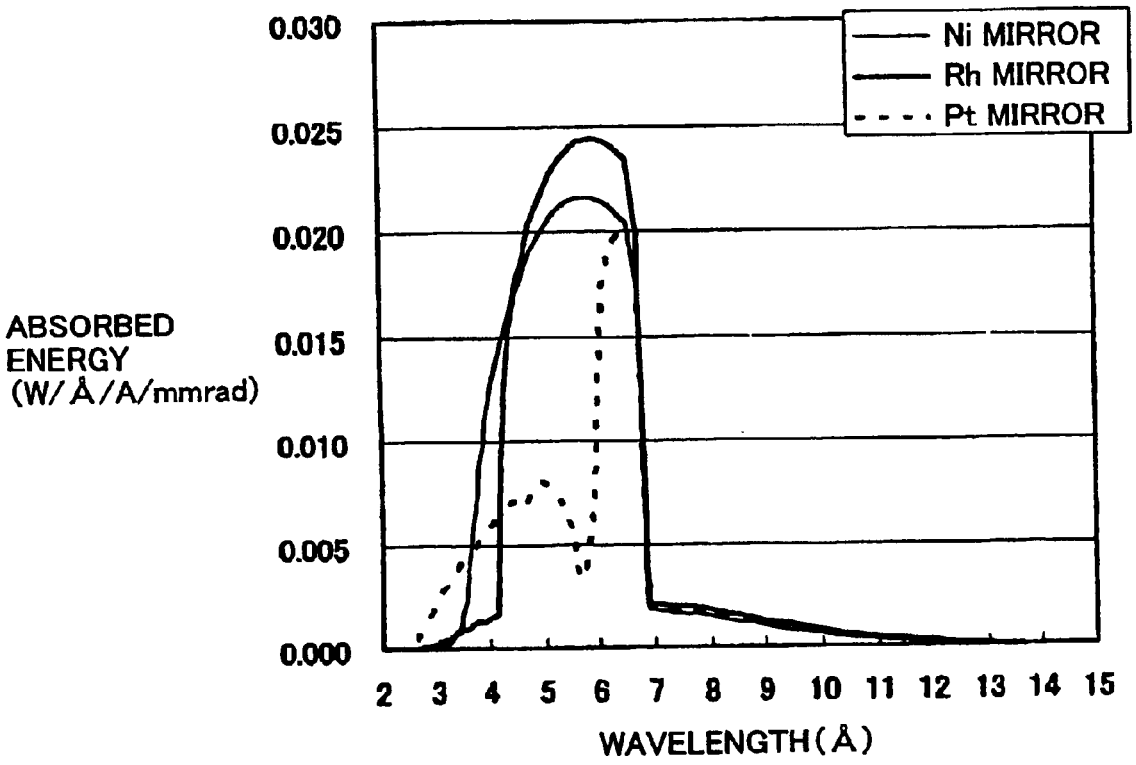
FIG. 39 illustrates energy absorption spectra of a silicon resist in exposure systems, similar to that of the first embodiment, employing rhodium mirrors, nickel mirrors and platinum mirrors in a twelfth embodiment of the present invention.

Such ratios were obtained as to cases of employing rhodium mirrors similar to those in the exposure system according to the aforementioned first embodiment, nickel mirrors having an incidence angle of 1° and platinum mirrors having an incidence angle of 1°. FIG. 39 is a graph showing energy absorption spectra with respect to a silicon-containing resist having specific gravity of 1 g/cm$^3$ and a thickness of 0.35 $\mu$m. The thickness of a diamond mask substrate is 2 $\mu$m.

Absorption on a shorter wave side of the absorption edge of silicon is strong, and the absorption wave range is 3.5 Å to 7 Å in the case employing nickel mirrors. Similarly, the absorption wave ranges are 4 Å to 7 Å in the case employing rhodium mirrors, and 2.5 Å to 7 Å in the case employing platinum mirrors. The ratios of electrons having lower energy than Auger electrons of silicon with respect to total absorbed energy were 0.86 in the case of nickel mirrors, 0.86 in the case of rhodium mirrors and 0.81 in the case of platinum mirrors respectively.

In each exposure system, the ratio of absorption by Auger electrons exceeds 0.8. Thus, the ratio of electrons having lower energy than the energy corresponding to the wavelength of 7.6 Å is dominant with respect to the quantity of absorption in the resist also in the exposure wave range including light having a wavelength shorter than 7 Å, and high resolution can be expected.

Thirteenth Embodiment

A method employing polysilane or polysilene as a resist was employed for increasing the silicon content. The silicon content can be set to 48.3% at the maximum in dimethyl polysilane, and can be increased up to 65.1% in methyl polysilene. Photosensitivity was supplied by a method similar to that for a general chemically amplified resist, and alkali solubility was supplied by a method of introducing a hydroxyphenyl group or a hydroxydifluoromethyl group.

Fourteenth Embodiment

In a fourteenth embodiment, energy and absorption of Auger electrons and photoelectrons in a case of employing a resist containing germanium are considered. Auger electrons having energy of about 1150 eV and low-energy photoelectrons are mainly generated with reference to light having a slightly shorter wavelength than the absorption edge (9.9 Å) of germanium. In other words, Auger electrons having energy (1150 eV) corresponding to the wavelength of about 10.8 Å are generated at the maximum, and hence blurring of electrons can be reduced also when the wavelength is reduced. When the wavelength is further reduced, the energy of Auger electrons remains constant while the energy of photoelectrons is gradually increased to be substantially equal to the energy of the Auger electrons at an exposure wavelength of about 5 Å. In other words, the energy of electrons generated from silicon is lower than the energy corresponding to the wavelength of about 10.8 Å with reference to exposure light in the range of about 10 Å to 5 Å, and hence blurring of electrons is not increased but a pattern of high resolution can be obtained also when the wavelength is reduced. When the wavelength is further reduced, the energy of photoelectrons exceeds that of Auger electrons, to gradually increase blurring of electrons.

The energy of photoelectrons generated at a wavelength up to 4.4 Å is lower than the energy (1396 eV) of Auger electrons of bromine. In other words, the energy of photoelectrons generated with reference to the exposure light of 4.4 Å is substantially identical to the energy corresponding to the wavelength of 9 Å, and germanium generates only electrons having energy lower than about half the energy of the exposure light. Thus, it is understood that blurring of electrons may be small and resolution may be improved also when the energy of photoelectrons is in excess of that of Auger electrons due to reduction of the wavelength, if the energy of generated photoelectrons is low.

Resolution of a germanium-containing resist ($C_8H_8O$+Ge) prepared by adding germanium to a PHS resist was studied. The specific gravity of the resist was 1.17 g/cm$^3$ when the germanium weight ratio was 0%, and 1.6 g/cm$^3$ when the germanium weight ratio was 37.7%. The thickness of the resist film was 0.2 $\mu$m.

Figure 40:
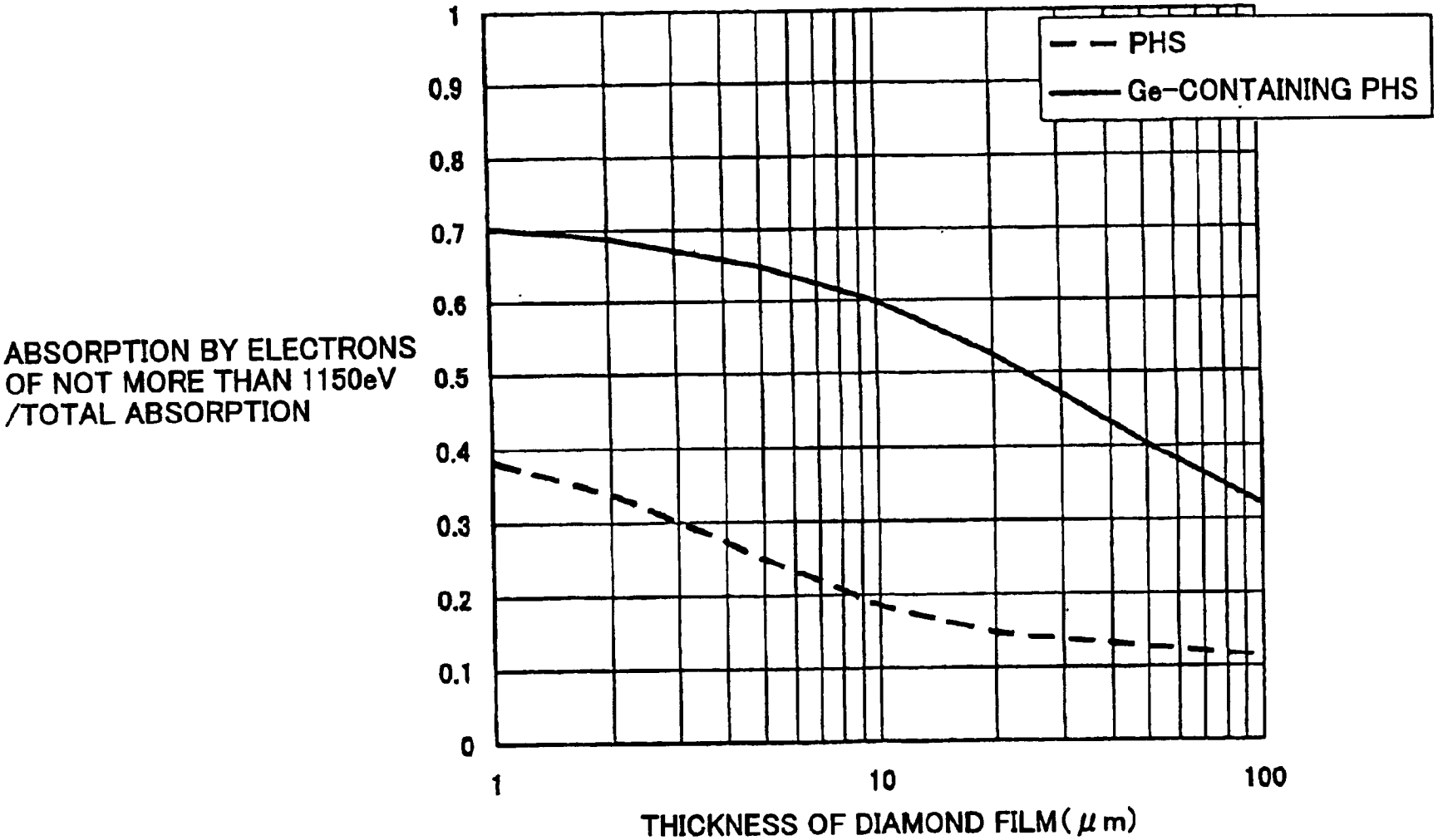
FIG. 40 illustrates the ratios of absorption by electrons having energy lower than the energy of Auger electrons in germanium with respect to the total quantity of absorbed energy with reference to a PHS resist and a germanium-containing PHS resist while varying the thickness of a diamond film in an exposure system similar to that of the first embodiment in a fourteenth embodiment of the present invention.

The ratio of absorption by electrons having lower energy than the energy of Auger electrons of germanium was obtained with respect to the quantity of absorbed energy in the germanium-containing resist having the germanium weight ratio of 37.7% in the exposure system according to the aforementioned first embodiment. FIG. 40 plots this ratio with respect to diamond films having thicknesses of 1$\mu$m to 100 $\mu$m.

The average wavelength, reduced when the thickness of the diamond film is increased, is about 6.2 Å if the thickness of the diamond film is 20 $\mu$m, and about 4.7 Å if the thickness of the diamond film is 50 $\mu$m. In the germanium-containing resist having the germanium weight ratio of 37.7%, about 50% is absorption by electrons having energy of not more than 1150 eV corresponding to the wavelength of 10.8 Å also when the thickness of the diamond film is 20 $\mu$m bringing the average absorption wavelength of 6.2 $\mu$, and it is understood that the energy of electrons influencing resolution is kept low and blurring is kept small also when the wavelength is reduced.

With respect to exposure light having a wavelength longer than 5 Å, the energy levels of Auger electrons and photoelectrons generated from germanium are not more than 1150 eV, i.e., lower than the energy (1396 eV) of Auger electrons of bromine. When mainly employing an exposure wave range of 10 Å to 5 Å, therefore, resolution may be increased if the germanium-containing resist is employed, since blurring of electrons is smaller than that in the case of employing a bromine-containing resist.

In order to add germanium to the resist, germanium-containing molecules may be bonded to resist molecules, or surface-treated nanograins may be added to the resist. When mixing germanium-containing fullerene, an already existing resist can be employed for short-wave exposure.

Fifteenth Embodiment

In a fifteenth embodiment, energy levels and absorption quantities of Auger electrons and photoelectrons in a case of employing a resist containing iodine having absorption edges on a longer-wave side of germanium are considered. M shells of iodine have a plurality of absorption edges between 13 Å and 20 Å, and Auger electrons having energy of about 510 eV and low-energy photoelectrons are mainly generated at least with reference to light having a wavelength slightly shorter than 13 Å. In other words, Auger electrons having energy corresponding to a wavelength of about 24 Å are generated at the maximum and hence blurring of electrons generated by exposure light having a shorter wavelength than the absorption edges can be reduced.

When the wavelength is further reduced, the energy of Auger electrons remains constant while the energy of photoelectrons is gradually increased and substantially equalized with the energy of Auger electrons in an exposure wave range of about 11 to 8.5 Å. In other words, the energy of electrons generated from iodine is lower than the energy corresponding to the wavelength of about 24 Å with reference to exposure light in the range of about 24 Å to at least 11 Å, and hence blurring of electrons is not increased but a pattern of high resolution is obtained also when the wavelength is reduced. When the wavelength is further reduced, the energy of photoelectrons exceeds that of Auger electrons, to gradually increase blurring of electrons. Still the energy of photoelectrons generated at a wavelength of up to 6.1 Å is lower than the energy (1396 eV) of Auger electrons of bromine.

In other words, the energy of generated photoelectrons is substantially identical to the energy corresponding to the wavelength of 9 Å and Auger electrons have lower energy with reference to the exposure light of 6.1 Å, and hence blurring of electrons is suppressed. Also when the energy of photoelectrons is higher than that of Auger electrons, therefore, it may be possible to reduce blurring of electrons and improve resolution if the energy of generated photoelectrons is low.

It has been shown in this embodiment that blurring of electrons can be reduced as compared with a conventional resist also when adding an element having no absorption edge in the exposure wave range. This is because absorption edges of iodine, not present in the exposure wave range, are present on a shorter-wave side of those of hydrogen, oxygen and carbon. The absorption edge of fluorine is also present on a shorter-wave side of those of hydrogen, oxygen and carbon, and hence blurring of electrons can be reduced also when employing a fluorine-containing resist.

While such a situation can take place also when employing a resist containing bromine, phosphorus, sulfur or silicon in a case of reducing the wavelength, it is obvious from the above embodiments that blurring of electrons is reduced as compared with the conventional resist in this case.

Sixteenth Embodiment

The specific function of the present invention is to reduce blurring of electrons generated by X-rays. According to the present invention, therefore, blurring of generated electrons can be reduced also in exposure employing an electron beam or an ion beam having energy substantially identical to that of soft X-rays.

When irradiating a bromine-containing resist with an electron beam having an acceleration voltage of 1 KeV to 4 KeV corresponding to the energy of an X-ray wavelength of about 3 Å to 13 Å, preferably an acceleration voltage of at least 1.5 KeV, for drawing a pattern, the energy of incident electrons is higher than that corresponding to the absorption edge (1.59 KeV) of bromine and hence incident electrons colliding with bromine partially generate Auger electrons and photoelectrons having lower energy than the incident electrons. Therefore, blurring of electrons in the resist is reduced while resolution of the pattern is increased.

When employing incident electrons having higher energy than that corresponding to the absorption edge of each element in a resist containing silicon, phosphorus, sulfur or chlorine in place of bromine, it follows that spreading of electrons in the resist can be suppressed. Incident electrons are scattered while gradually losing energy in the case of the electron beam, and hence an electron scattering cross section is large in an element such as iodine or bromine having a large atomic number, i.e., an element having a large number of electrons around the atomic nucleus while the scattering probability of electrons tends to increase in the resist containing iodine or bromine for effectively suppressing the range of electrons.

Also when drawing a pattern with an electron beam having a high acceleration voltage of 50 KeV to 100 KeV, incident electrons partially generate Auger electrons and photoelectrons having lower energy than the incident electrons, and hence blurring of electrons in the resist is reduced and resolution of the pattern is increased. Further, the energy of secondary electrons generated in the resist is gradually reduced while repeating scattering, and a similar effect of improving resolution can be expected when the energy reaches 1.6 KeV to 4 KeV. Thus, it is understood that resolution is improved when drawing the pattern on a resist containing an element having an absorption edge corresponding to the energy of about 1.6 KeV to 4 KeV also with an electron beam having a high acceleration voltage of 50 KeV to 100 KeV.

Seventeenth Embodiment

Synchrotron radiation emitted from a radiation generator having deflection field intensity of 4.5 T and acceleration energy of 0.7 GeV was condensed in a beam line employing two rhodium mirrors having an oblique incidence angle of 1° and passed through a beryllium window of 20 μm in thickness serving as a vacuum barrier and a diamond mask substrate of 2 μm in thickness, for applying this light to a substrate coated with a brominated PHS resist of 0.2 μm in thickness having a bromine content of 50 wt. %.

It was possible to form a resist pattern having a pattern dimension of 50 nm when the distance between an X-ray mask and the substrate coated with the resist was 10 μm, and it was possible to form a resist pattern having a pattern dimension of 35 nm when the distance between the X-ray mask and the substrate coated with the resist was 5 μm . A semiconductor device was fabricated by etching a substrate through such a resist pattern serving as a mask, washing the substrate, forming a new film on the substrate and thereafter repeating application of the resist, exposure, working, washing and film formation.

Bromine has an absorption edge at about 8 Å and hence the energy of Auger electrons generated from the brominated PHS resist irradiated with exposure light having a wavelength in the range of 4 Å to 8 Å, shorter than the absorption edge, is higher than that of photoelectrons. Therefore, blurring of electrons is not increased also when short-wave exposure is performed, and a fine pattern can be formed following improvement of an optical image due to Fresnel diffraction. A finer semiconductor device having a high degree of integration can be fabricated by working such a resist pattern.

According to the present invention, as hereinabove described, blurring resulting from secondary electrons generated in a resist subjected to short-wave exposure can be reduced for enabling formation of a high-resolution pattern.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An exposing method including condensing or magnifying X-rays generated from an X-ray source through an X-ray mirror in a beam line, thereafter transmitting the X-rays through a window member serving as a vacuum barrier, further transmitting the X-rays through an X-ray mask consisting of a mask substrate and an absorber pattern thereon, and irradiating a resist with the X-rays, wherein the resist has a main absorption waveband in the wave range of at least 3 Å and not more than 13 Å and contains an element, mainly absorbing the X-rays, and generating Auger electrons having energies of at least about 0.51 KeV and not more than 2.6 KeV, and generating photoelectrons having energies of at least 0.7 KeV and not more than 1.4 KeV.

2. The exposing method according to claim 1, wherein the element is selected from the group consisting of iodine, fluorine, germanium, bromine, silicon, sulfur, phosphorus, and chlorine.

3. The exposing method according to claim 1, wherein the the Auger electrons generated have higher energies than the photoelectrons generated.

4. The exposing method according to claim 1, wherein the main absorption waveband of said resist is in the wave range where the energy of the Auger electrons generated from the element mainly absorbing the X-rays is higher than the energy of the photoelectrons generated from the element mainly absorbing the X-rays.

5. The exposing method according to claim 1, wherein the main absorption waveband of the resist is in the wave range where the energy of the photoelectrons generated from the element mainly absorbing the X-rays is smaller than the energy of Auger electrons generated by carbon.

6. The exposing method according to claim 1, including exposing the resist with an illumination optical system changing the wave range of the X-rays without changing an optical axis to a condensing X-ray mirror or a magnifying X-ray mirror by selecting a position irradiated by the X-rays, wherein every surface coating material of an X-ray mirror having surface coating materials varies with position on the mirror.

7. The exposing method according to claim 1, including exposing the resist with an illumination optical system comprising a wavelength sweeper changing a wavelength without changing an optical axis to a condensing X-ray mirror or a magnifying X-ray mirror by reflecting the X-rays with at least two X-ray mirrors in the beam line.

8. An exposing method of exposing a resist with exposure light formed by an electron beam having an acceleration voltage of at least 1.5 KeV, wherein the resist contains an element generating Auger electrons, mainly generated by said electron beam, having energies of at least about 0.51 KeV and not more than 2.6 KeV and generating photoelectrons having energies of at least 0.7 KeV and not more than 1.4 KeV.

9. The exposing method according to claim 8, wherein the element is selected from the group consisting of iodine, fluorine, germanium, bromine, silicon, sulfur, phosphorus, and chlorine.

10. A semiconductor device fabricated by working a resist pattern on a substrate with an exposing method of condensing or magnifying X-rays generated from an X-ray source through an X-ray mirror in a beam line, thereafter transmitting the X-rays through a window member serving as a vacuum barrier and further transmitting the X-rays through an X-ray mask consisting of a mask substrate and an absorber pattern thereon for irradiating a resist with the X-rays serving as exposure light, wherein the resist has a main absorption waveband in the wave range of at least 3 Å and not more than 13 Å and contains an element, mainly absorbing the X-rays, generating Auger electrons having energy of at least about 0.51 KeV and not more than 2.6 KeV, and generating photoelectrons having energies of at least 0.7 KeV and not more than 1.4 KeV.

11. The semiconductor device fabricated according to claim 10, wherein the element is selected from the group consisting of iodine, fluorine, germanium, bromine, silicon, sulfur, phosphorus, and chlorine.

* * * * *